US010332430B2

(12) United States Patent
Ashby

(10) Patent No.: US 10,332,430 B2
(45) Date of Patent: Jun. 25, 2019

(54) METHOD AND APPARATUS FOR SELF-ILLUMINATING SPORTS, ENTERTAINMENT, EMERGENCY, AND SAFETY DEVICES

(71) Applicant: Glo-Crazy Lure Company, LLC, Payson, AZ (US)

(72) Inventor: Jeffery Luke Ashby, Payson, AZ (US)

(73) Assignee: Glo-Crazy Lure Company, LLC, Payson, AZ (US)

( * ) Notice: Subject to any disclaimer, the term of this patent is extended or adjusted under 35 U.S.C. 154(b) by 0 days.

(21) Appl. No.: 16/232,958

(22) Filed: Dec. 26, 2018

(65) Prior Publication Data

US 2019/0130798 A1 May 2, 2019

Related U.S. Application Data

(63) Continuation of application No. 15/632,342, filed on Jun. 24, 2017, now abandoned, which is a continuation of application No. 12/947,095, filed on Nov. 16, 2010, now Pat. No. 9,691,309, which is a continuation-in-part of application No. 12/606,962, filed on Oct. 27, 2009, now abandoned, which is a continuation-in-part of application No. 12/550,324, filed on Aug. 28, 2009, now abandoned, which is a continuation-in-part of application No. 12/396,786, filed on Mar. 3, 2009, now abandoned, which is a continuation-in-part of application No. 12/263,493, filed on Nov. 2, 2008, now abandoned, which is a continuation-in-part of application No. 12/247,679, filed on Oct. 8, 2008, now abandoned, which is a continuation-in-part of application No. 12/198,080, filed on Aug. 25, 2008, now abandoned, which is a continuation-in-part of application No. 12/043,064, filed on Mar. 5, 2008, now abandoned.

(51) Int. Cl.
*F21K 2/00* (2006.01)
*G09F 13/20* (2006.01)

(52) U.S. Cl.
CPC ..... *G09F 13/20* (2013.01)

(58) Field of Classification Search
CPC ..... G09F 13/20
USPC ..... 362/34
See application file for complete search history.

(56) References Cited

U.S. PATENT DOCUMENTS 1,422,841 A * 7/1922 Dey ..... F21V 9/30 250/464.1
4,610,103 A * 9/1986 Steinman ..... A01K 85/01 43/17.6

* cited by examiner

*Primary Examiner* — Jason M Han
(74) *Attorney, Agent, or Firm* — Michael T. Wallace

(57) ABSTRACT

A method and apparatus for the self-illumination of various objects designed for use in sports, entertainment, safety, and emergency related activities. The objects are caused to self-illuminate by chemiluminescence to facilitate usage of the objects during non-daylight hours or in areas that are otherwise surrounded by darkness. The self-illuminating objects are configured with a hollow channel that forms diametrically opposed openings in a body portion of the self-illuminating objects, the hollow channel being formed to accept fishing line.

11 Claims, 36 Drawing Sheets

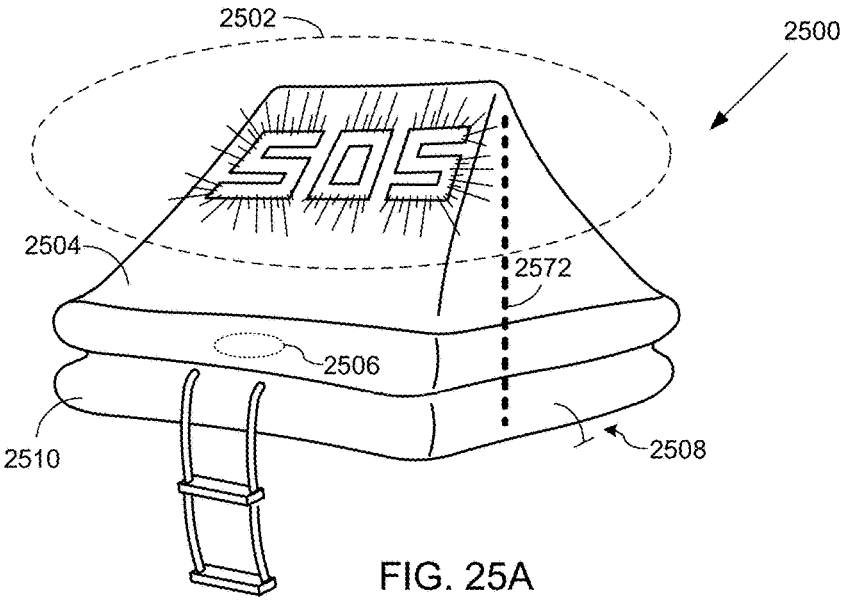
FIG. 25A
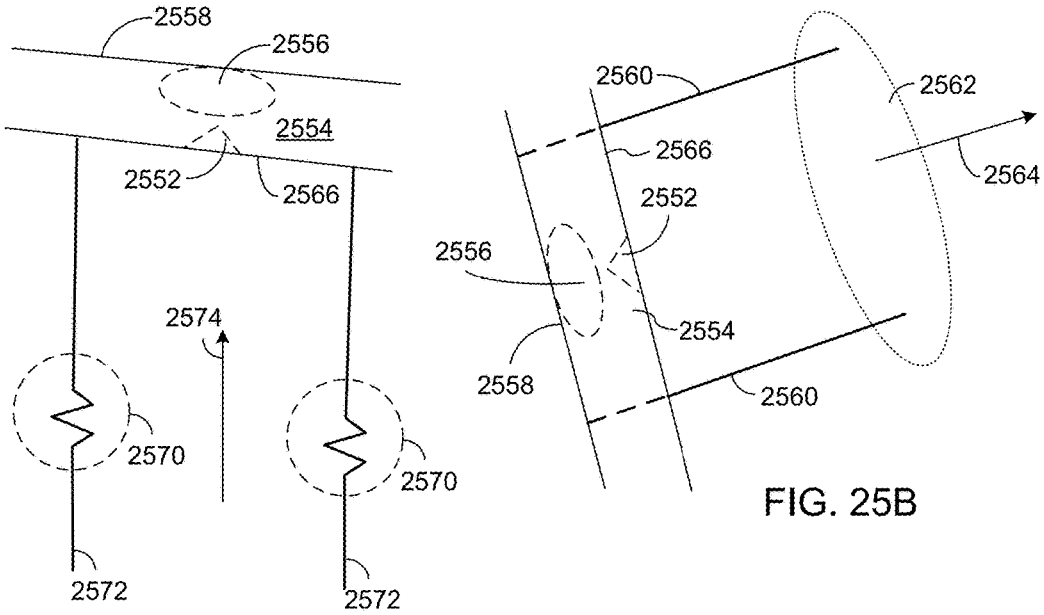
FIG. 25B
FIG. 25C

METHOD AND APPARATUS FOR SELF-ILLUMINATING SPORTS, ENTERTAINMENT, EMERGENCY, AND SAFETY DEVICES

FIELD OF THE INVENTION

The present invention generally relates to sports, entertainment, emergency, and safety devices, and more particularly to self-illuminating sports, entertainment, emergency, and safety devices.

BACKGROUND OF THE INVENTION

The advent of sports and entertainment activities has brought an immeasurable number of hours of enjoyment to all who have partaken, both from the participant's and the spectator's perspective. Until stadium lighting was introduced, however, all group sports were relegated to competitions during daylight hours. Organized baseball, for example, did not see its first nighttime competition until the 1880s, when carbon lamps were introduced to provide illumination of a baseball game played during non-daylight hours. The lighting developed for that game was imperfect, generating just enough illumination to discern the movements of the pitcher, and leaving the impression that nighttime sporting events would be impractical.

Since the 1880s, however, such vast improvements have been made to provide visible light to illuminate sporting activities that virtually every arena built for the purpose of hosting sporting events is now equipped with light generation facilities. It can be said, therefore, that the many advantages associated with hosting sporting events at night has necessitated the development of lighting technology to facilitate such activities.

When sporting and/or entertainment activities are conducted in areas that are not conducive to illumination, however, then other methods must be employed to facilitate the sporting and/or entertainment activities. For example, temporary lighting may be utilized to facilitate illumination within certain areas of parks, beaches, playgrounds, etc., so as to temporarily illuminate those areas for play.

Still other methods to facilitate sporting/entertainment activities involve the illumination of the objects of the activity, rather than the activity itself. For example, zinc-based products may be utilized, such that when the zinc-based products are exposed to ultra-violet (UV) radiation, they glow. As such, the so-called "glow-in-the-dark" products emanate enough visible light to be visible during non-daylight hours. Such zinc-based products, however, require a source of UV radiation, such as sunlight, black-light, or fluorescent light to be used as the charging agent before the zinc-based products may be caused to glow. Zinc-based products, therefore, may not lend themselves well to sporting/entertainment activities that do not have access to such UV radiation sources. Strontium-based products may also be utilized to produce glow effects. Strontium-based products, however, must also be charged with an artificial light source, such as fluorescent or incandescent light, or a natural light source, such as sunlight, before the strontium-based products glow.

Other products, such as emergency devices utilized to preserve the life of those in emergency situations, or to protect the lives of those emergency personnel charged with saving the lives of those in emergency situations, are simply deficient. In particular, while such emergency devices may be implemented with light reflective material, they do not emit light themselves. As such, a separate light source is required so as to activate the reflectivity of the emergency devices to make them visible.

Efforts continue, therefore, to develop self-illuminating objects, useful during sporting, entertainment, emergency, and safety activities, that are not dependent upon a source of light for activation. Furthermore, efforts continue to develop such self-illuminating objects that are not dependent upon a separate source of light to be visible.

SUMMARY OF THE INVENTION

To overcome limitations in the prior art, and to overcome other limitations that will become apparent upon reading and understanding the present specification, various embodiments of the present invention disclose a method and apparatus for self-illuminating sports, entertainment, emergency, and safety devices that self-illuminate without requiring a source of light for activation, or a separate source of light to be visible.

In accordance with one embodiment of the invention, a self-illuminating device comprises a body portion having a skin layer and a hollow channel, the hollow channel extending throughout an interior of the body portion to form first and second diametrically opposed openings in the body portion. The body portion includes a first solution and a vial disposed between the skin layer and the hollow channel, the vial containing a second solution. Depression of the skin layer is operative to rupture the vial to mix the first and second solutions to cause self-illumination of the self-illuminating device.

In accordance with an alternate embodiment of the invention, a self-illuminating device comprises a body portion having a hollow channel extending throughout an interior of the body portion to form first and second diametrically opposed openings in the body portion. The body portion includes a first solution and a vial, the vial containing a second solution. Depression of the body portion is operative to rupture the vial to mix the first and second solutions to cause self-illumination of the self-illuminating device.

In accordance with an alternate embodiment of the invention, a self-illuminating device comprises a body portion having a hollow channel extending throughout an interior of the body portion to form first and second diametrically opposed openings in the body portion. The body portion includes a first solution and a vial, the vial containing a second solution. The body portion is configured to rupture the vial to mix the first and second solutions to cause self-illumination of the self-illuminating device.

BRIEF DESCRIPTION OF THE DRAWINGS

Various aspects and advantages of the invention will become apparent upon review of the following detailed description and upon reference to the drawings in which:

FIG. 25A illustrates an emergency device in accordance with one embodiment of the present invention;

FIGS. 25B-25C illustrate triggering mechanisms used to cause the emergency device of FIG. 25A to self-illuminate;

DETAILED DESCRIPTION

Figure 1:
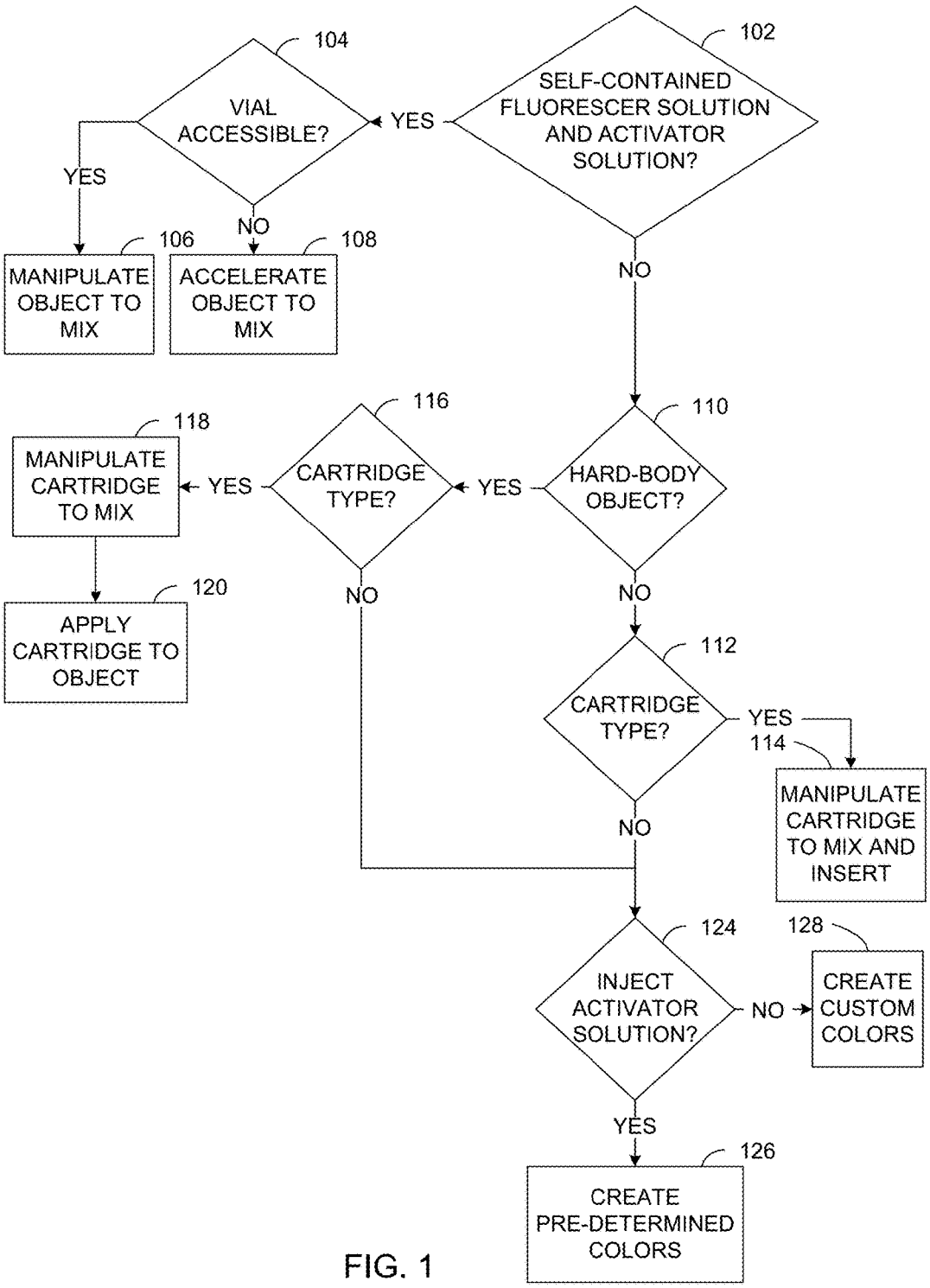
FIG. 1 illustrates a method of activating self-illuminating objects in accordance with the various embodiments of the present invention.

Generally, various embodiments of the present invention are applied to the fields of sports, entertainment, emergency, and safety. In particular, various objects designed for use in the various sports, entertainment, emergency, and safety related activities are activated in accordance with the various embodiments of the present invention and in response are caused to emanate visible light. As such, the objects become self-illuminated to facilitate their usage during non-daylight hours, or in other areas that are otherwise surrounded by darkness. Usage of the self-illuminating objects of the present invention may also be beneficial during daylight, since the self-illuminating effects produced by the self-illuminating objects may nevertheless be beneficial during lit conditions as well. Furthermore, activating the luminescence of the self-illuminating objects does not require a light source, nor do the self-illuminating objects require a separate source of light to be visible.

Instead, chemiluminescence may be utilized to cause emission of visible light from within one or more cavities of the objects, from exterior portions of the objects, or conversely from subcutaneous layers formed within the objects. Chemiluminescence is caused by the reaction in the liquid phase of an activator solution, e.g., hydrogen peroxide, with a fluorescer solution, such as the combination of a fluorescent agent, an oxalate, and a soluble perylene dye. Additional fluorescent agents may also be added to the fluorescer solution to modify the characteristics of the emitted light.

Such activator and fluorescer solutions, for example, are non-toxic and are described in U.S. Pat. Nos. 4,678,608, 4,717,511, 5,122,306, and 5,232,635, which are incorporated herein by reference in their entirety. The color of light that is emitted by the objects after chemiluminescent activation may be designed by appropriate selection of the fluorescer solution to create a wide variety of color selections across the red, orange, yellow, green, blue, indigo, and violet spectrum of visible light. In addition, the intensity of light may be enhanced by the incorporation of a water-soluble polymer, as described in U.S. Pat. No. 4,859,369, which is incorporated herein by reference in its entirety. Further, the stability of the color of light produced when using a rubrene dye may be enhanced by the incorporation of a polymer, as described in U.S. Pat. No. 5,824,242, which is also incorporated herein by reference in its entirety.

It is noted that chemiluminescent activation of the various embodiments of the present invention provided herein is not necessarily caused by the mixing of an activator and a fluorescer solution in their respective liquid states in order to emanate visible light. For example, U.S. Pat. No. 5,348,690, which is also incorporated herein by reference in its entirety, discloses the use of a vinyl halide or a vinylidene halide polymer structure that incorporates one or more of the components of the chemiluminescent reaction. The structure is capable of absorbing an activator solution, such as a mixture of hydrogen peroxide with a sodium salicylate catalyst, which mixes with the components incorporated within the structure to cause emanation of visible light via chemiluminescence.

In alternate embodiments, one or more of the components of the chemiluminescent reaction may exist in a powder, or otherwise solid form, which is not incorporated within the structure. Rather, the powder, or otherwise solid chemiluminescent component, is loosely contained within a cavity of the structure and mixed with an activator solution, such as hydrogen peroxide, to cause emanation of visible light via chemiluminescence.

Various methods are provided herein, whereby the activator solution is brought into contact with the fluorescer solution to cause chemiluminescence. In a first embodiment, for example, a self-illuminating cartridge may contain both a fluorescer solution and a vial that contains the activator solution, or vice-versa. Prior to activation, the fluorescer solution is kept separate from the activator solution by operation of the vial. The outer casing of the self-illuminating cartridge may be composed of a flexible material, such as plastic, rubber, cellophane, etc., so as to allow manipulation of the self-illuminating cartridge to rupture the vial contained within the self-illuminating cartridge. Once the vial is ruptured, the activator solution is released into the fluorescer solution, which then activates the self-illuminating cartridge to cause the emission of visible light from the self-illuminating cartridge by the process of chemiluminescence. The activated, self-illuminating cartridge is then placed within a cavity of the self-illuminating object to produce the emanation of light from within the self-illuminating object.

In an alternate embodiment, the outer casing of the self-illuminating cartridge may be composed of a non-flexible, or rigid, material. In such an instance, manipulation of the self-illuminating cartridge does not rupture the vial contained within the self-illuminating cartridge. Instead, a trigger mechanism that forms a portion of the surface of the outer casing allows the internal vial to be ruptured. Once the vial is ruptured, the activator solution is released into the fluorescer solution, which then activates the self-illuminating cartridge to cause the emission of visible light from the self-illuminating cartridge by the process of chemiluminescence. The activated, self-illuminating cartridge is then placed within a cavity of the self-illuminating object to produce the emanation of light from within the self-illuminating object.

The activated, self-illuminating cartridge may also be shaped in the form of an elongated, flexible, self-illuminating packet that includes an adhesion component to allow attachment of the self-illuminating packet to an object's external periphery. A temporary adhesive, such as a Velcro® mechanism, a zipper mechanism, a channel mechanism, or liquid agent may be applied to the backing of the self-illuminating packet so as to facilitate attachment of the self-illuminating packet to the object. Should a Velcro®, zipper, or channel mechanism be used, the self-illuminating packets may be interchanged as necessary to maintain the desired intensity or desired color once the self-illumination effects have expired, or once a color change is desired.

In alternate embodiments, portions of the self-illuminating object may be pre-filled with a fluorescer solution. Chemiluminescent activation occurs in response to the injection of an activator solution into the fluorescer solution using a syringe or flexible vial. Once injected, the self-illuminating object begins to emanate visible light in a color spectrum that is designed by appropriate selection of the fluorescer solution. In yet another embodiment, a fluorescer solution, instead of an activator solution, is injected into portions of the self-illuminating object that are pre-filled with an activator solution. As such, a variety of vials and/or syringes containing a corresponding variety of fluorescer solution selections may be kept on hand, so as to facilitate color selection within the self-illuminating objects.

In alternate embodiments, portion(s) of the self-illuminating object may be pre-filled with either of a fluorescer solution or an activator solution. Chemiluminescent activation occurs in response to tactile, or acceleration-based, manipulation that causes the rupturing of a vial that is also contained within the object. The vial contains one of an activator solution, or a fluorescer solution, respectively. Once the vial is ruptured, the solutions mix within the object and in response, the self-illuminating object begins to emanate visible light in a color spectrum that is designed by appropriate selection of the fluorescer solution.

Turning to FIG. 1, a flow chart illustrating a method of activating self-illuminating objects in accordance with the various embodiments of the present invention is exemplified. In step 102, as discussed in more detail below, a determination is made as to whether the self-illuminating object already contains the fluorescer solution as well as the activator solution. If so, then the object may be manipulated in step 106 to mix the fluorescer and activator solutions if the vial contained within the self-illuminating object is accessible as determined in step 104.

In one embodiment, accessibility to the vial is facilitated through manipulation of the outer casing of the object, which is sufficiently pliable to allow the vial to be ruptured by manipulation of the outer casing. In alternate embodiments, however, the outer casing of the object is rigid, but manipulation of the vial is nevertheless facilitated through operation of a trigger mechanism that forms a portion of the surface of the outer casing. In such an instance, while the majority of the outer casing is rigid, a small portion of the outer casing is non-rigid, which allows depression of the trigger mechanism to rupture the vial contained within the outer casing. In other embodiments, a reverse trigger mechanism is utilized, whereby the vial is brought into contact with the trigger mechanism to allow rupturing of the vial.

If the vial contained within the self-illuminating object is not accessible, either through manipulation of the outer casing, manipulation of a trigger mechanism that forms a portion of the surface of the outer casing, or through activation of a reverse trigger mechanism, then as discussed in more detail below, acceleration forces are imposed upon the object causing a vial containing one of the activator or fluorescer solutions to rupture as in step 108. For example, if the object is a projectile that does not offer access to the vial contained within the projectile, then acceleration forces imposed upon the projectile causes the vial to rupture, thereby causing the activator and fluorescer solutions to mix. As such, the projectile is caused to self-illuminate during the projectile's trajectory to its intended target by virtue of the acceleration forces imposed upon the projectile as in step 108.

If the object that is to be activated does not already contain the fluorescer solution and the activator solution, then a determination is made in step 110 as to whether the self-illuminating object is hard-bodied. If the object is soft-bodied as may be determined in step 110, then a self-illuminating cartridge, as discussed in more detail below, may be selected in step 112 and manipulated to mix the fluorescer and activator solutions to cause the self-illuminating cartridge to emit visible light as in step 114. The cartridge may then be inserted in step 114 into the cavity of the soft-body object to cause the soft-body object to emit visible light.

If a hard-body object is used, on the other hand, then injection of the fluorescer/activator solutions, or a self-illuminating cartridge, is utilized to produce emanation of light from the hard-body object. If a self-illuminating cartridge is used, as determined in step 116, then a self-illuminating cartridge containing a fluorescer solution and an activator solution is utilized. Prior to activation, the fluorescer solution is kept separate from the activator solution by operation of a vial.

The outer casing of the self-illuminating cartridge may be composed of either of a rigid, or a flexible material. If the outer casing of the self-illuminating cartridge is flexible, then manipulation of the self-illuminating cartridge allows the vial to be ruptured as in step 118. If, on the other hand, the outer casing of the self-illuminating cartridge is rigid, then a trigger mechanism that forms a portion of the outer casing of the self-illuminating cartridge allows the vial to be ruptured as in step 118. Once the vial is ruptured, the activator solution is mixed with the fluorescer solution, which then causes the emission of visible light by the process of chemiluminescence as discussed above.

The self-illuminating cartridge may then be inserted into the inner cavity of the object, as in step 120, and locked into place. The rigid casing of the object may be constructed using a transparent, or sufficiently translucent, composition so as to allow the emission of light from within the inner cavity of the object by the self-illuminating cartridge. As discussed above, the color of light emitted from within the object may be designed by appropriate selection of the fluorescer solution contained within the self-illuminating cartridge and/or appropriate selection of the color used for the outer surface of the object.

Conversely, if hard or soft body objects are being utilized and such objects are not pre-filled with both fluorescer and activator solutions, then injection of either the fluorescer solution, or the activator solution, may be necessary to activate the chemiluminescence. If the activator solution is injected, as determined in step 124, then chemiluminescence of pre-determined colors is performed in step 126, since the fluorescer solution already exists within the object thereby determining the color of light that is emanated from the object.

If fluorescer solution is injected instead of the activator solution, then chemiluminescence of custom colors may be performed as in step 128. In particular, one or more injection ports may be used to individually inject fluorescer solution into the one or more sections of the objects that have been pre-filled with activator solution. In such instances, syringes, or flexible vials, containing the appropriate fluorescer solution may be utilized to create the desired color. As such, a variety of syringes/vials containing a corresponding variety of fluorescer solution selections may be kept on hand, so as to facilitate color experimentation within the objects to optimize performance under the prevailing circumstances.

Figure 2A:
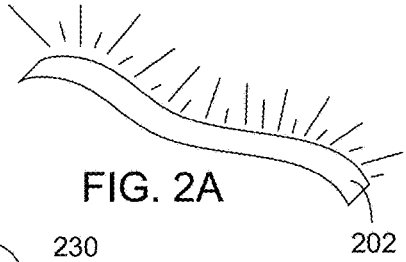
FIG. 2A illustrates a flexible, elongated, self-illuminating packet in accordance with various embodiments of the present invention.
Figure 2B:
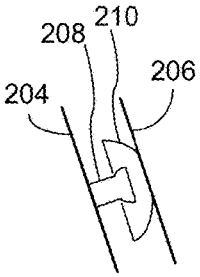
FIG. 2B illustrates a zipper mechanism that may be used as an adhesive for the flexible, elongated, self-illuminating packet of FIG. 2A in accordance with one embodiment of the present invention.
Figure 2F:
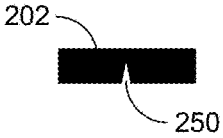
FIG. 2F illustrates a channel mechanism that may be used as an adhesive for the flexible, elongated, self-illuminating packet of FIG. 2A in accordance with one embodiment of the present invention.
Figure 2C:
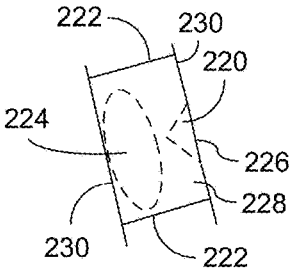
FIG. 2C illustrates a trigger mechanism that may be used to activate self-illumination in accordance with one embodiment of the present invention.
Figure 2D:
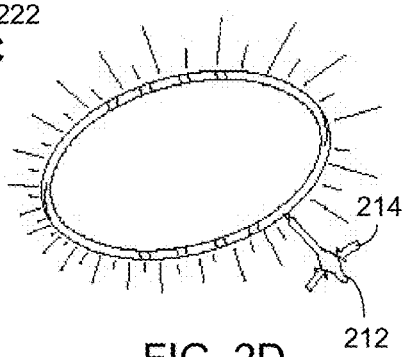
FIGS. 2D and 2E illustrate self-illuminating sports/entertainment devices in accordance with various embodiments of the present invention.
Figure 2E:
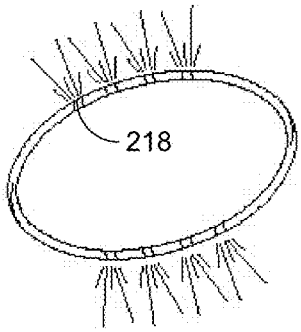

Turning to FIGS. 2D and 2E, a sports/entertainment device, such as a Hula Hoop® device, is adapted to cause self-illumination of portion(s) 218, as exemplified in FIG. 2E, or the entire circumference, as exemplified in FIG. 2D, of the Hula Hoop® object in accordance with various embodiments of the present invention. In a first embodiment, for example, a flexible, elongated, self-illuminating packet 202, as exemplified in FIG. 2A, is utilized that includes an adhesion component to allow attachment of self-illuminating packet 202 to the external periphery of the Hula Hoop® object. Adhesion components, such as a Velcro® mechanism, a zipper mechanism, a channel mechanism, or adhesive components may be applied to the back portion of self-illuminating packet 202 so as to facilitate attachment of self-illuminating packet 202 to the Hula Hoop® object. Should a Velcro®, zipper, or channel mechanism be used, a variety of self-illuminating packets 202 may be interchanged as necessary to maintain the desired intensity or desired color. In particular, one or more of a variety of self-illuminating packets may be caused to self-illuminate as in steps 102-106 of FIG. 1 and then applied to portion(s) 218, or the entire periphery, of the Hula Hoop® object to make the Hula Hoop® object self-illuminate.

Turning to FIG. 2B, an exemplary zipper mechanism is illustrated, whereby either of a length of zipper portion 204 or a length of zipper portion 206 may be attached to the back side of self-illuminating packet 202. The mating portion may then be fastened to portions of the periphery of the Hula Hoop® object, so as to allow engagement of male member 208 of zipper portion 204 with female member 210 of zipper portion 206. Once mated, zipper portions 204 and 206 remain temporarily engaged so as to maintain the attachment of self-illuminating packet 202 to the Hula Hoop® object.

Turning to FIG. 2F, an exemplary channel mechanism is illustrated, whereby channel 250 is formed along the back side of self-illuminating packet 202. As discussed in more detail below, objects receiving self-illuminating packet 202 may employ a mating portion so as to allow a frictional engagement between the mating portion of the object and channel 250. Once mated, self-illuminating packet 202 remains temporarily engaged to the mating portion of the object so as to maintain the attachment of self-illuminating packet 202 to the object.

In an alternate embodiment, internal channel 228 may be formed between walls 230 of the Hula Hoop® object as illustrated in FIG. 2C. Interior channel 228 may then be pre-filled with either of a fluorescer, or an activator, solution that is caused to self-illuminate by the injection of either of an activator, or a fluorescer, solution, respectively, as in steps 124-128 of FIG. 1. The injection may be facilitated, for example, by applying pressure in direction 214 on flexible vial 212, as illustrated in FIG. 2D, so as to cause the solution contained within vial 212 to be injected into internal channel 228 of the Hula Hoop® object.

In other embodiments, the Hula Hoop® object may be pre-filled with both an activator solution and a fluorescer solution that are kept separate through use of vial 224 as illustrated in FIG. 2C. Vial 224 may be affixed to an inner portion of wall 230 of the Hula Hoop® object so as to facilitate rupture of the vial using tactile depression of trigger 220 as in steps 102-106 of FIG. 1. In particular, surface 226 of trigger 220 forms a portion of the outer surface of the Hula Hoop® object and is sufficiently pliable so as to allow depression of trigger 220 to engage vial 224. Applying a sufficient amount of force upon surface 226 causes trigger 220 to rupture vial 224, which then allows the activator and fluorescer solutions to mix. The mixed solutions then cause internal channel 228 to emit visible light, which in turn causes the Hula Hoop® object to self-illuminate.

In other embodiments, segregated interior channel portion(s) may be created within the Hula Hoop® object by use of separating walls 222 as illustrated in FIG. 2C. The interior channel portion(s) may be pre-filled with the activator and fluorescer solutions, wherein the activator and fluorescer solutions are kept separate by vial(s) 224. Applying a sufficient amount of force upon surface 226 causes trigger 220 to rupture vial 224, which then allows the activator and fluorescer solutions to mix. The mixed solutions then cause only the segregated interior portions of the Hula Hoop® object to self-illuminate to create the self-illuminating effects as exemplified in relation to FIG. 2E.

It is understood that the embodiments exemplified in FIGS. 2D and 2E may not necessarily represent Hula Hoop® objects. Instead, FIGS. 2D and 2E may exemplify any annular sports/entertainment object that may be caused to emanate visible light as discussed above. For example, the objects of FIGS. 2D and 2E may represent diving rings that are used in a swimming pool to mark dive targets for divers who are utilizing the swimming pool during nighttime, or otherwise dark conditions.

Figure 3A:
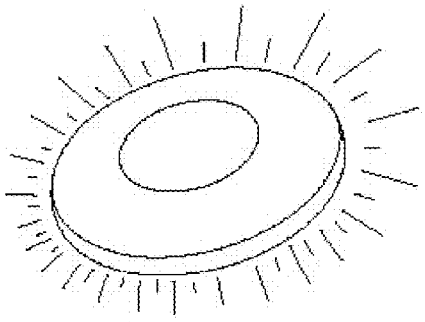
FIGS. 3A and 3B illustrate self-illuminating sports/entertainment devices in accordance with alternate embodiments of the present invention.
Figure 3B:
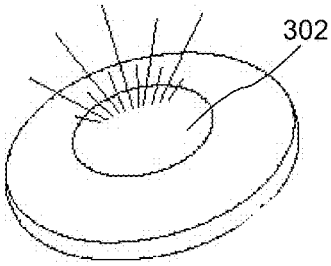

Turning to FIGS. 3A and 3B, a sports/entertainment device, such as a Frisbee® object is exemplified, whereby similar to the objects of FIGS. 2D and 2E, the entire periphery of the Frisbee® object, or a portion of the Frisbee® object, respectively, may be caused to self-illuminate in accordance with various embodiments of the present invention. In a first embodiment, for example, flexible, elongated, self-illuminating packet 202, as discussed above in relation to FIG. 2A, is utilized that includes an adhesion component to allow attachment of self-illuminating packet 202 to the external periphery of the Frisbee® object. Adhesion components, such as a Velcro® mechanism, a zipper mechanism, a channel mechanism, or other adhesive mechanisms may be applied to the back portion of self-illuminating packet 202 so as to facilitate attachment of self-illuminating packet 202 to the Frisbee® object. Should a Velcro®, zipper, or channel mechanism be used, a variety of self-illuminating packets 202 may be interchanged as necessary to maintain the desired intensity or desired color. In particular, one or more of a variety of self-illuminating packets may be caused to self-illuminate as in steps 106-108 of FIG. 1 and then applied to the entire periphery of the Frisbee® object to generate the self-illuminating effects as exemplified in FIG. 3A.

Turning to FIG. 3B, cavity 302 of the Frisbee® object may be formed and pre-filled with both an activator solution and a fluorescer solution, each being kept separate through use of a vial (not shown in FIG. 3B, but similar to vial 224 as discussed above in relation to FIG. 2C). The vial may be affixed to an interior portion of cavity 302 so as to facilitate the rupturing of the vial using tactile depression of the trigger (not shown) as discussed above in relation to FIG. 2C. Applying a sufficient amount of force upon the trigger causes the vial to rupture, which then allows the activator and fluorescer solutions to mix as in steps 102-106 of FIG. 1. The mixed solutions then cause cavity 302 of the Hula Hoop® object to self-illuminate as exemplified in FIG. 3B.

In an alternate embodiment, the chemiluminescence of portion 302 may be activated by the introduction of an activator solution into portion 302, which may be composed of a vinyl halide or a vinylidene halide polymer structure that incorporates one or more of the components of the fluorescer solution. In such an instance, portion 302 is capable of absorbing an activator solution, such as a mixture of hydrogen peroxide with a sodium salicylate catalyst, which mixes with the fluorescer components incorporated within portion 302 to cause emanation of visible light via chemiluminescence. Injection of the activator solution may be facilitated by rupturing a vial containing the activator solution through use of a trigger mechanism as discussed above in relation to FIG. 2C, or conversely by depressing a flexible vial containing the activator solution as discussed above in relation to FIG. 2D.

Figure 4:
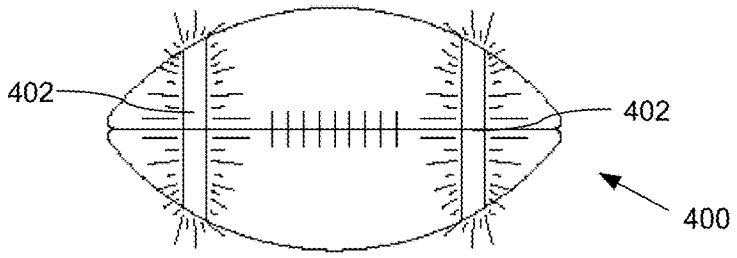
FIG. 4 illustrates a self-illuminating sports/entertainment device in accordance with an alternate embodiment of the present invention.

Turning to FIG. 4, a sports/entertainment device, such as football 400, is exemplified, whereby similar to the objects of FIGS. 2E and 3B, respectively, only a portion of the object may be caused to self-illuminate in accordance with various embodiments of the present invention. In a first embodiment, for example, flexible, elongated, self-illuminating packet 202, as discussed above in relation to FIG. 2A, is utilized that includes an adhesion component to allow attachment of self-illuminating packet 202 to portions 402 of football 400. Adhesion components, such as a Velcro® mechanism, a zipper mechanism, a channel mechanism, or other adhesive mechanisms may be applied to the back portion of self-illuminating packet 202 so as to facilitate attachment of self-illuminating packet 202 to portions 402 of football 400. Should a Velcro®, zipper, or channel mechanism be used, a variety of self-illuminating packets 202 may be interchanged as necessary to maintain the desired intensity or desired color. In particular, one or more of a variety of self-illuminating packets may be caused to self-illuminate as in steps 102-106 of FIG. 1 and then applied to portions 402 of football 400 to cause the self-illuminating effects as exemplified in FIG. 4.

Figure 5A:
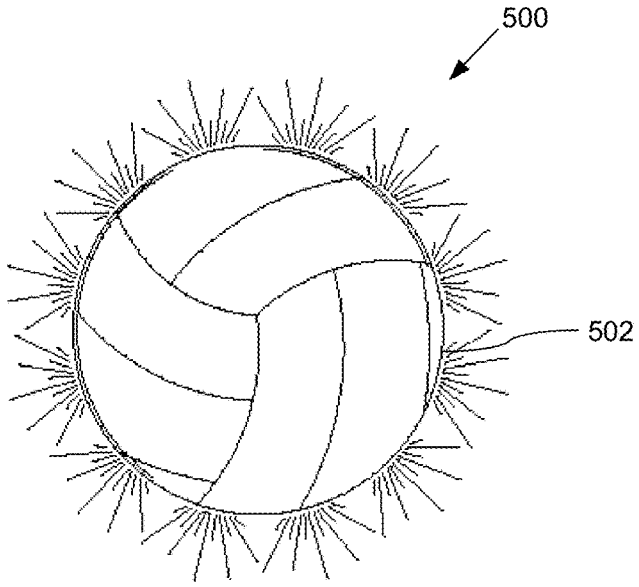
FIGS. 5A-5B illustrate a self-illuminating sports/entertainment device in accordance with alternate embodiments of the present invention.
Figure 5B:
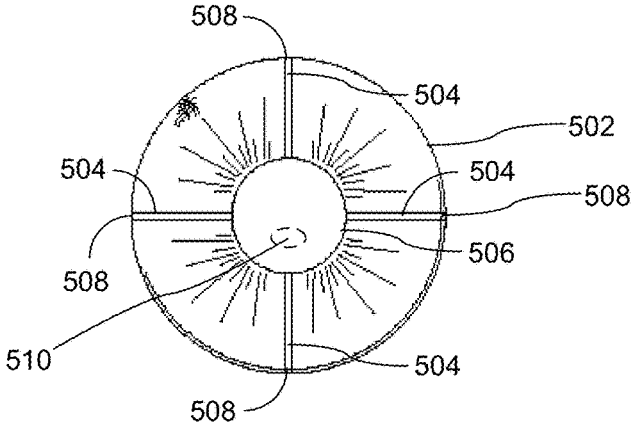

Turning to FIG. 5A, a sports/entertainment device, such as soccer ball 500, is exemplified, whereby the entire sphere 502 of soccer ball 500 is caused to self-illuminate in accordance with various embodiments of the present invention. In particular, sphere 502 is formed of a transparent or translucent material, such that all, or a portion of, the visible light emitted from globe 506, as illustrated in FIG. 5B, may pass through sphere 502 to allow soccer ball 500 to self-illuminate.

In one embodiment, for example, sphere 502 may contain an interior globe 506, which may be pre-filled with either of a fluorescer, or an activator, solution that is caused to self-illuminate by the injection of either of an activator, or a fluorescer, solution, respectively, as in steps 124-128 of FIG. 1. The injection may be facilitated through the use of, e.g., flexible vial 212 as discussed above in relation to FIG. 2D, by applying pressure in direction 214 on flexible vial 212 so as to cause the solution contained within vial 212 to be injected into globe 506 via channels 504.

In such an instance, channels 504 serve two purposes. First, channels 504 provide structural support so as to maintain globe 506 to be substantially centered within sphere 502. Second, channels 504 provide one-way injection ports 508, to allow solution to be injected into globe 506, via channels 504, while preventing leakage of solution from globe 506 via channels 504. Air bladders (not shown) may also be employed between the outer portions of globe 506 and the inner portions of sphere 502 to further maintain globe 506 substantially centered within sphere 502. The air bladders are preferably either transparent, or at least translucent, so as to facilitate the emanation of visible light from sphere 502, while also providing elasticity to the soccer ball.

In other embodiments, globe 506 of soccer ball 500 may be pre-filled with both an activator solution and a fluorescer solution that are kept separate through use of vial 510. In such an instance, the walls of vial 510 may be composed of a material that is designed to rupture in response to exposure to a pre-determined amount of acceleration force imposed upon vial 510. For example, soccer ball may be kicked with an amount of force that subjects vial 510 to an acceleration that is sufficient to rupture vial 510, as in step 108 of FIG. 1, but insufficient to rupture globe 506. The solutions within globe 506 are then caused to mix, which causes globe 506 to self-illuminate, which in turn causes the emanation of visible light from sphere 502 of soccer ball 500 subsequent to the kicking of soccer ball 500. In such an instance, channels 504 function only to maintain globe 506 substantially centered within sphere 502. In other embodiments, a transparent, or translucent, air bladder (not shown) may be employed between the outer portions of globe 506 and the inner portions of sphere 502 to maintain globe 506 substantially centered within sphere 502, to provide elasticity to the soccer ball, and to facilitate the emanation of visible light from sphere 502.

In alternate embodiments, one or more trigger mechanisms (not shown) similar to those discussed above in relation to FIG. 2C may be installed in place of injection ports 508, where the trigger mechanisms form a portion of the outer surface of sphere 502. In such an instance, one or more vials 510 may be attached to the inner walls of channels 504, such that depression of the trigger mechanisms causes the vials to rupture as in steps 102-106 of FIG. 1. Solution contained within the vials is then allowed to propagate to globe 506 via channels 504, which then mixes with the solution contained within globe 506 via channels 504 to cause globe 506 to self-illuminate.

As discussed above, globe 506 may instead be composed of a vinyl halide or a vinylidene halide polymer structure that incorporates one or more of the components of the fluorescer solution. Activator solution released by ruptured vials 510 is then absorbed by globe 506 to cause self-illumination of globe 506.

Figure 6A:
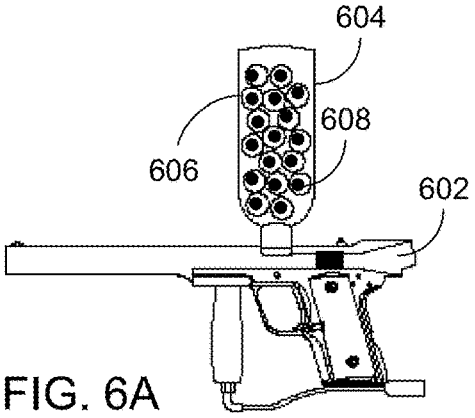
FIGS. 6A-6C illustrate acceleration-activated, self-illuminating sports/entertainment devices in accordance with alternate embodiments of the present invention.
Figure 6B:
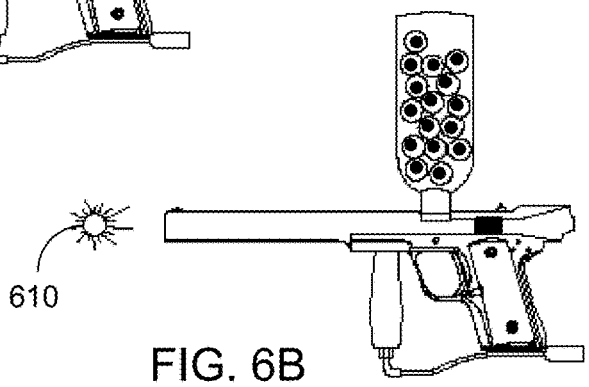
Figure 6C:
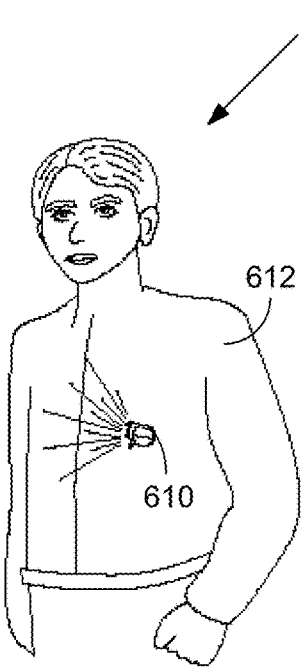

Turning to FIGS. 6A-6C, alternate embodiments of an acceleration-based, self-illuminating activation sporting/entertainment device is exemplified. In particular, pistol 602 is arranged to accept magazine 604, which is filled with paint balls 606 having vials 608 displaced therein. As discussed above in relation to FIG. 5B, the walls of vials 608 may be composed of a material that is designed to rupture in the existence of a pre-determined amount of acceleration force imposed upon vials 608.

For example, pistol 602 may exert an acceleration force on paint ball 606 that is defined in equation (1) as:

$$a = \frac{v^2}{2s}, \tag{1}$$

where a is the acceleration force imposed upon paint ball 606, v is the muzzle velocity of paint ball 606, and s is the barrel length of pistol 602. Appropriate design of pistol 602 parameters, v and s, may cause a sufficient amount of acceleration force to rupture vial 608 when firing paint ball 606 from pistol 602, as in step 108 of FIG. 1, but with insufficient acceleration force to rupture paint ball 606 due to the relative non-pliability of the outer surface of paint ball 606. The solutions within paint ball 606 are then caused to mix, which causes paint ball 610 to self-illuminate, as illustrated in FIG. 6B, which in turn causes a tracer effect to be exhibited by paint ball 610 along its trajectory.

That is to say, in other words, that while paint balls 606 reside within magazine 604, vials 608 remain intact, thus preventing the mixing of the activator and fluorescer solutions contained within paint balls 606. Players utilizing the pistol assemblies of FIGS. 6A and 6B may, therefore, remain stealthy at night, or in other surroundings of darkness, since paintballs 606 are not yet self-illuminating. Upon the firing of paintball 610 from pistol 602, however, acceleration forces in accordance with equation (1) that are sufficient to rupture vial 608, but that are insufficient to rupture paint ball 606, are exerted upon paint ball 610 as in step 108 of FIG. 1. While paint ball 610 is traversing its trajectory, paint ball 610 begins to self-illuminate, thereby creating a trace of light along the path of trajectory. Should the self-illuminating paintball find its intended target, as illustrated in FIG. 6C, paintball 610 continues to self-illuminate after being ruptured upon impact with player 600, thereby undeniably marking player 600 as having been scored upon.

Clothing 612, as worn by player 600, may be designed to absorb the activator and fluorescer solutions once paint ball 610 is ruptured. That is to say, in other words, that clothing 612 may be designed with high absorption properties so as to maintain the activator and fluorescer solutions in their respective liquid states for a prolonged duration of time after paint ball 610 ruptures upon impact with person 600. In such an instance, continuation of the light emissions exhibited by the contents of paint ball 610 are facilitated by retarding the evaporation of the activator and fluorescer solutions through use of appropriately designed absorptive clothing 612.

In an alternate embodiment, magazine 604 may instead be exposed to an amount of force, e.g., by shaking magazine 604, that subjects vials 608 to an acceleration that is sufficient to rupture vials 608, as in step 108 of FIG. 1, but insufficient to rupture paint balls 606 due to the relative non-pliability of the outer surface of paint balls 606. The solutions within paint balls 606 are then caused to mix, which causes paint balls 606 to self-illuminate, which in turn causes the emanation of visible light from paint balls 606.

By designing magazine 604 to be non-transparent and non-translucent, visible light is prevented from being emanated by magazine 604 after activation of paint balls 606 contained therein. As such, players utilizing the pistol assemblies of FIGS. 6A and 6B may, therefore, remain stealthy at night, or in other surroundings of darkness, since despite the self-emanation of visible light from paintballs 606, magazine 604 prevents visibility of paint balls 606. Only when paintballs 606 are fired, do they cause the tracer effects as discussed above.

Figure 6D:
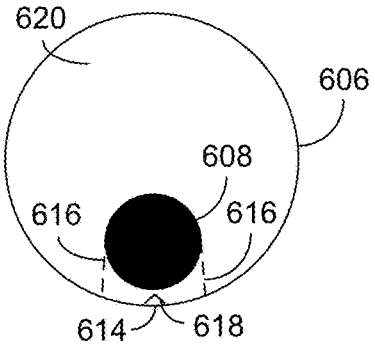
FIG. 6D illustrates a trigger activated, self-illuminating sports/entertainment device in accordance with alternate embodiments of the present invention.

In other embodiments as illustrated in FIG. 6D, a trigger mechanism may instead be employed. In particular, paint ball 606 may be pre-filled with both an activator solution and a fluorescer solution that are kept separate through use of vial 608. Vial 608 may be affixed to an inner portion of paint ball 606 via supports 616 so as to facilitate rupture of the vial using tactile depression of trigger 618 as in steps 102-106 of FIG. 1. In particular, surface 614 of trigger 618 forms a portion of the surface of paint ball 606 and is sufficiently pliable so as to allow depression of trigger 618 to engage vial 608. Applying a sufficient amount of force upon surface 614 causes trigger 618 to rupture vial 608, which then allows the activator and fluorescer solutions to mix. The mixed solutions then cause internal channel 620 of paint ball 606 to emit visible light, which in turn causes paint ball 606 to self-illuminate. Once self-illuminated, paint ball 606 may be inserted into the chamber of pistol 602 in preparation for firing.

Figure 7B:
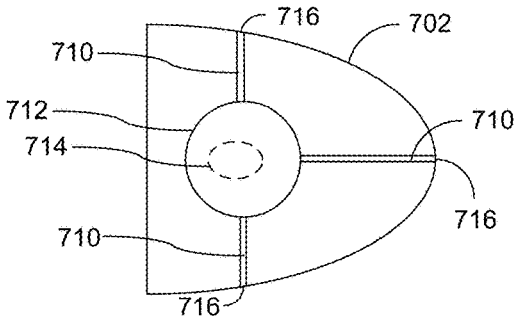
FIGS. 7A-7E illustrate acceleration, trigger or injection activated, self-illuminating sports/entertainment devices in accordance with alternate embodiments of the present invention.
Figure 7A:
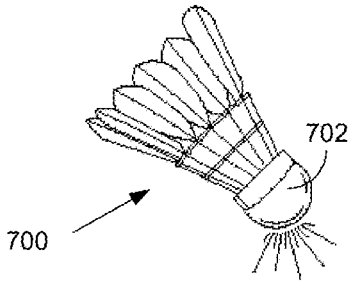

Turning to FIG. 7A, a sports/entertainment device, such as shuttlecock 700, is exemplified, whereby the entire semi-sphere 702 of shuttlecock 700 is caused to self-illuminate in accordance with various embodiments of the present invention. In particular, semi-sphere 702 is formed of a transparent or translucent material, such that all, or a portion of, the visible light emitted from globe 712 contained within semi-sphere 702, as illustrated in FIG. 7B, may pass through semi-sphere 702 to allow semi-sphere 702 to emanate visible light.

In one embodiment, semi-sphere 702 may contain interior globe 712, which may be pre-filled with either of a fluorescer, or an activator, solution that is caused to self-illuminate by the injection of either of an activator, or a fluorescer, solution, respectively, as in steps 124-128 of FIG. 1. The injection may be facilitated through the use of, e.g., flexible vial 212 as discussed above in relation to FIG. 2D, by applying pressure in direction 214 on flexible vial 212 so as to cause the solution contained within flexible vial 212 to be injected into globe 712 via channels 710 contained within semi-sphere 702. In such an instance, channels 710 serve two purposes. First, channels 710 provide structural support so as to maintain globe 712 substantially centered within semi-sphere 702. Second, channels 710 provide one-way injection ports 716, to allow solution to be injected into globe 712, via channels 710, while preventing leakage of solution from globe 712 via channels 710. Air bladders (not shown) may also be employed between the outer portions of globe 712 and the inner portions of semi-sphere 702 to further maintain globe 712 substantially centered within semi-sphere 702. The air bladders are preferably either transparent, or translucent, so as to facilitate the emanation of visible light from semi-sphere 702, while providing elasticity to semi-sphere 702.

In other embodiments, globe 712 of shuttlecock 700 may be pre-filled with both an activator solution and a fluorescer solution that are kept separate through use of vial 714. In such an instance, the walls of vial 714 may be composed of a material that is designed to rupture in response to exposure to a pre-determined amount of acceleration force imposed upon vial 714. For example, shuttlecock 700 may be struck by racquet 730 with an amount of force that subjects vial 714 to an acceleration force that is sufficient to rupture vial 714, as in step 108 of FIG. 1, but insufficient to rupture globe 712. The solutions within globe 712 are then caused to mix, which causes globe 712 to self-illuminate, which in turn causes the emanation of visible light from semi-sphere 702 of shuttlecock 700 in response to the striking of shuttlecock 700 by racquet 730. In such an instance, channels 710 function only to maintain globe 712 substantially centered within semi-sphere 702. In other embodiments, a transparent, or translucent, bladder (not shown) may be employed between the outer portions of globe 712 and the inner portions of semi-sphere 702 to maintain globe 712 substantially centered within semi-sphere 702, to provide elasticity to semi-sphere 702, and to facilitate the emanation of visible light from semi-sphere 702.

In alternate embodiments, one or more trigger mechanisms (not shown) similar to those discussed above in relation to FIG. 2C may be installed in place of injection ports 716, where the trigger mechanisms form a portion of the outer surface of semi-sphere 702. In such an instance, one or more vials 714 may be attached to the inner walls of channels 710, such that depression of the trigger mechanisms causes the vials to rupture as in steps 102-106 of FIG. 1. Solution contained within the vials is then allowed to propagate to globe 712 via channels 710, which then mixes with the solution contained within globe 712 via channels 710 to cause globe 712 to self-illuminate.

As discussed above, globe 712 may instead be composed of a vinyl halide or a vinylidene halide polymer structure that incorporates one or more of the components of the fluorescer solution. Activator solution released by ruptured vials 714 is then absorbed by globe 712 to cause self-illumination of globe 712.

Figure 7C:
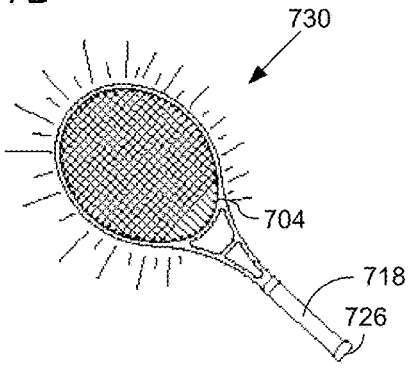

Turning to FIG. 7C, racquet 730 may also be caused to emanate visible light as illustrated by employing similar mechanisms as discussed above in accordance with various embodiments of the present invention. For example, frame 704 of racquet 730 may be manufactured as a hollow frame that exhibits transparent, or translucent, attributes. Further, handle 718 may similarly be formed of a hollow structure, where the cavity of frame 704 is in communication with the cavity of handle 718 to allow one of an activator, or fluorescer, solution to propagate throughout frame 704 and handle 718.

Figure 7D:
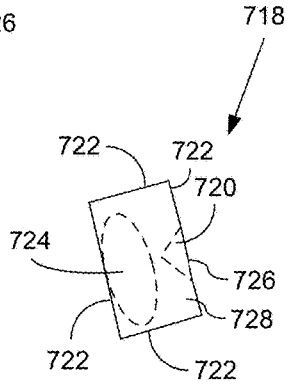

Frame 704 may then be pre-filled with both an activator solution and a fluorescer solution that are kept separate through use of vial 724 as illustrated in FIG. 7D. Vial 724 may be affixed to an inner portion of walls 722 of handle 718 so as to facilitate rupture of the vial using tactile depression of trigger 720 as in steps 102-106 of FIG. 1. In particular, surface 726 of trigger 720 forms a portion of the surface of handle 718 and is sufficiently pliable so as to allow depression of trigger 720 to engage vial 724. Applying a sufficient amount of force upon surface 726 causes trigger 720 to rupture vial 724, which then allows the activator and fluorescer solutions contained within handle 718 and frame 704 to mix. The mixed solutions then cause internal channel 728 to emit visible light, which in turn causes frame 704 and handle 718 of racquet 730 to self-illuminate.

Figure 7E:
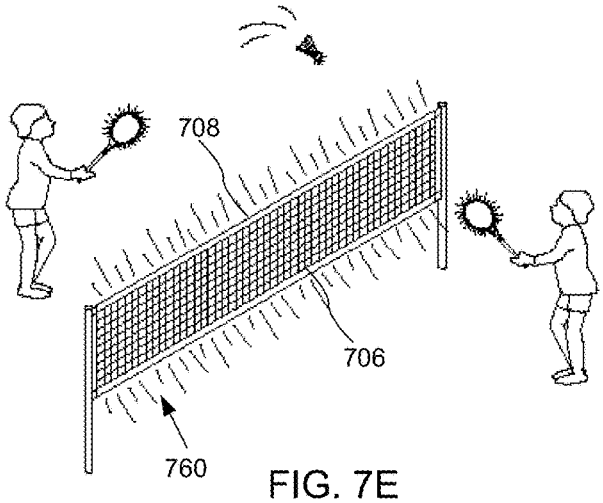

Turning to FIG. 7E, an illustration of an exemplary activity, such as the execution of a game of badminton, is exemplified, whereby racquets 730, shuttlecock 700, and net 760 are caused to emanate visible light in accordance with various embodiments of the present invention. Portions 706 and 708 of net 760 may be caused to emanate visible light, for example, through the use of flexible, elongated, self-illuminating packet 202, as discussed above in relation to FIG. 2A. Self-illuminating packet 202 includes an adhesion component to allow attachment of self-illuminating packet 202 to portions 706 and 708 of net 760. Adhesion components, such as a Velcro® mechanism, a zipper mechanism, a channel mechanism, or other adhesives may be applied to the back portion of self-illuminating packet 202 so as to facilitate attachment of self-illuminating packet 202 to portions 706 and 708 of net 760. Should a Velcro®, zipper, or channel mechanism be used, a variety of self-illuminating packets 202 may be interchanged as necessary to maintain the desired intensity or desired color. In particular, one or more of a variety of self-illuminating packets may be caused to self-illuminate as in steps 102-106 of FIG. 1 and then applied to portions 706 and 708 of net 760 to cause the self-illuminating effects of net 760 as exemplified in FIG. 7E.

Figure 8B:
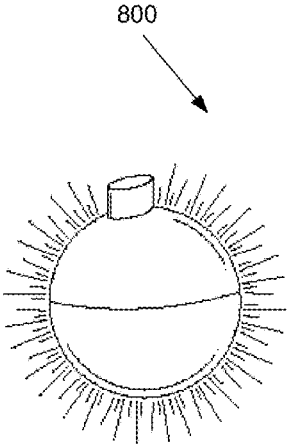
FIGS. 8A-8C illustrate a self-illuminating, sports/entertainment device in accordance with alternate embodiments of the present invention.
Figure 8A:
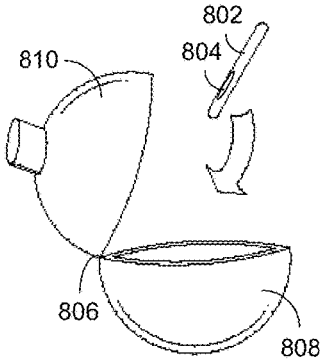

Turning to FIG. 8A, an entertainment/sporting object such as fishing bobber 800 is implemented with hinged member 806, so that upper portion 810 may be separated from lower portion 808. In so doing, an inner cavity within fishing bobber 800 is exposed to accept self-illuminating cartridge 802 that may contain a fluorescer or activator solution, as well as vial 804 that contains an activator or fluorescer solution, respectively. Prior to activation, the two solutions are kept separate by operation of vial 804. The outer casing of self-illuminating cartridge 802 may be composed of a flexible material, so as to allow manipulation of self-illuminating cartridge 802 to rupture vial 804 as in step 118 of FIG. 1.

In an alternate embodiment, the outer casing of self-illuminating cartridge 802 may be composed of a non-flexible, or rigid, material. In such an instance, manipulation of self-illuminating cartridge 802 does not rupture the vial contained within self-illuminating cartridge 802. Instead, a trigger mechanism (not shown), as discussed above in relation to FIG. 2C, that forms a portion of the surface of the outer casing of self-illuminating cartridge 802 allows vial 804 to be ruptured. Once vial 804 is ruptured, the solutions are allowed to mix, which then causes the emission of visible light by the process of chemiluminescence. In yet other embodiments, cartridge 802 may be configured with a subcutaneous layer and an inner core having varying degrees of buoyancy as discussed below, for example, in relation to FIG. 12A.

Self-illuminating cartridge 802 may then be inserted into the inner cavity of fishing bobber 800, as in step 120 of FIG. 1, and locked into place by engaging upper portion 810 with lower portion 808 via hinged member 806 as illustrated in FIG. 8B. The rigid casing of fishing bobber 800 may be constructed using a transparent, or sufficiently translucent, composition so as to allow the emission of light from within the inner cavity of fishing bobber 800 by self-illuminating cartridge 802. As discussed above, the color of light emitted from within fishing bobber 800 may be designed by appropriate selection of the fluorescer solution contained within self-illuminating cartridge 802.

In alternate embodiments, the light emitted by self-illuminating cartridge 802 may include all visible spectrums of light, so that the color of light emitted by self-illuminating cartridge 802 is white. In such instances, fishing bobber 800 may be covered with a transparent, or sufficiently translucent, coating that is tinted in accordance with the color of light that is desired to be emitted by fishing bobber 800. Accordingly, multiple luminescent effects and colors may be emitted by fishing bobber 800 of FIG. 8B upon activation of self-illuminating cartridge 802.

In alternate embodiments, as discussed in more detail below in relation to FIG. 12A, fishing bobber 800 may not employ hinged member 806, but may instead be implemented as a single-piece unit. The single-piece unit exhibiting a subcutaneous layer that may be activated in accordance with the various embodiments discussed herein to cause fishing bobber 800 to self-illuminate.

Figure 8C:
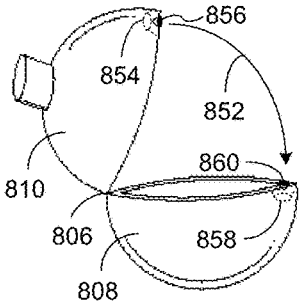

In yet an alternate embodiment as illustrated in FIG. 8C, upper portion 810 and/or lower portion 808 may contain a fluorescer or activator solution, as well as vials 854 and/or 858, respectively, that contain either an activator or fluorescer solution, respectively. Prior to activation, the two solutions are kept separate by operation of vials 854 and/or 858. Upon closure of upper portion 810 with lower portion 808 in direction 852, compression forces between upper portion 810 and lower portion 808 engage trigger mechanisms 856 and/or 858, thereby causing vials 854 and/or 858 to rupture. The solutions contained within upper portion 810 and/or lower portion 808 are then allowed to mix with solution contained within vials 854 and/or 858, which then causes the emission of visible light by the process of chemiluminescence from upper and/or lower portions 810 and/or 808 as illustrated in FIG. 8B.

Figure 9A:
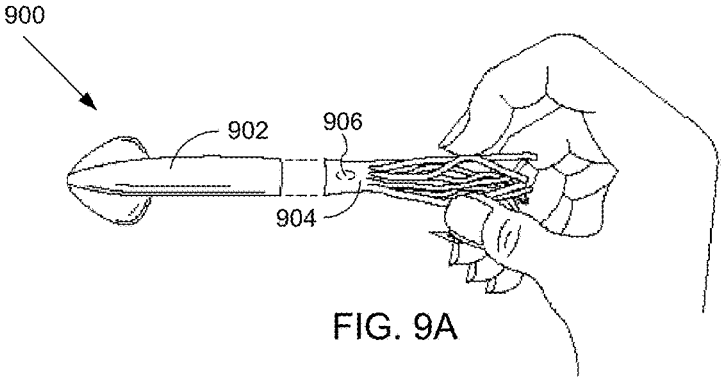
FIGS. 9A-9C illustrate a self-illuminating sports/entertainment device in accordance with alternate embodiments of the present invention.
Figure 9B:
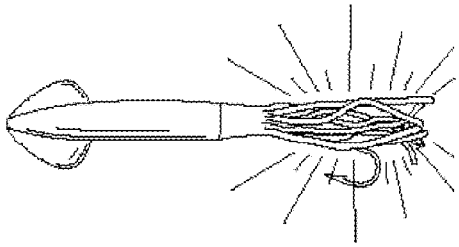

Turning to FIG. 9A, an entertainment/sporting object such as a self-illuminating fishing lure is exemplified that exhibits body parts that are detachable. In particular, soft-body fishing lure 900 may be comprised of attachable/detachable body parts 902 and 904, whereby body part 904 may be pre-filled with fluorescer and activator solutions that are kept separate by operation of vial 906. Upon manipulation of body part 904, vial 906 is caused to be ruptured as in steps 102-106 of FIG. 1. The activator and fluorescer solutions are then caused to mix, which in turn causes tentacle portion 904 of soft-body fishing lure 900 to self-illuminate. Body parts 902 and 904 may then be attached, as illustrated in FIG. 9B, to allow specific body portions of soft-body fishing lure 900 to emanate visible light by chemiluminescence as discussed above. It should be noted that virtually any body part of soft-body lure 900 may be designed to be attachable/detachable and subsequently caused to individually self-illuminate as discussed above.

Figure 9C:
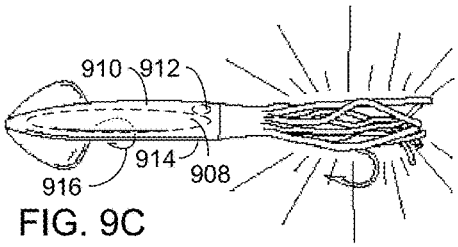

In an alternate embodiment, as illustrated in FIG. 9C, detachable portion 902 may be hollow, or may optionally contain core portion 908, which creates subcutaneous layer 910 that exists between skin layer 914 and core portion 908. In such an instance, vial 912 is either contained within the hollow portion of detachable portion 902, or subcutaneous layer 910, either of which is also filled with either of an activator or fluorescer solution. Core portion 908 may be a semi-rigid structure that provides rigidity to detachable portion 902 while also allowing detachable portion 902 to remain pliable so as to better emulate a prey fish. In other words, should skin layer 914 lack sufficient rigidity, core portion 908 may optionally be added to maintain an effective prey fish emulation. Core portion 908 may also be optionally added to press subcutaneous layer 910 against the inner portion of skin layer 914 as illustrated, so as to improve self-illumination properties of detachable portion 902. Hook portion 916 may also be implemented as a pre-fabricated assembly with core portion 908, so as to obviate the need to rig hook portion 916 through core portion 908, thereby avoiding the possibility of rupturing subcutaneous layer 910 during the rigging process.

In alternate embodiments, a hollow channel (not shown) may be formed, which connects skin layer 914 to core portion 908 through subcutaneous layer 910. As a result, hook portion 916 is not necessarily pre-fabricated with core portion 908, but the hollow channel nevertheless facilitates rigging hook portion 916 into core portion 908 without the possibility of rupturing subcutaneous layer 910 during the rigging process.

Subcutaneous layer 910 may be pre-filled with both an activator solution and a fluorescer solution that are kept separate through use of vial 912. Vial 912 may be affixed to an inner portion of skin layer 914, or an outer portion of core 908, so as to facilitate rupture by manipulation of vial 912 as in steps 102-106 of FIG. 1. The mixed solutions then cause subcutaneous layer 910 to emit visible light, which in turn causes self-illumination of subcutaneous layer 910. It is noted that skin layer 914 may be composed of a transparent, or translucent, material so as to further enhance emanation of visible light from subcutaneous layer 910. It is further noted that subcutaneous layer 910 may not extend around the entire circumference of core portion 908. In such an instance, a subcutaneous packet is formed that is activated to emanate visible light from only a portion of detachable portion 902. As a result, hook portion 916 may more easily be rigged into core portion 908 without the possibility of rupturing the subcutaneous packet during the rigging process.

Figure 9D:
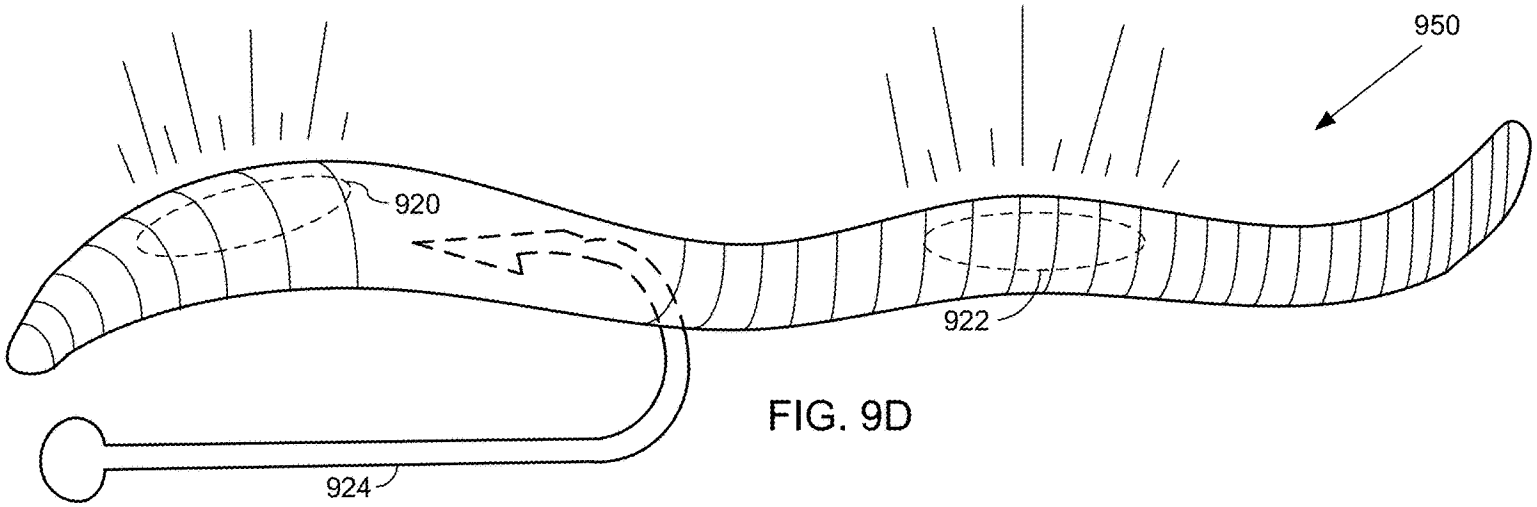
FIGS. 9D-9E illustrate self-illuminating sports/entertainment devices in accordance with alternate embodiments of the present invention.

Turning to FIG. 9D, one or more subcutaneous packets 920 and/or 922 are further illustrated in relation to pliable fishing lure 950, which in one embodiment, is exemplified as a plastic or rubber worm. As illustrated, hook portion 924 may be rigged into pliable fishing lure 950, such that no danger exists that packets 920 and/or 922 are ruptured during the rigging process. Subcutaneous layer packets 920 and/or 922 may be pre-filled with both an activator solution and a fluorescer solution that are kept separate through use of a vial (not shown). The vial may be affixed to an inner portion of subcutaneous packets 920 and/or 922, so as to facilitate rupture by manipulation of the vial, as in steps 102-106 of FIG. 1, through manipulation of the pliable outer surface of pliable fishing lure 950. The mixed solutions then cause subcutaneous packets 920 and 922 to emit visible light, which in turn causes self-illumination of portions of pliable fishing lure 950 as illustrated.

In one embodiment, pliable fishing lure 950 may be manufactured with subcutaneous packets 920 and/or 922 already inserted. In other embodiments, pre-formed slots within pliable fishing lure 950 may be formed, so as to facilitate the insertion of subcutaneous packets 920 and/or 922 into pliable fishing lure 950 subsequent to the manufacture of pliable fishing lure 950. In other embodiments, subcutaneous packets 920 and/or 922 may form an inner core to the pliable fishing lure 950. For example, the subcutaneous packets may be shaped in the form of core 908 of FIG. 9C, where the core itself is pre-filled with both an activator solution and a fluorescer solution that are kept separate through use of a vial (not shown). The vial may be affixed to an inner portion of core 908, so as to facilitate rupture by manipulation of the vial, as in steps 102-106 of FIG. 1, through manipulation of the pliable outer surface of pliable fishing lure 950.

Figure 9E:
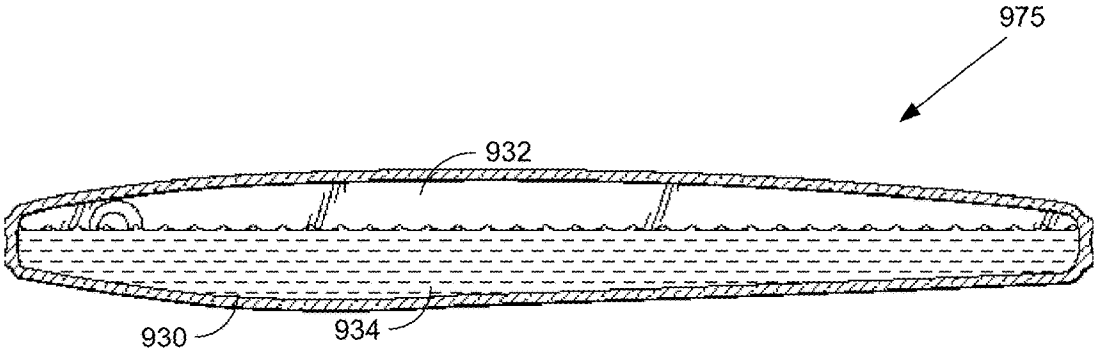

Turning to FIG. 9E, packet 930 may be contoured to inner portion 932 of fishing lure 975, as illustrated in the cross-section view of fishing lure 975. Contoured packet 930 may be pre-filled with both an activator solution, e.g., solution 934, and a fluorescer solution (not shown) that are kept separate through use of a vial (not shown). The vial may be affixed to an inner portion of contoured packet 930, so as to facilitate rupture by manipulation of the vial, as in steps 102-106 of FIG. 1, through manipulation of the pliable outer surface of pliable fishing lure 975. The mixed solutions then cause contoured packet 930 to emit visible light, which in turn causes self-illumination of pliable fishing lure 975.

It is noted that contoured packet 930 may be contoured to fit within the inner portion of virtually any pliable fishing lure made from, e.g., plastic or rubber, so as to better emulate the aesthetics of inner portion 932 of pliable fishing lure 975. It is further noted that pliable fishing lure 975 may be manufactured with contoured packet 930 permanently inserted. Alternately, pre-formed slots within pliable fishing lure 975 may facilitate the insertion of contoured packet 930 into pliable fishing lure 975 subsequent to the manufacture of pliable fishing lure 975. Accordingly, the interchangeability of contoured packet 930 within pliable fishing lure 975 is facilitated.

Figure 10:
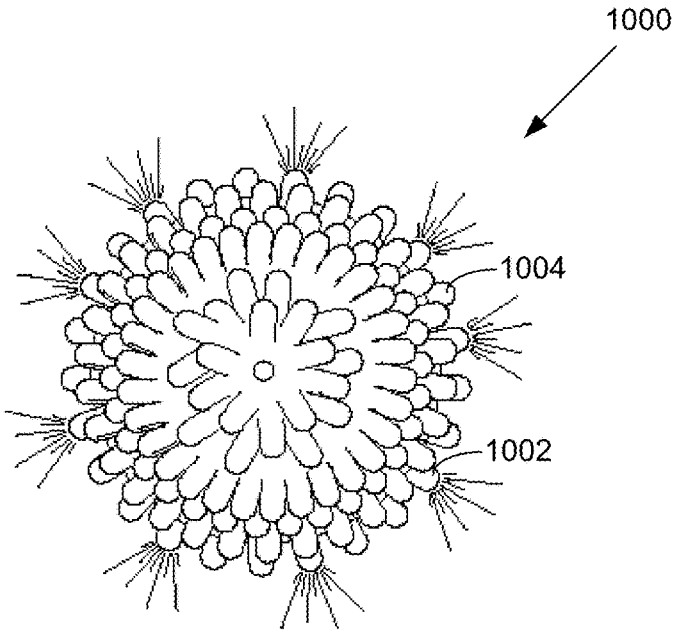
FIG. 10 illustrates a self-illuminating sports/entertainment device in accordance with an alternate embodiment of the present invention.

Turning to FIG. 10, an entertainment/sporting object such as soft-bodied, spiney ball 1000 is exemplified, whereby spiney ball 1000 may be pre-filled with fluorescer and activator solutions that are kept separate by operation of a vial (not shown). Upon manipulation of spiney ball 1000, as in step 106 of FIG. 1, or conversely upon applying an acceleration force to spiney ball 1000, as in step 108 of FIG. 1, the vial is caused to rupture. The activator and fluorescer solutions are then caused to mix, which in turn causes one or more tentacle portions 1002 of spiney ball 1000 to self-illuminate. It should be noted that one or more tentacle portions 1004 of spiney ball 1000 may not be composed of a transparent, or translucent, material, such that emanation of visible light is not possible from tentacle portions 1004. It is further noted that the spiney ball 1000 may instead be entirely composed of a transparent, or translucent, material, such that emanation of visible light from the entire periphery of spiney ball 1000 is provided.

Figures 11A, 11B:
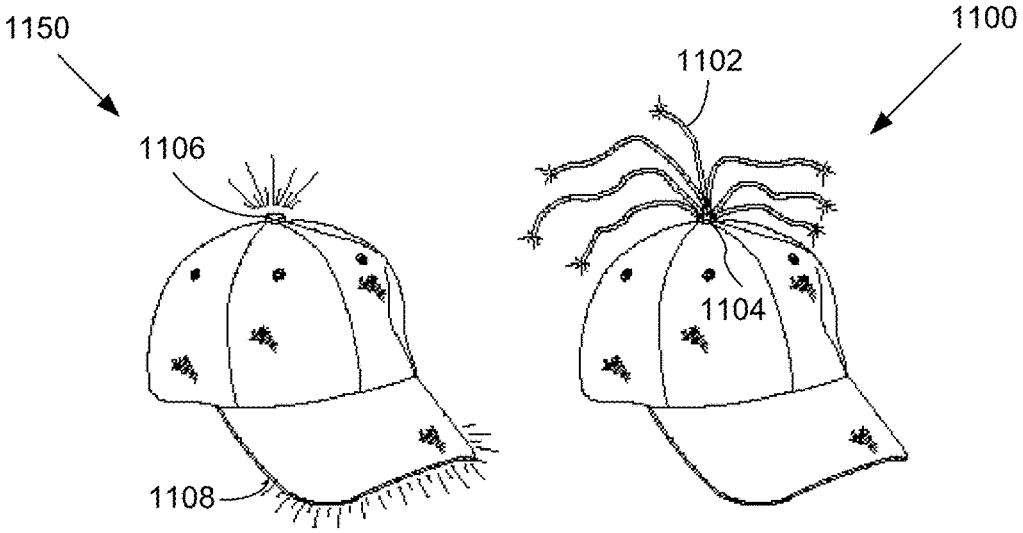
FIGS. 11A-11B illustrate self-illuminating sports/entertainment devices in accordance with alternate embodiments of the present invention.

Turning to FIG. 11A, an entertainment/sporting object such as spiney hat 1100 is exemplified, whereby tentacles 1102 of spiney hat 1100 may be pre-filled with either of a fluorescer, or an activator solution. Button 1104 may similarly be filled with either of an activator, or fluorescer, solution, respectively. Button 1104 and tentacles 1102 may be in adaptive communication, such that channels (not shown) within tentacles 1102 may be caused to receive the solution contained within button 1104 once the vial (not shown) that is contained within button 1104 is ruptured by tactile manipulation of the trigger mechanism (not shown) contained within button 1104. In such an instance, manipulation of the trigger mechanism of button 1104, as in step 106 of FIG. 1, causes the vial to be ruptured, which releases solution contained within the vial to be released into the channels of tentacles 1102. The activator and fluorescer solutions are then caused to mix, which in turn causes all or portions of tentacles 1002 to self-illuminate.

In alternate embodiments, a sports/entertainment/safety device, such as hat 1150, is adapted to cause self-illumination of portion(s) 1106 and/or 1108, as exemplified in FIG. 11B, in accordance with various embodiments of the present invention. For example, a flexible, elongated self-illuminating packet 202, as exemplified in FIG. 2A, is utilized that includes an adhesion component to allow attachment of self-illuminating packet 202 to brim portion 1108 of hat 1150 and/or to the top portion 1106 of hat 1150. Adhesion components, such as a Velcro® mechanism, a zipper mechanism, a channel mechanism, or other adhesives may be applied to the back portion of self-illuminating packet 202 so as to facilitate attachment of self-illuminating packet 202 to the one or more portions of hat 1150. Should a Velcro®, zipper, or channel mechanism be used, a variety of self-illuminating packets 202 may be interchanged as necessary to maintain the desired intensity or desired color. In particular, one or more of a variety of self-illuminating packets may be caused to self-illuminate as in steps 102-106 of FIG. 1 and then applied to portion(s) 1106 and/or 1108, to make the corresponding portions of hat 1150 self-illuminate.

Figure 12A:
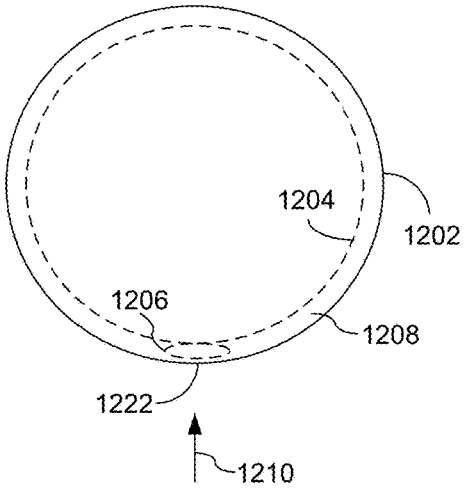
FIG. 12A illustrates a self-illuminating, subcutaneous layer that may be applied to the various embodiments of sports/entertainment/safety devices in accordance with alternate embodiments of the present invention.
Figure 12B:
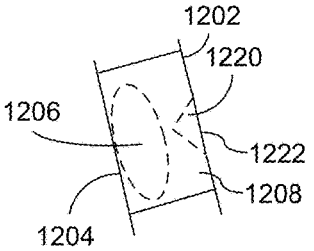
FIG. 12B illustrates a trigger mechanism that may be used to activate the self-illuminating, subcutaneous layer of FIG. 12A in accordance with one embodiment of the present invention.

In alternate embodiments, as exemplified in FIG. 12A, subcutaneous layer 1208 existing between skin layer 1202 and bladder 1204 is utilized to form the self-illuminating component, instead of, e.g., the self-illuminating globes of FIGS. 5B and 7B. Bladder 1204 may be a substantially hollow object that is filled with air to provide sufficient elasticity and/or positive buoyancy as may be required by the entertainment/sporting/safety devices described herein. Alternately, bladder 1204 may be a substantially solid object having positive buoyant characteristics, such as styrofoam or cork. In other embodiments, bladder 1204 may be a substantially solid object having negative buoyant characteristics, such as lead or steel. Still other embodiments allow bladder 1204 to take on neutral buoyancy characteristics, such that the entertainment/sporting/safety devices described herein may maintain a certain depth when utilized below the surface of a body of water.

Generally speaking, the inner core, e.g., bladder 1204, of the various entertainment/sporting/safety devices described herein may provide any variation of negative, positive, or neutral buoyancy characteristics as may be required by any application. The inner core may contain more than one layers, or conversely, more than one inner cores may be utilized to produce the desired effects. The inner core may also take on various degrees of pliability, e.g., stiff or soft, depending upon the particular application. In any event, bladder 1204 may also be utilized to press subcutaneous layer 1208 against the inner portion of skin layer 1202 as illustrated so as to enhance the emanation of visible light from skin layer 1202. In addition, subcutaneous layer 1208 may take on varying depths, or thicknesses, so as to provide the correct self-illumination characteristics as desired.

Subcutaneous layer 1208 may be pre-filled with both an activator solution and a fluorescer solution that are kept separate through use of vial 1206. Vial 1206 may be affixed to an inner portion of skin layer 1202 so as to facilitate rupture by manipulation of vial 1206 as in steps 102-106 of FIG. 1. In particular, a force in direction 1210 may be imposed upon the surface of skin layer 1202 to rupture vial 1206, which then allows the activator and fluorescer solutions to mix within subcutaneous layer 1208. The mixed solutions then cause subcutaneous layer 1208 to emit visible light, which in turn causes self-illumination of the various sports/entertainment/safety objects that may contain a subcutaneous layer, such as exemplified in the various embodiments of the present invention provided herein.

It is noted that skin layer 1202 may be composed of a transparent, or translucent, material so as to allow emanation of visible light from subcutaneous layer 1208. It is further noted that similar subcutaneous layers may be established within other non-spherical sports/entertainment/safety objects, such as exemplified in the various embodiments of the present invention provided herein.

In alternate embodiments, skin layer 1202 may not be sufficiently pliable so as to allow vial 1206 to be ruptured by manipulation of skin layer 1202. In such instances, vial 1206 may be affixed to an inner portion of subcutaneous layer 1208 so as to facilitate rupture of vial 1206 using tactile depression of trigger 1220 as in steps 102-106 of FIG. 1. In particular, surface 1222 of trigger 1220 forms a portion of skin layer 1202 and is sufficiently pliable so as to allow depression of trigger 1220 to engage vial 1206. Applying a sufficient amount of force upon surface 1222 causes trigger 1220 to rupture vial 1206, which then allows the activator and fluorescer solutions to mix. The mixed solutions then cause subcutaneous layer 1208 to emit visible light, which in turn causes the object of FIG. 12A to self-illuminate.

Figure 13A:
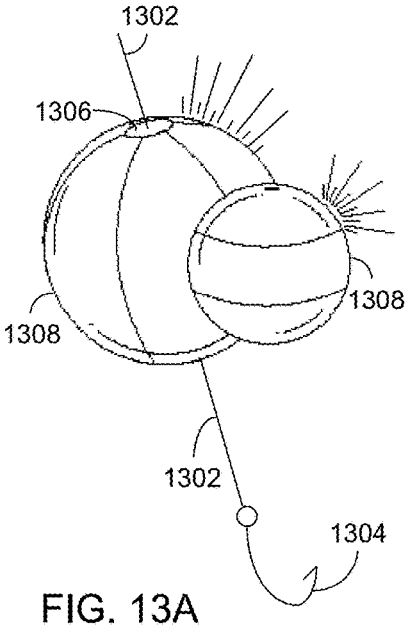
FIGS. 13A-13B illustrate a fishing bead that may be caused to self-illuminate in accordance with various embodiments of the present invention.

Turning to FIG. 13A, an alternate embodiment of a sports/entertainment device is illustrated, whereby a rigid spherical object 1308 may be caused to emanate visible light in accordance with various embodiments of the present invention. In one embodiment, the rigid spherical object may be used as a fishing bead that is utilized to emulate the existence of a fish egg, whereby fishing line 1302, and/or hook 1304, is utilized within hollow channel 1306 of the fishing bead to attach the fishing bead to fishing line 1302 and/or hook 1304. In other embodiments, use of a multiplicity of rigid spherical objects 1308 may instead facilitate the manufacture of a necklace, whereby the plurality of beads are similarly attached to the necklace by stringing the beads together.

Spherical object 1308 may be pre-filled with both an activator solution and a fluorescer solution that are kept separate through use of a vial (not shown). Spherical object 1308 may then be subjected to an acceleration force, such as by shaking fishing bead 1308 or striking fishing bead 1308 against a hard surface, as in step 108 of FIG. 1, to rupture the vial.

Figure 13B:
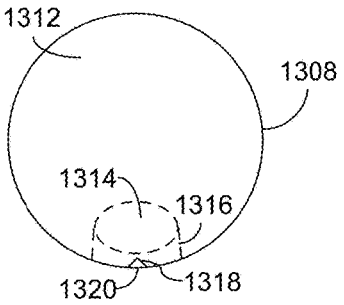

Alternately, a trigger mechanism, such as illustrated in FIG. 13B, may instead be employed. In particular, object 1308 may be pre-filled with both an activator solution and a fluorescer solution that are kept separate through use of vial 1314. Vial 1314 may be affixed to an inner portion of object 1308 via, e.g., supports 1316, so as to facilitate rupture of the vial using tactile depression of trigger 1318 as in steps 102-106 of FIG. 1. In particular, surface 1320 of trigger 1318 forms a portion of the surface of object 1308 and is sufficiently pliable so as to allow depression of trigger 1318 to engage vial 1314. Applying a sufficient amount of force upon surface 1320 causes trigger 1318 to rupture vial 1314, which then allows the activator and fluorescer solutions to mix within cavity portion 1312. The mixed solutions then cause object 1308 to emit visible light. In alternate embodiments, trigger 1318 is an optional component, such that the pliability of a portion of the surface of object 1308 facilitates the rupture of vial 1314 by depression of the portion of the surface of object 1308.

In an alternate embodiment, fishing bead 1308 may exhibit upper and lower portions that are hinged in a manner that is similar to the fishing bobber illustrated, for example, in FIG. 8C. In addition, the upper and/or lower portions of fishing bead 1308 may also include the clasp-activated trigger mechanism(s) as also discussed above in relation to FIG. 8C. In such an instance, fishing bead 1308 may attach to fishing line 1302 and/or hook 1304 by clasping the upper and lower portions of fishing bead 1308 around fishing line 1302 and/or hook 1304. The clasping action further engages the trigger(s) (not shown) to rupture the vial(s) (not shown) to cause mixing of the activator and fluorescer solutions within the upper and/or lower portions of fishing bead 1308 to emit visible light from fishing bead 1308 by chemiluminescence.

Figure 13C:
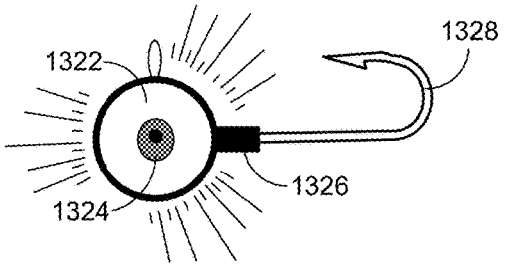
FIG. 13C illustrates a jig head style fishing lure that may be caused to self-illuminate in accordance with various embodiments of the present invention.
Figure 14A:
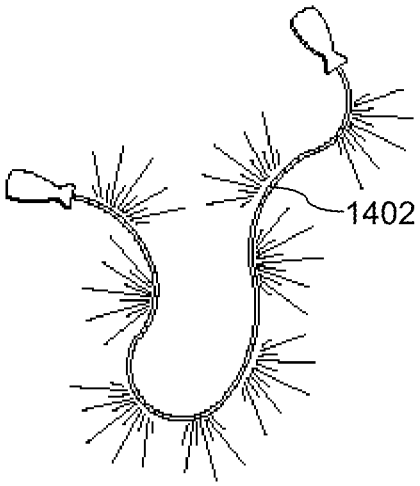
FIGS. 14A, 14B, 15, 16A, 16B, 16C, 16D, 17A and 17B illustrate various self-illuminating sports/entertainment/safety devices in accordance with alternate embodiments of the present invention.
Figure 14B:
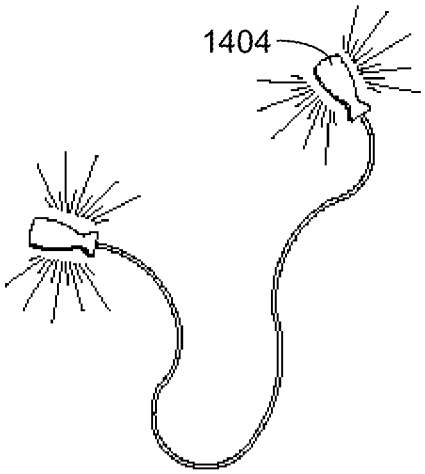

Each of the fishing bead embodiments discussed above in relation to FIGS. 13A-13B may also be employed within the jig head style fishing lure of FIG. 13C, whereby eye portion 1324 and/or bead portion 1322 may be caused to emanate visible light by chemiluminescence as discussed herein. Weight portion 1326 may also be implemented to provide the jig head style fishing lure of FIG. 13C with appropriate buoyancy characteristics, such that use of hook portion 1328 in combination with synthetic worms (e.g., for use in fresh water) or synthetic squids (e.g., for use in salt water) may cause the fishing lure to sink to an appropriate depth of water during fishing operations.

Turning to FIGS. 14-17, various other embodiments of self-illuminating sports/entertainment/safety devices are exemplified. In FIGS. 14A and 14B, for example, a jump rope device is exemplified, whereby rope portion 1402, and/or handle portion 1404, is caused to emanate visible light in accordance with various embodiments of the present invention. In particular, rope portion 1402 and/or handle portions 1404 may be pre-filled with fluorescer and activator solutions that are kept separate by operation of a vial (not shown). Upon manipulation of rope portion 1402, as in step 106 of FIG. 1, and/or upon activation of a trigger mechanism (not shown, but similar to the trigger mechanisms discussed herein) within handle portion 1404, the vial(s) may be caused to rupture. The activator and fluorescer solutions are then caused to mix, which in turn causes rope portion 1402 and/or handle portions 1404 to self-illuminate.

Figure 15:
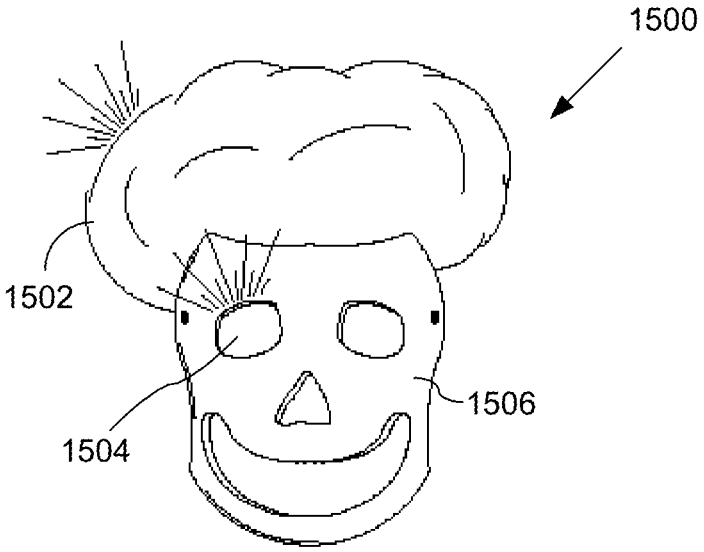

Turning to FIG. 15, various portions 1502 and 1504 of mask 1500 are caused to emanate visible light in accordance with various embodiments of the present invention. In particular, hair portion 1502 and/or eye portions 1504 may be pre-filled with fluorescer and activator solutions that are kept separate by operation of a vial (not shown). Upon manipulation of hair portion 1502, as in step 106 of FIG. 1, or upon activation of a trigger mechanism (not shown) within eye portions 1504, the vial(s) may be caused to rupture. The activator and fluorescer solutions are then caused to mix, which in turn causes hair portion 1502 and/or eye portions 1504 to self-illuminate.

Facial features 1506 may further be caused to emanate visible light from mask 1500 by incorporation of a subcutaneous layer (not shown). The subcutaneous layer may be pre-filled with both an activator solution and a fluorescer solution that are kept separate through use of a vial (not shown). The vial may be affixed to an inner portion of the subcutaneous layer so as to facilitate rupture by manipulation of the vial as in steps 102-106 of FIG. 1.

In alternate embodiments, the subcutaneous layer of mask 1500 may be pre-filled with either of a fluorescer, or an activator, solution that is caused to self-illuminate by the injection of either of an activator, or a fluorescer, solution, respectively, as in steps 124-128 of FIG. 1. The injection may be facilitated, for example, by applying pressure in direction 214 on flexible vial 212, as illustrated in FIG. 2D, so as to cause the solution contained within vial 212 to be injected into the subcutaneous layer of mask 1500 via injection ports (not shown) of mask 1500.

Figure 16A:
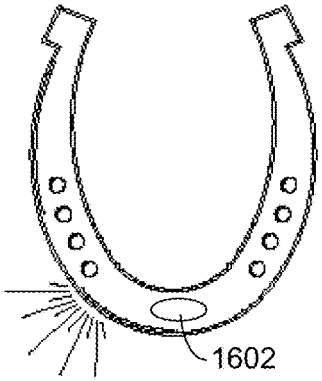
Figure 16D:
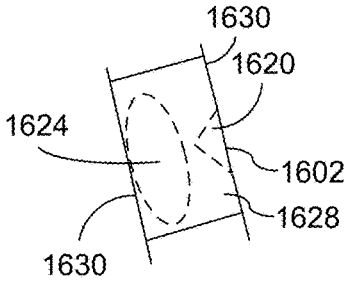
Figure 16B:
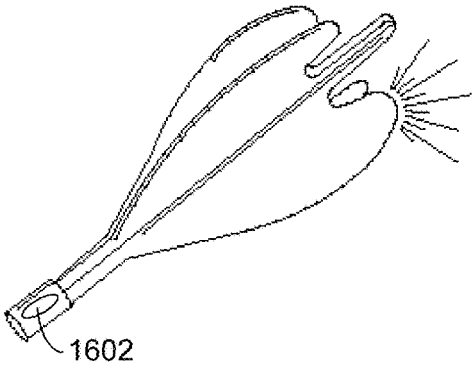
Figure 16C:
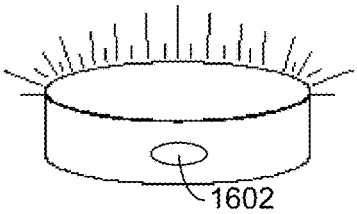

Turning to FIGS. 16A-16C, alternate embodiments of self-illuminating sports/entertainment equipment are exemplified, whereby horseshoes, lawn darts, and hockey pucks, for example, are caused to emanate visible light in accordance with various embodiments of the present invention. Each of the objects of FIGS. 16A-16C incorporate an internal channel 1628 that may be pre-filled with both an activator solution and a fluorescer solution that are kept separate through use of vial 1624 as illustrated in FIG. 16D, which is representative of a cross-section of each of the objects of FIGS. 16A-16C. Vial 1624 may be affixed to an inner portion of wall 1630 so as to facilitate rupture of the vial using tactile depression of trigger 1620 as in steps 102-106 of FIG. 1. In particular, surface 1602 of trigger 1620 forms a portion of the outer surface of the objects of FIGS. 16A-16C and is sufficiently pliable so as to allow depression of trigger 1620 to engage vial 1624. Applying a sufficient amount of force upon surface 1602 causes trigger 1620 to rupture vial 1624, which then allows the activator and fluorescer solutions to mix within internal channel 1628. The mixed solutions then cause internal channel 1628 to emit visible light, which in turn causes the respective objects to self-illuminate.

In alternate embodiments, the walls of vial 1624 may be composed of a material that is designed to rupture in response to exposure to a pre-determined amount of acceleration force imposed upon vial 1624. For example, the horseshoe of FIG. 16A or the lawn dart of FIG. 16B may be thrown and subsequently land with such an amount of force that subjects vial 1624 to a deceleration force that is sufficient to rupture vial 1624, as in step 108 of FIG. 1. The solutions within internal channel 1628 are then caused to mix, which causes internal channel 1628 to self-illuminate, which in turn causes the emanation of visible light from the objects of FIGS. 16A-16C.

Figure 17A:
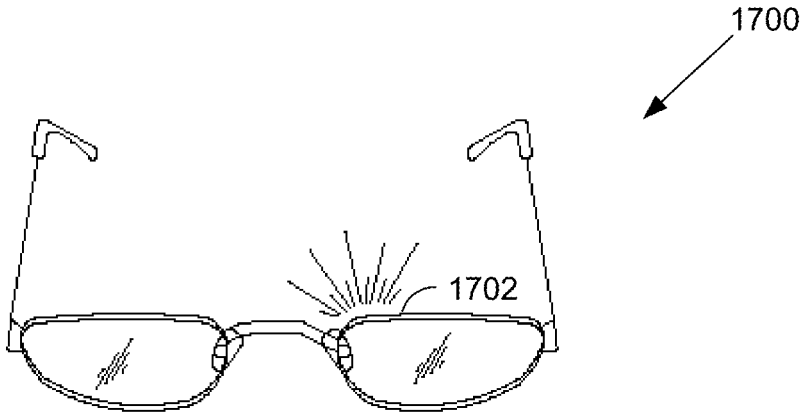
Figure 17B:
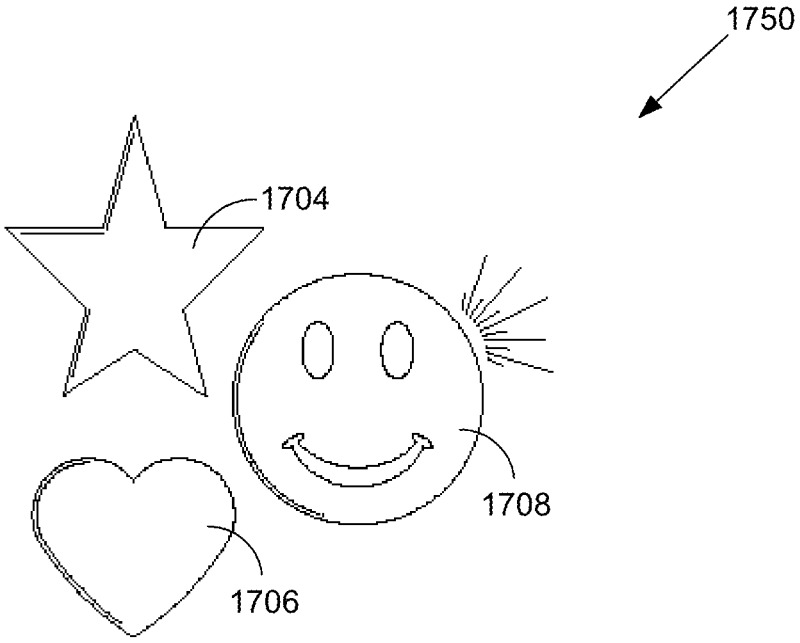

Turning to FIGS. 17A-17B, alternate embodiments of self-illuminating safety equipment are exemplified, whereby safety glasses 1700 and safety stickers 1750, for example, are caused to emanate visible light in accordance with various embodiments of the present invention. In a first embodiment, for example, a flexible, elongated self-illuminating packet 202, as exemplified in FIG. 2A, is utilized that includes an adhesion component to allow attachment of self-illuminating packet 202 to frame portion 1702 of safety glasses 1700. Adhesion components, such as a Velcro® mechanism, a zipper mechanism, a channel mechanism, or other adhesives may be applied to the back portion of self-illuminating packet 202 so as to facilitate attachment of self-illuminating packet 202 to safety glasses 1700. Should a Velcro®, zipper, or channel mechanism be used, a variety of self-illuminating packets 202 may be interchanged as necessary to maintain the desired intensity or desired color. In particular, one or more of a variety of self-illuminating packets may be caused to self-illuminate as in steps 102-106 of FIG. 1 and then applied to frame portion(s) 1702 of safety glasses 1700 to make safety glasses 1700 self-illuminate.

FIG. 17B exemplifies alternate embodiments of self-illuminating packet 202, whereby instead of the elongated structure of self-illuminating packet 202, safety stickers shaped in the form of, e.g., star 1704, heart 1706, smiling face 1708, etc., are provided. An adhesion component is provided to allow attachment of safety stickers 1750 to various body parts and/or articles of clothing worn by persons who wish to be visible at night or in otherwise dark surroundings. Adhesion components, such as a Velcro® mechanism, a zipper mechanism, or a channel mechanism may be applied to the back portion of safety stickers 1750 so as to facilitate attachment of safety stickers 1750 to their respective recipients, e.g., children. A variety of safety stickers 1750 may be caused to emanate visible light, as in steps 102-106 of FIG. 1, and interchanged as necessary to maintain the desired intensity and/or desired color of, e.g., children, so as to allow the children to be sufficiently visible during nighttime activities, or other activities taking place in otherwise darkened conditions.

Figure 18A:
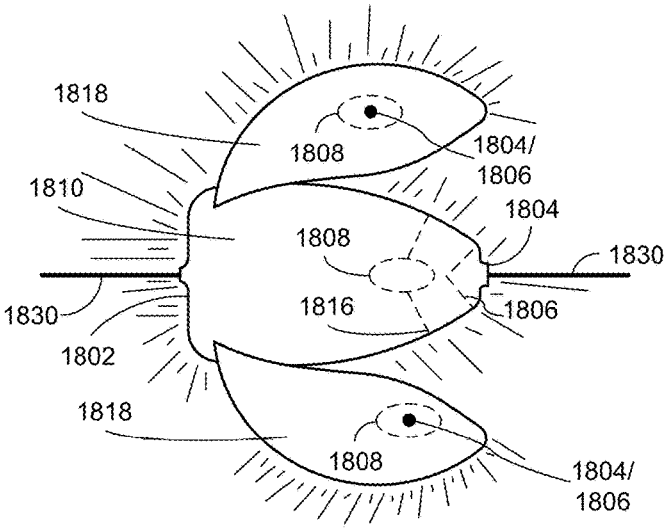
FIGS. 18A-18C illustrate self-illuminating sports/entertainment devices in accordance with alternate embodiments of the present invention.
Figure 18B:
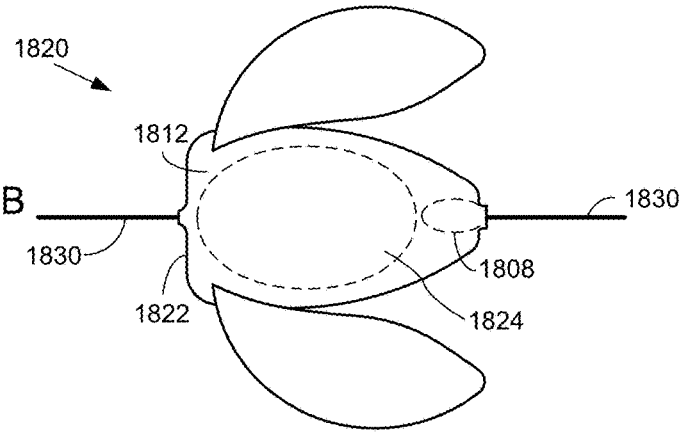
Figure 18C:
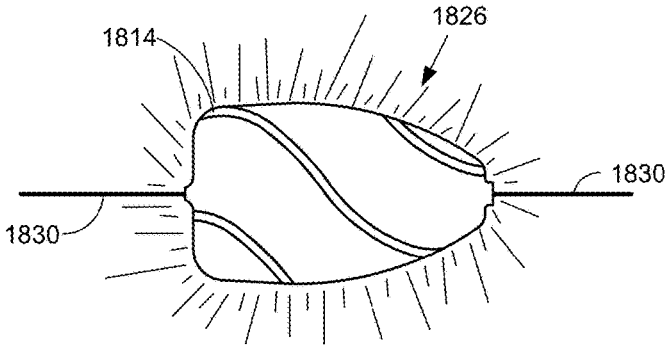

Turning to FIGS. 18A-18C, alternate embodiments of a self-illuminating sports/entertainment device in accordance with the present invention are illustrated. The devices of FIGS. 18A-18C are not spherically shaped, but are rather shaped in the form of prey and are designed to spin along the axis formed by fishing line 1830 when immersed in a current of water, such as may be produced when the device is immersed into a running stream of water, or when the device is pulled through still water from a moving boat. In such an instance, fishing line 1830 passes through a hollow channel (not shown) of the device.

Self-illuminating device 1802 and wings 1818 of FIG. 18A may be pre-filled with both an activator solution and a fluorescer solution that are kept separate through use of vial(s) 1808. Vial(s) 1808 may be affixed to inner portions of device 1802/wings 1818 via, e.g., supports 1816, so as to facilitate rupture of vial(s) 1808 using tactile depression of trigger 1806 as in steps 102-106 of FIG. 1. In particular, surface 1804 of trigger 1806 forms a portion of the surface of device 1802 and wings 1818 and exhibits greater pliability as compared to the remaining surface area of device 1802 and wings 1818, so as to allow depression of trigger 1806 to engage vial(s) 1808. Applying a sufficient amount of force upon surface 1804 causes trigger 1806 to rupture vial 1808, which then allows the activator and fluorescer solutions to mix within cavity portions 1810 of device 1802 and wings 1818. The mixed solutions then cause device 1802 and wings 1818 to emit visible light as illustrated in FIG. 18A. In alternate embodiments, trigger 1806 is an optional component for device 1802 and wings 1818, such that the pliability of a portion, or the entire, surface of device 1802 and wings 1818 facilitates the rupture of vial 1808 by depression of the portion of the surface of device 1802 and wings 1818.

It is noted that wings 1818 and device 1802 may employ mechanisms (not shown) to allow detachment of wings 1818 from device 1802. As such, a variety of wings that exhibit the self-illumination of varied colors of light may be interchanged to determine the most successful combination of colors so as to maximize the attraction to predator fish.

Turning to FIG. 18B, an alternate embodiment of self-illuminating device 1820 is illustrated, whereby subcutaneous layer 1812 exists between skin layer 1822 and bladder 1824. Bladder 1824 may be a substantially hollow object that is filled with air to provide sufficient elasticity and/or buoyancy. Alternatively, bladder 1824 may be a substantially solid object having buoyant characteristics, such as cork, or a relatively non-buoyant solid to allow device 1820 to operate at depth. In any event, bladder 1824 is utilized to press subcutaneous layer 1812 against the inner portion of skin layer 1822 as illustrated so as to enhance the emanation of visible light from skin layer 1822.

Subcutaneous layer 1812 may be pre-filled with both an activator solution and a fluorescer solution that are kept separate through use of vial 1808. Vial 1808 may be affixed to an inner portion of skin layer 1822 so as to facilitate rupture by manipulation of vial 1808 as in steps 102-106 of FIG. 1. In particular, a force may be imposed upon the surface of skin layer 1822 to rupture vial 1808, which then allows the activator and fluorescer solutions to mix within subcutaneous layer 1812. The mixed solutions then cause subcutaneous layer 1812 to emit visible light, which in turn causes self-illumination. It is noted that skin layer 1822 may be composed of a transparent, or translucent, material so as to allow emanation of visible light from subcutaneous layer 1812. In alternate embodiments of FIG. 18B, a trigger mechanism similar to trigger mechanism 1806 of FIG. 18A may optionally be used to rupture vial 1808 should skin layer 1822 be implemented as a rigid component, i.e., not sufficiently pliable to allow rupture of vial 1808 without trigger mechanism 1806.

Turning to FIG. 18C, an alternate embodiment of self-illuminating device 1826 is illustrated, whereby grooves 1814 etched into device 1826 obviate the need for wings 1818. That is to say, in other words, that grooves 1814 are designed to cause device 1826 to spin along the axis formed by fishing line 1830 when device 1826 is immersed into a current of water, such as may be produced when device 1826 is immersed into a running stream of water, or when device 1826 is pulled through still water from a moving boat. Wings 1818 may, however, be added to device 1826 to enhance the illusion that device 1826 is prey, or to enhance the spin qualities of device 1826. In addition, device 1826 may either employ the trigger mechanism of FIG. 18A, the subcutaneous layer arrangement of FIG. 18B, or both, in order to cause self-illumination of device 1826.

Figure 19A:
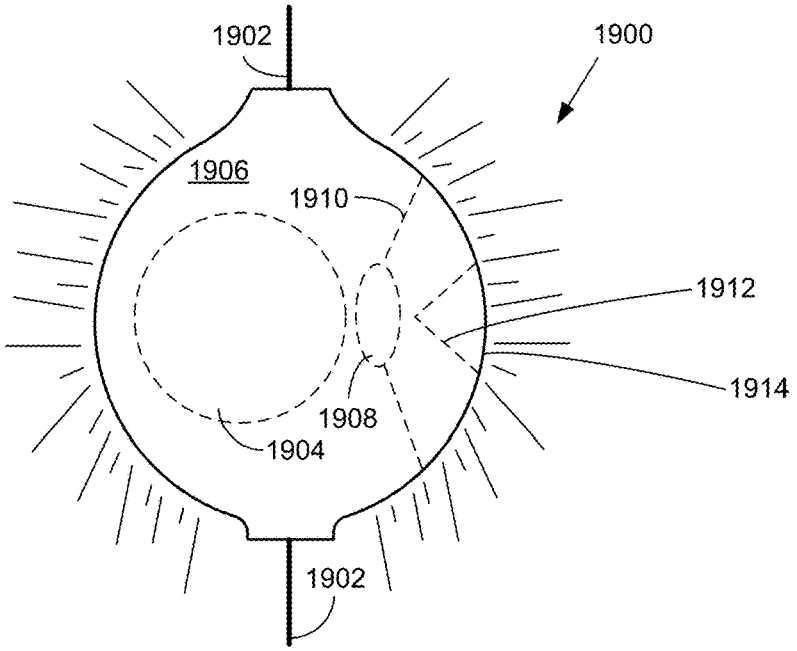
FIGS. 19A-19B illustrate self-illuminating sports/entertainment devices in accordance with alternate embodiments of the present invention.
Figure 19B:
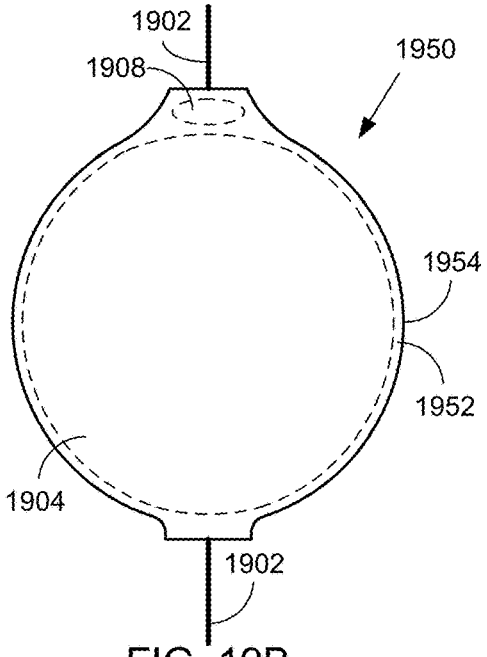

Turning to FIGS. 19A-19B, alternate embodiments of a self-illuminating sports/entertainment device in accordance with the present invention are illustrated. The devices of FIGS. 19A-19B are spherically shaped and are designed to maintain buoyancy of a fishing lure (not shown) that is attached to fishing line 1902, whereby fishing line 1902 passes through a hollow channel (not shown) of device 1900. Bladder 1904, for example, may either be filled with air or a buoyant solid such as cork, in order to provide adequate buoyancy to maintain device 1900 afloat.

Self-illuminating device 1900 may be pre-filled with both an activator solution and a fluorescer solution that are kept separate through use of vial 1908. Vial 1908 may be affixed to inner portions of device 1900 via, e.g., supports 1910, so as to facilitate rupture of vial 1908 using tactile depression of trigger 1912 as in steps 102-106 of FIG. 1. In particular, surface 1914 of trigger 1912 forms a portion of the surface of device 1900 and exhibits greater pliability as compared to the remaining surface area of device 1900 so as to allow depression of trigger 1912 to engage vial 1908. Applying a sufficient amount of force upon surface 1914 causes trigger 1912 to rupture vial 1908, which then allows the activator and fluorescer solutions to mix within cavity portion 1906. The mixed solutions then cause device 1900 to emit visible light as illustrated in FIG. 19A.

Turning to FIG. 19B, an alternate embodiment of self-illuminating device 1950 is illustrated, whereby subcutaneous layer 1952 exists between skin layer 1954 and bladder 1904. As discussed above in relation to FIG. 19A, bladder 1904 may be a substantially hollow object that is filled with air to provide sufficient elasticity and/or buoyancy. Alternatively, bladder 1904 may be a substantially solid object having buoyant characteristics, such as cork. In any event, bladder 1904 is utilized to press subcutaneous layer 1952 against the inner portion of skin layer 1954 as illustrated so as to enhance the emanation of visible light from skin layer 1954.

Subcutaneous layer 1952 may be pre-filled with both an activator solution and a fluorescer solution that are kept separate through use of vial 1908. Vial 1908 may be affixed to an inner portion of skin layer 1954 so as to facilitate rupture by manipulation of vial 1908 as in steps 102-106 of FIG. 1. In particular, a force may be imposed upon the surface of skin layer 1954 to rupture vial 1908, which then allows the activator and fluorescer solutions to mix within subcutaneous layer 1952. The mixed solutions then cause subcutaneous layer 1952 to emit visible light, which in turn causes self-illumination. It is noted that skin layer 1952 may be composed of a transparent, or translucent, material so as to allow emanation of visible light from subcutaneous layer 1952. In alternate embodiments of FIG. 19B, an optional trigger mechanism similar to trigger mechanism 1912 of FIG. 19A may be used to rupture vial 1908 should skin layer 1954 be implemented as a rigid component, i.e., not sufficiently pliable to allow rupture of vial 1908 without trigger mechanism 1912.

Figure 20A:
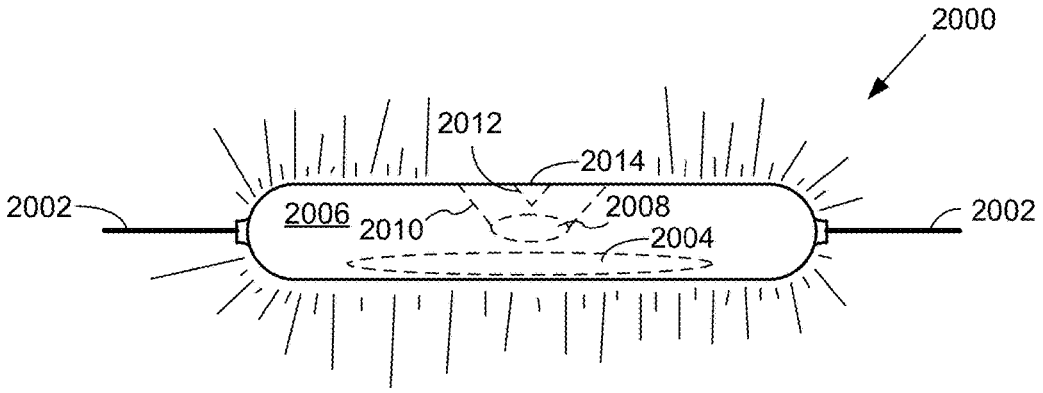
FIGS. 20A-20B illustrate self-illuminating sports/entertainment devices in accordance with alternate embodiments of the present invention.
Figure 20B:
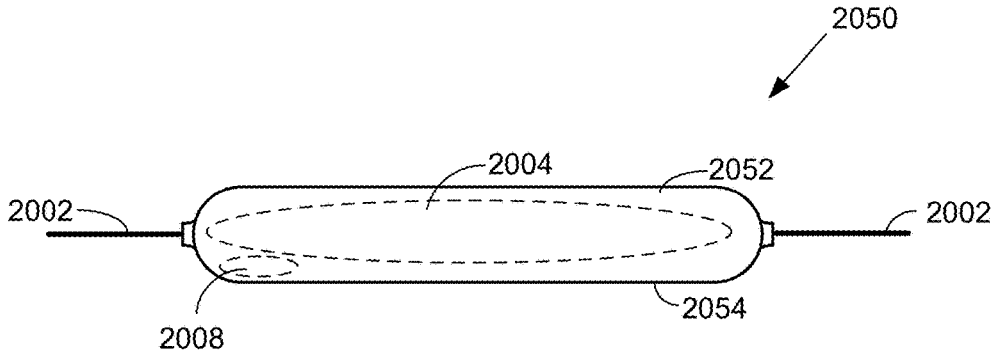

Turning to FIGS. 20A-20B, alternate embodiments of a self-illuminating sports/entertainment device in accordance with the present invention are illustrated. The devices of FIGS. 20A-20B are cylindrically shaped and are designed to maintain buoyancy of a fishing lure (not shown) that is attached to fishing line 2002, whereby fishing line 2002 passes through a hollow channel (not shown) of device 2000. Cylinder 2004, for example, may either be filled with air or a buoyant solid such as cork, in order to provide adequate buoyancy to maintain device 2000 afloat.

Self-illuminating device 2000 may be pre-filled with both an activator solution and a fluorescer solution that are kept separate through use of vial 2008. Vial 2008 may be affixed to inner portions of device 2000 via, e.g., supports 2010, so as to facilitate rupture of vial 2008 using tactile depression of trigger 2012 as in steps 102-106 of FIG. 1. In particular, surface 2014 of trigger 2012 forms a portion of the surface of device 2000 and exhibits greater pliability as compared to the remaining surface area of device 2000 so as to allow depression of trigger 2012 to engage vial 2008. Applying a sufficient amount of force upon surface 2014 causes trigger 2012 to rupture vial 2008, which then allows the activator and fluorescer solutions to mix within cavity portion 2006. The mixed solutions then cause device 2000 to emit visible light as illustrated in FIG. 20A.

Turning to FIG. 20B, an alternate embodiment of self-illuminating device 2050 is illustrated, whereby subcutaneous layer 2052 exists between skin layer 2054 and bladder 2004. As discussed above in relation to FIG. 20A, bladder 2004 may be a substantially hollow object that is filled with air to provide sufficient elasticity and/or buoyancy. Alternatively, bladder 2004 may be a substantially solid object having buoyant characteristics, such as cork. In any event, bladder 2004 is utilized to press subcutaneous layer 2052 against the inner portion of skin layer 2054 as illustrated so as to enhance the emanation of visible light from skin layer 2054.

Subcutaneous layer 2052 may be pre-filled with both an activator solution and a fluorescer solution that are kept separate through use of vial 2008. Vial 2008 may be affixed to an inner portion of skin layer 2054 so as to facilitate rupture by manipulation of vial 2008 as in steps 102-106 of FIG. 1. In particular, a force may be imposed upon the surface of skin layer 2054 to rupture vial 2008, which then allows the activator and fluorescer solutions to mix within subcutaneous layer 2052. The mixed solutions then cause subcutaneous layer 2052 to emit visible light, which in turn causes self-illumination. It is noted that skin layer 2054 may be composed of a transparent, or translucent, material so as to allow emanation of visible light from subcutaneous layer 2052. In alternate embodiments of FIG. 20B, an optional trigger mechanism similar to trigger mechanism 2012 of FIG. 20A may be used to rupture vial 2008 should skin layer 2054 be implemented as a rigid component, i.e., not sufficiently pliable to allow rupture of vial 2008 without trigger mechanism 2012.

Turning to FIGS. 21A-21D, alternate embodiments of a self-illuminating sports/entertainment device in accordance with the present invention are illustrated. In particular, detachable chemiluminescent inserts are provided that allow interchangeability of chemiluminescent effects. Device 2100 illustrates, for example, fishing lure 2104 having a body portion that exhibits void 2102. A plurality of chemiluminescent inserts 2120 may be interchangeably locked into void 2102 to provide fishing lure 2104 with a variety of chemiluminescent effects.

In one embodiment, fishing lure 2104 is shaped as a spoon lure, but other body shapes may also be employed. For example, fishing lure 2104 may instead be shaped as various types of fishing apparatus, such as a spinner blade, a diver, or flasher 2192 as illustrated, for example, in FIG. 21E. In such instances, inserts 2120 exhibiting various shapes and sizes may be removable, or non-removable, as required to provide the fishing apparatus with a variety of chemiluminescent effects. In alternate embodiments, the inserts themselves may be shaped as body parts of the fishing apparatus, so that specific body parts of the fishing apparatus may be interchanged to exhibit a variety of chemiluminescent effects as desired. Various interchangeable and self-illuminating body parts are illustrated, for example, in FIG. 21F as interchangeable, self-illuminating body parts 2120. As discussed in more detail below with respect to FIGS. 31-32, the chemiluminescence of interchangeable, self-illuminating body parts 2120 of FIG. 21F may be automatically triggered in response to the engagement of body parts 2120 to portions of the fishing apparatus, or conversely, may be triggered in accordance with various other embodiments as provided herein, e.g., trigger activated, acceleration activated, actuator means, etc.

The outer periphery of insert 2120 may include a temporary attachment mechanism, such as an extrusion (not shown) that matches a corresponding channel (not shown) of fishing lure 2104 that lies just inside void 2102. By aligning the extrusion of insert 2120 with void 2102 and pressing insert 2120 into void 2102, the extrusion and corresponding channel engage each other to create a mechanical friction that maintains insert 2120 within void 2102. In order to replace insert 2120 with an alternate, insert 2120 may be removed from void 2102 by applying an opposite force from that which was used to engage insert 2120 within void 2102. As such, fishing lure 2100 may take on any number of chemiluminescent effects simply by replacing chemiluminescent insert 2120 with other chemiluminescent inserts 2120 that exhibit a different color or intensity. In alternate embodiments, insert 2120 may be permanently affixed within void 2102.

Chemiluminescent insert 2120 may be pre-filled with both an activator solution and a fluorescer solution that are kept separate through use of vial 2108. Chemiluminescent insert 2120 is made from a transparent or translucent material, e.g., an extruded plastic, such that the solution contained within chemiluminescent insert 2120 is visible. Vial 2108 may be affixed to inner portions of insert 2120 via, e.g., supports 2110, so as to facilitate rupture of vial 2108 using tactile depression of trigger 2112 as in steps 102-106 of FIG. 1. In alternate embodiments, vial 2108 may be manufactured such that a length of vial 2108 extends substantially throughout the full length of the inner portion of insert 2120. Accordingly, the need for supports 2110 is obviated, since the inner portion of insert 2120 precludes shifting of vial 2108 during tactile depression of trigger 2112.

In one embodiment, trigger 2112 may be formed as part of the inner portion of insert 2120 through the use of, e.g., a plastic extrusion mold, whereby the trigger is formed as an integral part of insert 2120. In addition, trigger 2112 is not necessarily formed as a pointed extrusion, but rather may be formed as a blunted extrusion instead. In addition, trigger 2112 may be formed as a hollow extrusion having a cavity, whereby the cavity (not shown) inside trigger 2112 may be utilized to capture the gaseous emissions produced during the chemiluminescent reaction. Accordingly, a greater amount of solution may be used to fill insert 2120, since trigger 2112 provides an exhaust means for the gaseous emissions, which obviates the requirement that insert 2120 contain other exhaust means, such as an air bubble that is used as a volume to absorb the gaseous emissions.

Surface 2114 of trigger 2112 forms a portion of the surface of insert 2120 and exhibits greater pliability as compared to the remaining surface area of insert 2120 so as to allow depression of trigger 2112 to engage vial 2108. It is noted that the majority of the surface of insert 2120 is to remain substantially rigid, so as to facilitate use during fishing operations. As a result, only that portion of surface 2114 that is immediately adjacent to trigger 2112 is to remain sufficiently pliable, whereas the remaining surface area of insert 2120 remains rigid, i.e., substantially non-pliable. Applying a sufficient amount of force upon surface 2114 causes trigger 2112 to rupture vial 2108, which then allows the activator and fluorescer solutions to mix within cavity portion 2106. The mixed solutions then cause fishing lure 2104 to emit visible light as illustrated in FIG. 21B.

In alternate embodiments, the surface of chemiluminescent insert 2120 may be sufficiently pliable so as to obviate the need for trigger 2112. In such an instance, the surface of chemiluminescent insert 2120 may be manipulated in order to rupture vial 2108 to cause fishing lure 2104 to emit visible light as illustrated in FIG. 21B.

Figures 21A, 21B, 21C, 21D:
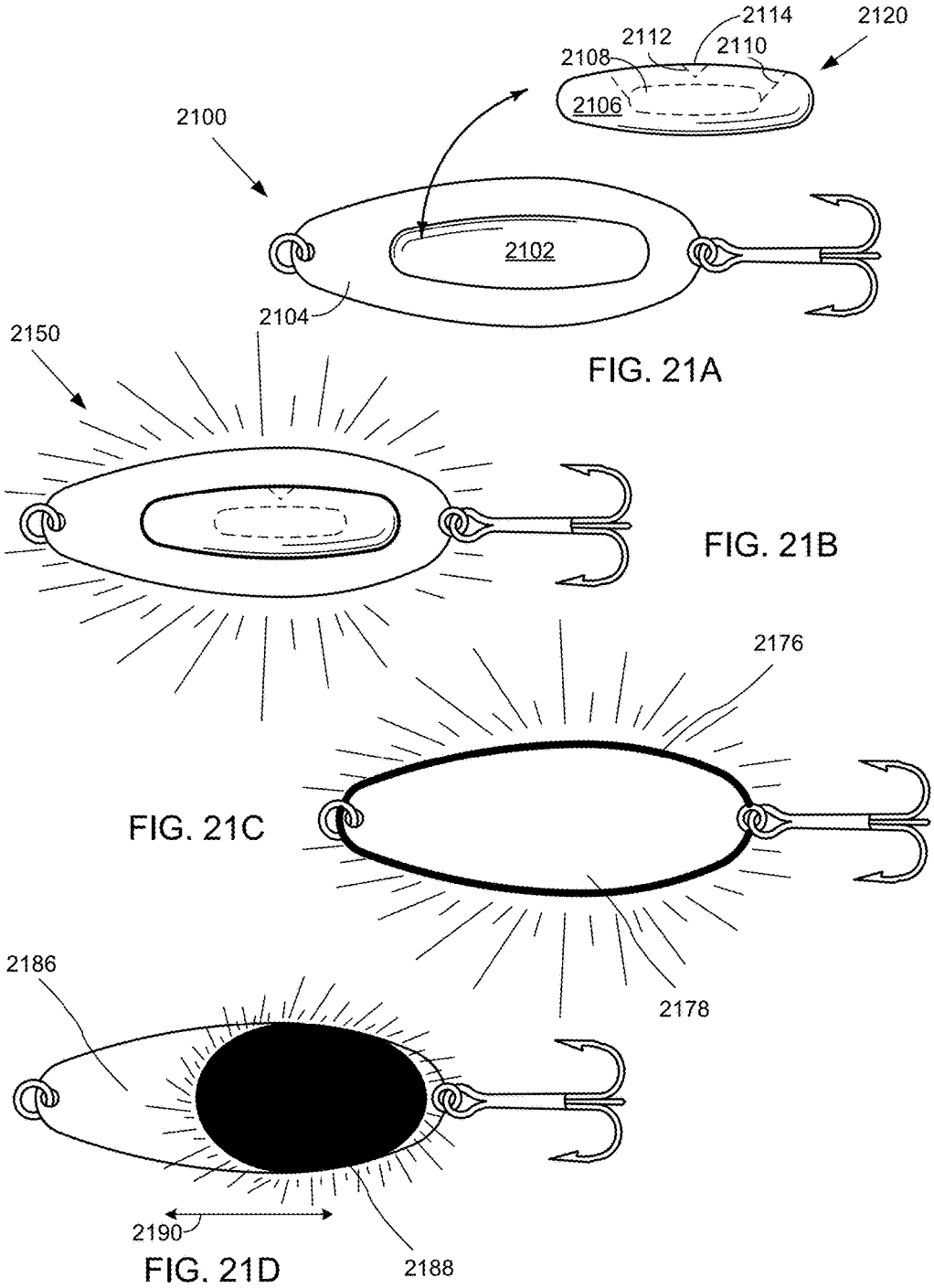
FIGS. 21A-21F illustrate self-illuminating sports/entertainment devices in accordance with alternate embodiments of the present invention.
Figure 21E:
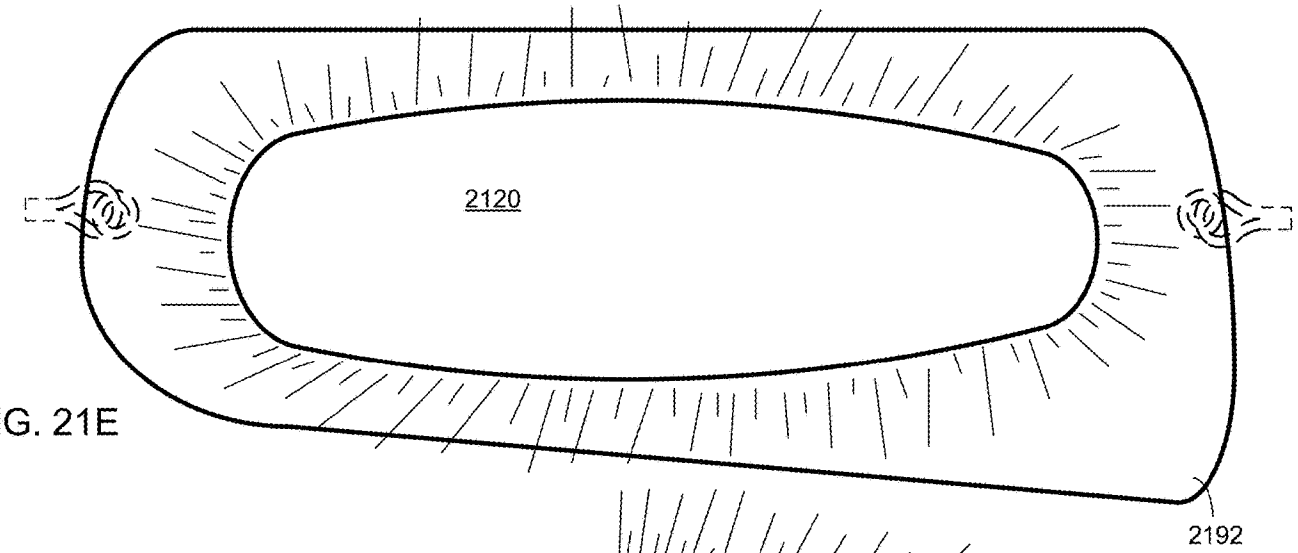
Figure 21F:
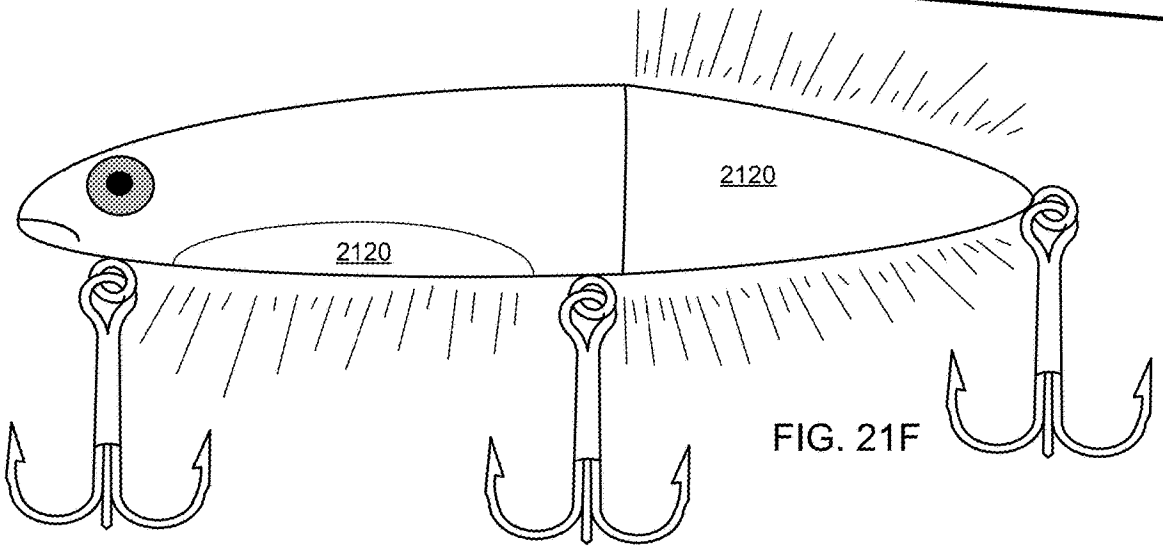

Turning to FIG. 21C, self-illuminating packet 202 of FIG. 2F is instead utilized to provide chemiluminescence of fishing lure 2178. In particular, channel 250 that is formed along the back side of self-illuminating packet 202 engages the outer periphery of fishing lure 2178 to create a mechanical friction that maintains an attachment between self-illuminating packet 2176 and fishing lure 2178. In order to replace self-illuminating packet 2176 with an alternate, self-illuminating packet 2176 may be removed from fishing lure 2178 by applying an opposite force from that which was used to engage self-illuminating packet 2176 with fishing lure 2178. As such, fishing lure 2178 may take on any number of chemiluminescent effects simply by replacing self-illuminating packet 2176 with other self-illuminating packets 2176 that exhibit a different color or intensity.

Turning to FIG. 21D, self-illuminating slip-on 2188 is instead utilized to provide chemiluminescence of fishing lure 2186. In particular, self-illuminating slip-on 2188 engages the outer periphery of fishing lure 2186 by sliding over the outer circumference of fishing lure 2186 to create a mechanical friction that maintains the attachment between self-illuminating slip-on 2188 and fishing lure 2186. In alternate embodiments, the zipper mechanism of FIG. 2B may instead be used to attach a self-illuminating packet, such as the packet of FIG. 2A, to the outer periphery of fishing lure 2186.

In order to replace self-illuminating slip-on 2188 with an alternate, self-illuminating slip-on 2188 may be removed from fishing lure 2186 by sliding self-illuminating slip-on 2188 in either direction 2190. As such, fishing lure 2186 may take on any number of chemiluminescent effects simply by replacing self-illuminating slip-on 2188 with other self-illuminating slip-ons 2188 that exhibit a different color or intensity. It is noted that self-illuminating slip-on 2188 may be activated to emit visible light in accordance with the various embodiments presented herein. It is further noted that more than one slip-on 2188 may be utilized to further enhance the self-illumination of fishing lure 2186. Still further, slip-on 2188 may represent a multi-colored or multi-faceted wrap that may be applied to fishing lure 2186, so as to alter, modify, or otherwise enhance the illumination effects produced by fishing lure 2186.

Figure 22A:
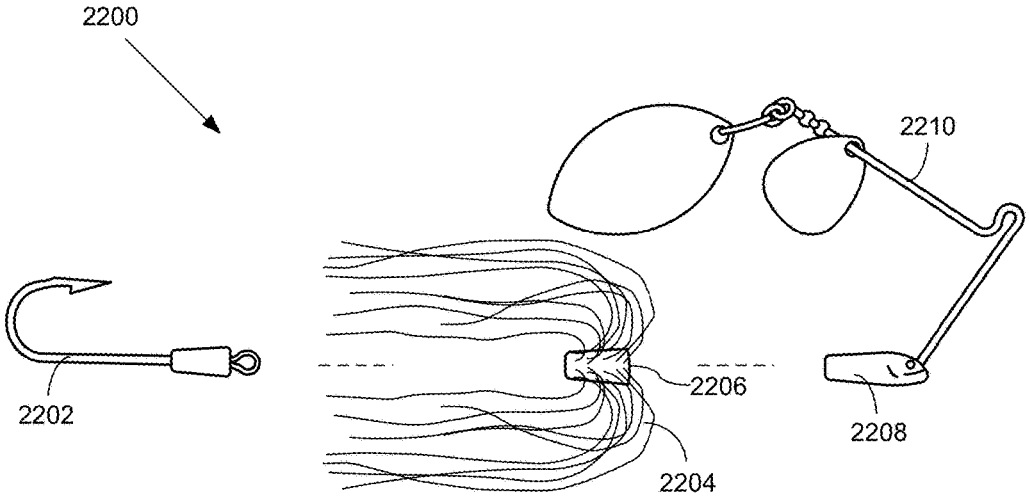
FIGS. 22A-22B illustrate self-illuminating sports/entertainment devices in accordance with alternate embodiments of the present invention.
Figure 22B:
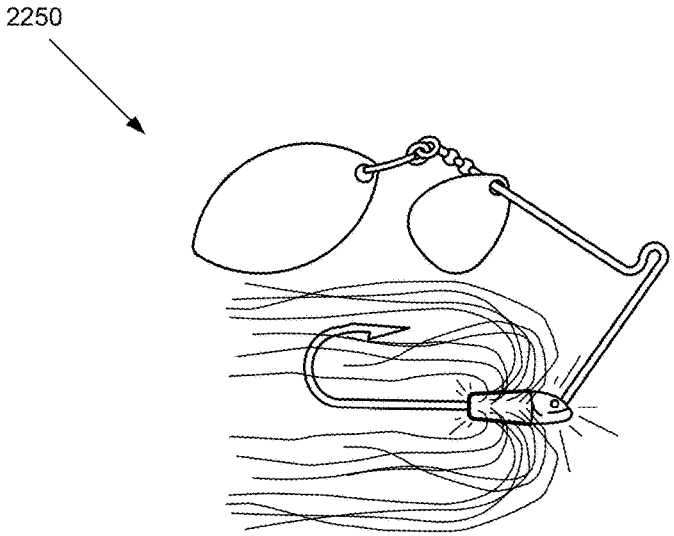

Turning to FIGS. 22A-22B, alternate embodiments of self-illuminating inserts of a fishing lure system in accordance with the present invention are illustrated. In particular, FIG. 22A illustrates a fishing lure system comprised of hook portion 2202, skirt portion 2204, head portion 2208, and spoon portion 2210. As illustrated, skirt portion 2204 includes core portion 2206 that is made to self-illuminate in accordance with various embodiments of the present invention. For example, core portion 2206 may be pre-filled with fluorescer and activator solutions that are caused to emanate visible light by actuation of a trigger mechanism (not shown) which operates in accordance with the various trigger activated devices discussed herein. In addition, head portion 2208 may also be pre-filled with fluorescer and activator solutions that are also caused to emanate visible light by actuation of a trigger mechanism (not shown).

In alternate embodiments, the surface of core portion 2206 and head portion 2208 may be sufficiently pliable so as to obviate the need for a trigger mechanism. In such an instance, the surface of core portion 2206 and head portion 2208 may be manipulated in order to rupture the vial to cause the emission of visible light.

Through self-illumination of core portion 2206, skirt portion 2204 may exhibit a glowing effect once core portion 2206 is caused to emanate visible light. Head portion 2208 may similarly emanate visible light once activated, yielding fishing lure 2250 of FIG. 22B that emanates a plurality of spectrums of visible light to exhibit glow effects as illustrated that enhance the fishing lure's desirability to predator fish. Further enhancement is yielded when head portion 2208 is shaped in the form of a prey fish head as illustrated.

Attachment of the various components of the fishing lure system of FIG. 22A may be accomplished using any number of techniques, so long as the attachment means are temporary so as to allow interchangeability of the various components. Head portion 2208, for example, may be fitted using mechanical friction to core portion 2206, whereas a clasp mechanism (not shown) within core portion 2206 may be used to temporarily apply a mechanical friction between skirt portion 2204 and hook portion 2202. In addition, head portion 2208 may be divided into two portions, as discussed above in relation to FIGS. 8C and 13A, where each portion is hinged together so that head portion 2208 may be clamped onto spoon portion 2210.

Figure 23:
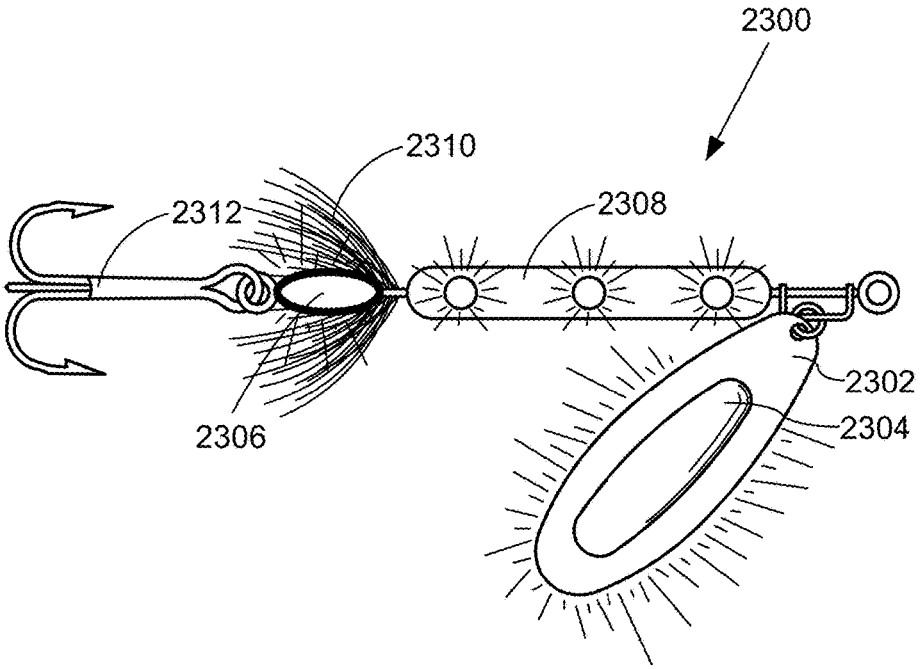
FIG. 23 illustrates a self-illuminating sports/entertainment device in accordance with alternate embodiments of the present invention.

Turning to FIG. 23, an alternate embodiment of self-illuminating inserts of a fishing lure system in accordance with the present invention are illustrated. In particular, fishing lure 2300 illustrates a fishing lure system comprised of core portion 2306, skirt portion 2310, head portion 2308, and spoon portion 2302. Spoon portion 2302 may also comprise an insert 2304. Conversely, spoon portion 2302 may comprise a detachable, self-illuminating packet, as discussed above in relation to FIG. 2A, that attaches through any number of attachment means, e.g., a Velcro® mechanism, a zipper mechanism, a channel mechanism, or liquid agent. Each of core portion 2306, head portion 2308, spoon portion 2302, and/or insert 2304 may be caused to emanate visible light by actuation of a trigger mechanism (not shown) which operates in accordance with the various trigger activated devices discussed herein.

In alternate embodiments, the surface of core portion 2306, head portion 2308, spoon portion 2302, and/or insert 2304 may be sufficiently pliable so as to obviate the need for a trigger mechanism. In such an instance, the surface of core portion 2306, head portion 2308, spoon portion 2302, and/or insert 2304 may be manipulated in order to rupture the vial to cause the emission of visible light.

It is noted that each of the various portions of fishing lure 2300 may be temporarily fitted together, as discussed above in relation to FIGS. 22A-22B, to allow for the interchangeability of chemiluminescent effects. In addition, insert 2304 of spoon portion 2302 may operate as discussed above in relation to FIGS. 21A-21B, whereby insert 2304 may be interchanged to modify the color of light emanated by spoon portion 2302. Optionally, insert 2304 may be permanently affixed within the void of spoon portion 2302.

Figure 24A:
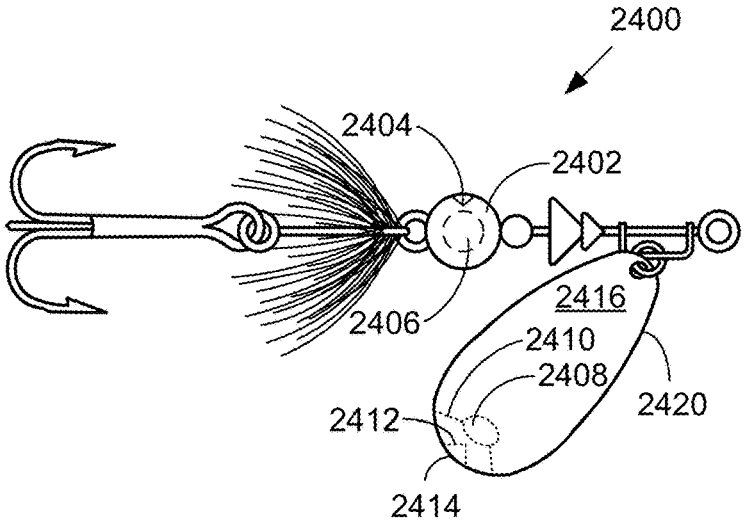
FIGS. 24A-24B illustrate self-illuminating sports/entertainment devices in accordance with alternate embodiments of the present invention.
Figure 24B:
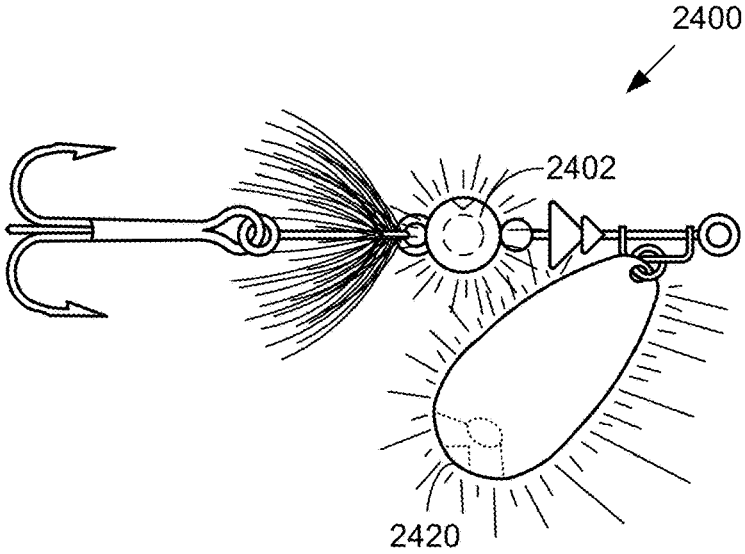

Turning to FIGS. 24A-24B, alternate embodiments of self-illuminating inserts of a fishing lure system in accordance with the present invention are illustrated. In particular, fishing lure 2400 illustrates a fishing lure system that incorporates a head portion 2404 that is similar to the fishing bead as discussed above in relation to FIGS. 13A-13B that is designed to emulate a prey fish egg. Accordingly, fishing bead 2402 may be pre-filled with fluorescer and activator solutions that are caused to mix by actuation of trigger mechanism 2404 to rupture vial 2406 which causes emanation of visible light in accordance with the various trigger activated devices discussed herein. It is noted that each of the various inserts of fishing lure 2400 may be temporarily fitted together, as discussed above in relation to FIGS. 22A-22B and 23A-23B to allow for the interchangeability of chemiluminescent effects.

For example, chemiluminescent spoon/spinner 2420 may be an interchangeable insert that may be pre-filled with both an activator solution and a fluorescer solution that are kept separate through use of vial 2408. Vial 2408 may be affixed to inner portions of spoon/spinner 2420 via, e.g., supports 2410, so as to facilitate rupture of vial 2408 using tactile depression of trigger 2412 as in steps 102-106 of FIG. 1. In particular, surface 2414 of trigger 2412 forms a portion of the surface of spoon/spinner 2420 and exhibits greater pliability as compared to the remaining surface area of spoon/spinner 2420 so as to allow depression of trigger 2412 to engage vial 2408. Applying a sufficient amount of force upon surface 2414 causes trigger 2412 to rupture vial 2408, which then allows the activator and fluorescer solutions to mix within cavity portion 2416. The mixed solutions then cause spoon/spinner 2420 to emit visible light as illustrated in FIG. 24B. In alternate embodiments, trigger 2412 is an optional component, such that the pliability of a portion, or all, of the surface of spoon/spinner 2420 facilitates the rupture of vial 2408. In addition, fishing bead 2404 may be divided into two sections, where each section is hinged to clamp onto spoon/spinner 2420.

Turning to FIG. 25A, one embodiment of a self-illuminating emergency device is illustrated, whereby self-illumination automatically occurs when deployment of an emergency vessel is executed. In particular, object 2500 exemplifies a self-inflating life raft that is activated by "rip cord" 2508 that is similar to a rip cord that is utilized to activate, e.g., a parachute. In response to pulling rip cord 2508, buoyancy panels 2510 forming the walls of life raft 2500, buoyancy panels forming the floor (not shown), and self-erecting canopy 2504 are inflated to promote the sustenance of life while afloat. In addition, an emergency message board, which is generally attached to self-erecting canopy 2504 as illustrated, is caused to self-illuminate caption 2502, thereby projecting an emergency message, e.g., "SOS", through the use of visible light that is generated through chemiluminescent activation of captioned message 2502.

Canister 2506, for example, may typically be filled with a compressed gas, such as carbon dioxide, $CO_2$, and may then be caused to release the compressed gas into buoyancy panels 2510 of life raft 2500. In addition, self-erecting canopy 2504 is caused to self-inflate or otherwise self-deploy as illustrated, whereby supports 2572 located within the interior of life raft 2500 facilitate the erection of self-erecting canopy 2504 to remain deployed even during periods of inclement weather. In response, life raft 2500 becomes positively buoyant so as to maintain and protect the lives of those persons that occupy life raft 2500.

In one embodiment, activation of the chemiluminescence of captioned message 2502 occurs simultaneously with the inflation of the buoyancy panels of life raft 2500 in response to the pulling of rip cord 2508. Turning to FIG. 25B, for example, a reverse trigger mechanism is illustrated, whereby interface 2562 mechanically engages with rip cord 2508, so as to facilitate reverse activation of trigger mechanism 2552 when rip cord 2508 is pulled.

In particular, reverse activation cords 2560 mechanically engage rip cord 2508 via interface 2562, whereby the pulling of rip cord 2508 causes reverse activation cords 2560 to move in direction 2564. In response, surface 2558 is also caused to move in direction 2564, whereby the interface between reverse activation cords 2560 and surface 2566 is such that surface 2566 maintains a substantially static position while surface 2558 moves in direction 2564. As such, vial 2556 also moves in direction 2564 while trigger mechanism 2552 retains a substantially static position. Sufficient movement of vial 2556 towards trigger mechanism 2552 in direction 2564 causes vial 2556 to rupture, thereby releasing the chemiluminescent solution contained within vial 2556 to mix with the chemiluminescent solution contained within cavity 2554. Since cavity 2554 and corresponding vial 2556/trigger mechanism 2552 exists within each of the letters, numbers, designs, patterns, etc., of caption 2502, then caption 2502 is caused to self-illuminate as illustrated in FIG. 25A, thereby causing life raft 2500 to become more visible at night or in otherwise dark conditions.

In alternate embodiments, interface 2562 may not be directly coupled to rip cord 2508. Instead, the interface illustrated in FIG. 25C may be utilized, whereby a portion of the energy utilized by expansion mechanisms 2570 to facilitate the extension of supports 2572 is also utilized to activate trigger mechanism 2552. As discussed above, for example, pulling of rip cord 2508 causes self-inflation of buoyancy panels 2510, as well as the self-inflation of canopy 2504. In addition, supports 2572 are also inflated to extend the length of supports 2572, thereby extending the height of canopy 2504.

While the length of supports 2572 is extended, expansion mechanisms 2570 mechanically convert a portion of the energy that is utilized to extend the length of supports 2572 to energy that is utilized to exert a force on surface 2566 in direction 2574 as illustrated. In response, surface 2558 is caused to maintain a substantially static position while surface 2566 moves in direction 2574. As such, trigger mechanism 2552 also moves in direction 2574 while vial 2556 retains a substantially static position. Sufficient movement of trigger mechanism 2552 towards vial 2556 in direction 2574 causes vial 2556 to rupture, thereby releasing the chemiluminescent solution contained within vial 2556 to mix with the chemiluminescent solution contained within cavity 2554. Since cavity 2554 and corresponding vial 2556/trigger mechanism 2552 exists within each of the letters, numbers, designs, patterns, etc., of caption 2502, caption 2502 is caused to self-illuminate as exemplified in FIG. 25A, thereby causing life raft 2500 to become more visible at night or in otherwise dark conditions.

In alternate embodiments, caption 2502 may be manually caused to self-illuminate as illustrated in FIG. 25A, thereby causing life raft 2500 to become more visible at night or in otherwise dark conditions. In such an instance, a flexible, elongated self-illuminating packet 202, as exemplified in FIG. 2A, is instead utilized to form caption 2502 that includes an adhesion component to allow attachment of caption 2502 to the emergency message board of FIG. 25A. Adhesion components, such as a Velcro® mechanism, a zipper mechanism, or a channel mechanism may be applied to the back portion of caption 2502 so as to facilitate attachment of caption 2502 to the emergency message board. As such, a variety of captions 2502 may be interchanged as necessary to maintain the desired intensity or desired color of the message conveyed by the emergency message board. In particular, one or more of a variety of captions 2502 may be caused to self-illuminate as in steps 102-106 of FIG. 1 and then applied to the emergency message board as required.

Figure 26:
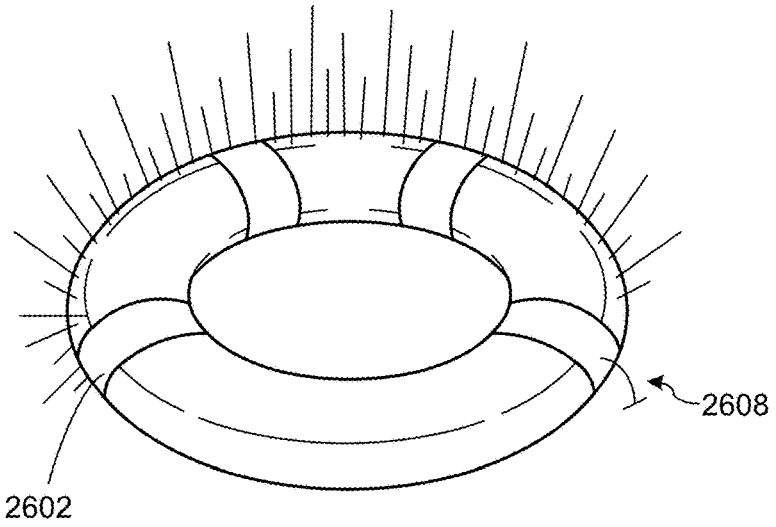
FIGS. 26, 27 and 28A illustrate emergency devices in accordance with the various embodiments of the present invention.
Figure 27:
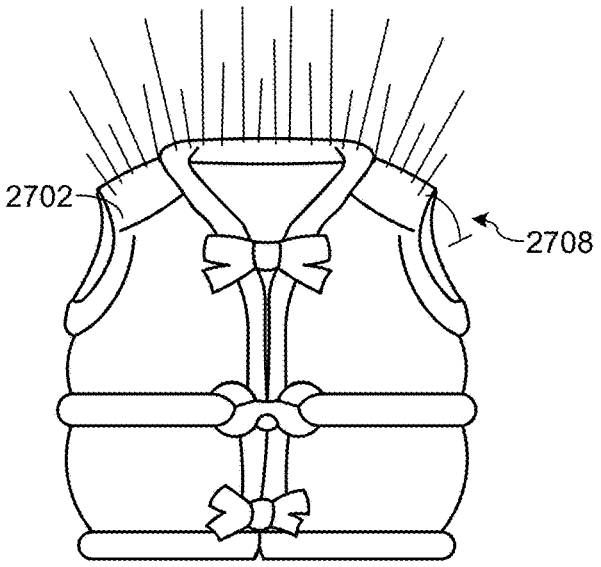

Turning to FIGS. 26-27, alternate embodiments of self-illuminating, personal flotation devices are illustrated, where each of the personal flotation devices may include rip cords 2608 and 2708, respectively, as discussed above in relation to FIGS. 25A-25C. In response to pulling the respective rip cords, buoyancy panels (not shown) are inflated to maintain positive buoyancy of a person wearing the personal flotation device. In particular, compressed air canisters may be used as discussed above in relation to FIG. 25A to increase the buoyancy of the personal flotation device.

In addition, emergency indicators formed by self-illumination panels 2602/2702 and/or other panels (not shown) are caused to self-illuminate, thereby causing the production of visible light that is generated through chemiluminescent activation. Activation of the chemiluminescence of the respective emergency indicators occurs simultaneously with the inflation of the buoyancy panels in response to the pulling of rip cords 2608/2708, whereby the reverse trigger mechanism as discussed above in relation to FIGS. 25B-25C may be utilized to activate the self-illumination. Thus, activation of self-illumination may be accomplished either by pulling rip cords 2608/2708 or by inflation of the buoyancy panels that occurs as a result of the pulling of rip cords 2608/2708.

In alternate embodiments, a flexible, elongated self-illuminating packet 202, as exemplified in FIG. 2A, is instead utilized that includes an adhesion component to allow attachment of self-illuminating packet 202 to the various portions of the emergency devices of FIGS. 26 and 27. Adhesion components, such as a Velcro® mechanism, a zipper mechanism, or a channel mechanism may be applied to the back portion of self-illuminating packet 202 so as to facilitate attachment of self-illuminating packet 202 to the emergency devices. As such, a variety of self-illuminating packets 202 may be interchanged as necessary to maintain the desired intensity or desired color of the emergency devices. In particular, one or more of a variety of self-illuminating packets may be caused to self-illuminate as in steps 102-106 of FIG. 1 and then applied to the various portions of the emergency devices to cause self-illumination of the emergency devices.

In yet other embodiments, the vest of FIG. 27 may not include buoyancy panels, but may nevertheless exhibit emergency indicators formed by self-illumination panels 2602/2702 and/or other panels (not shown) that are caused to self-illuminate, thereby causing the production of visible light that is generated through chemiluminescent activation. Such vests may be worn by emergency personnel such as policeman, fireman, construction workers, etc., so as to increase their visibility during performance of their respective duties.

Figure 28A:
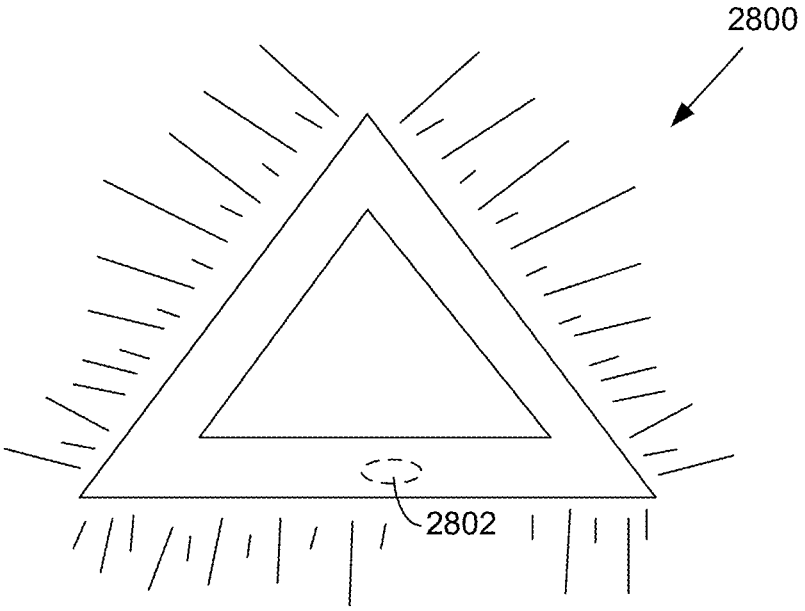
Figure 28B:
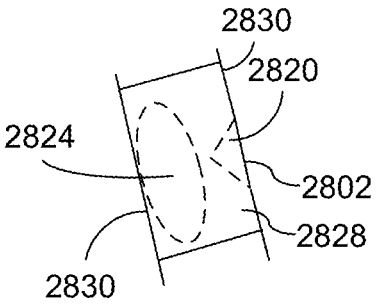
FIG. 28B illustrates a triggering mechanism used to cause the emergency device of FIG. 28A to self-illuminate.

Turning to FIG. 28A, an alternate embodiment of emergency device 2800 is illustrated that exemplifies an emergency triangle for use in, e.g., automotive applications, to warn other drivers of vehicles that are stopped along the side of the road that otherwise are difficult to detect due to nighttime or otherwise darkened conditions. Emergency triangle 2800 incorporates an internal channel 2828 that may be pre-filled with both an activator solution and a fluorescer solution that are kept separate through use of vial 2824 as illustrated in FIG. 28B, which is representative of a cross-section of emergency triangle 2800. Vial 2824 may be affixed to an inner portion of wall 2830 so as to facilitate rupture of the vial using tactile depression of trigger 2820 as in steps 102-106 of FIG. 1. In particular, surface 2802 of trigger 2820 forms a portion of the outer surface of the emergency triangle 2800 and is sufficiently pliable so as to allow depression of trigger 2820 to engage vial 2824.

Surface 2802 of trigger 2820 forms a portion of the surface of emergency triangle 2800 and exhibits greater pliability as compared to the remaining surface area of emergency triangle 2800 so as to allow depression of trigger 2820 to engage vial 2824. It is noted that the majority of the surface of emergency triangle 2800 is to remain substantially rigid, so as to facilitate use during emergency operations. As a result, only that portion of surface 2802 that is immediately adjacent to trigger 2820 is to remain sufficiently pliable, whereas the remaining surface area of emergency triangle 2800 remains rigid, i.e., non-pliable. Applying a sufficient amount of force upon surface 2802 causes trigger 2820 to rupture vial 2824, which then allows the activator and fluorescer solutions to mix within internal channel 2828. The mixed solutions then cause internal channel 2828 to emit visible light, which in turn causes emergency triangle 2800 to self-illuminate as illustrated in FIG. 28A.

In one embodiment, trigger 2820 may be formed as part of the inner portion of wall 2830 through the use of, e.g., a plastic extrusion mold, whereby the trigger is formed as an integral part of emergency triangle 2800. In addition, trigger 2820 is not necessarily formed as a pointed extrusion, but rather may be formed as a blunted extrusion instead. In addition, trigger 2820 may be formed as a hollow extrusion having a cavity, whereby the cavity (not shown) inside trigger 2820 may be utilized to capture the gaseous emissions produced during the chemiluminescent reaction. Accordingly, a greater amount of solution may be used to fill internal channel 2828, since trigger 2820 provides an exhaust means for the gaseous emissions, which obviates the requirement that internal channel 2828 contain other exhaust means, such as an air bubble that is used as a volume to absorb the gaseous emissions.

Figure 29:
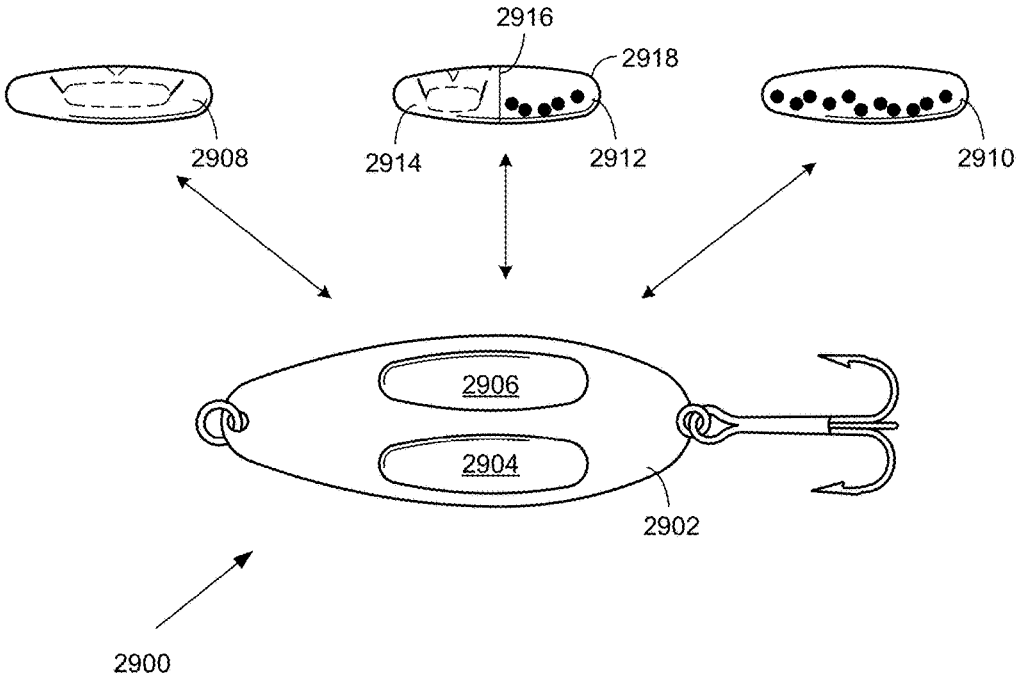
FIG. 29 illustrates a self-illuminating sports/entertainment device in accordance with an alternate embodiment of the present invention.

Turning to FIG. 29, alternate embodiments of a self-illuminating sports/entertainment device in accordance with the present invention are illustrated. In particular, a plurality of detachable inserts are provided that allow interchangeability so as to achieve hybrid chemiluminescent effects. Device 2900 illustrates, for example, fishing lure 2902 having a body portion that exhibits a plurality of voids, e.g., 2904-2906, that are adapted to receive the detachable inserts. A plurality of chemiluminescent inserts, e.g., 2908, chemiluminescent hybrid inserts, e.g., 2918, and/or other inserts, e.g., 2910, may be interchangeably locked into voids 2904-2906 to provide fishing lure 2902 with a variety of hybrid chemiluminescent effects. In one embodiment, fishing lure 2902 is shaped as a spoon lure, but other body shapes may also be employed as discussed above in relation to FIG. 21A. It is noted that the size, shape, and orientation of voids 2904-2906, as well as the number of voids 2904-2906 utilized, may be altered as required by a particular application, so as to accept a variety of inserts that exhibit multiple shapes and sizes.

The outer periphery of the various inserts of FIG. 29 may include a temporary attachment mechanism, such as an extrusion (not shown) that matches a corresponding channel (not shown) of fishing lure 2902 that lies just inside voids 2904-2906. By aligning the extrusion of the inserts with voids 2904-2906 and pressing the inserts into their respective voids, the extrusions and corresponding channels may engage each other to create a mechanical friction that maintains the inserts within the respective voids. In order to exchange any insert with an alternate insert, the insert may be removed from its respective void by applying an opposite force from that which was used to engage the insert within the void. As such, fishing lure 2900 may take on any number of hybrid chemiluminescent effects.

Chemiluminescent insert 2908, for example, may be pre-filled with both an activator solution and a fluorescer solution that are kept separate through use of a vial as discussed herein. Insert 2908 may then be activated and attached within one of voids 2904-2906. In alternate embodiments, the vial contained within insert 2908 may be manufactured such that a length of the vial extends substantially throughout the full length of the inner portion of insert 2908. Accordingly, the need for supports is obviated, since the inner portion of insert 2908 precludes shifting of the vial during tactile depression of the trigger.

In one embodiment, the trigger may be formed as part of the inner portion of insert 2908 through the use of, e.g., a plastic extrusion mold, whereby the trigger is formed as an integral part of insert 2908. In addition, the trigger is not necessarily formed as a pointed extrusion, but rather may be formed as a blunted extrusion instead. In addition, the trigger may be formed as a hollow extrusion having a cavity, whereby the cavity (not shown) inside the trigger may be utilized to capture the gaseous emissions produced during the chemiluminescent reaction. Accordingly, a greater amount of solution may be used to fill insert 2908, since the trigger provides an exhaust means for the gaseous emissions, which obviates the requirement that insert 2908 contain other exhaust means, such as an air bubble that is used as a volume to absorb the gaseous emissions.

A hybrid insert, such as insert 2918, may also be utilized, whereby portion 2914 of insert 2918 exhibits chemiluminescent properties as discussed herein, but portion 2912 exhibits non-chemiluminescent properties. It is noted that hybrid insert 2918 may also be utilized within fishing lure 2014 of FIG. 21A, or conversely, within any of the other embodiments provided herein that utilize inserts, such as discussed above in relation to wings 1818 of FIGS. 18A-18B and the detachable inserts of FIGS. 22-24.

In one embodiment, for example, portion 2912 may contain hardened objects that are free to move about within portion 2912 while fishing lure 2902 is being utilized to attract predator fish. In such an embodiment, separation wall 2916 is utilized to separate portions 2912 and 2914 so as to maintain the effectiveness of each respective portions. As a result, fishing lure 2902 may not only be visible to the predator fish via chemiluminescence of portion 2914, but may also be audible to the predator fish, due to the rattling effects provided by the movement of the hardened objects within portion 2912. In alternate embodiments, insert 2910 may be used in conjunction with insert 2908, whereby both a chemiluminescent insert and an audible insert may be used within voids 2904-2906 to enhance the attractive effects of fishing lure 2902.

In alternate embodiments, hybrid insert 2918 may utilize one or more separation walls 2916 to separate two or more portions of hybrid insert 2918. In such an instance, a plurality of separated chemiluminescent effects, or a plurality of chemiluminescent effects separated from a plurality of rattling effects may be produced from the various portions of hybrid insert 2918.

It is noted that the hybrid chemiluminescent effects of fishing lure 2902 may also be incorporated into the fishing lures of FIGS. 21 and 23-24. For example, spoon portion 2302 of FIG. 23 and chemiluminescent spoon/spinner 2420 of FIG. 24 may utilize the hybrid chemiluminescent effects of fishing lure 2902 by incorporating multiple inserts to enhance the attractive effects of fishing lures 2300 and 2400.

Figure 30A:
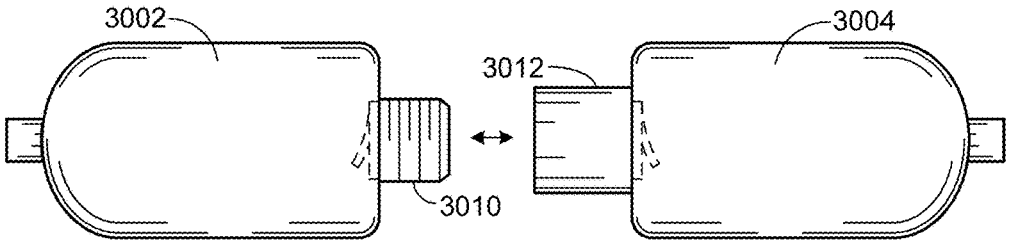
FIGS. 30A-30E illustrate self-illuminating sports/entertainment devices in accordance with alternate embodiments of the present invention.

Turning to FIG. 30A, an alternate embodiment of a self-illuminating sports/entertainment device in accordance with the present invention is illustrated. In particular, self-illuminating devices 3002 and 3004 represent both halves of a device that are coupled together to form a union between devices 3002-3004 using, e.g., male connector 3010 and female connector 3012, as illustrated. Irrespective of the shape of devices 3002 and 3004 as illustrated in FIG. 30A, devices 3002 and 3004 may be representative of both halves of the exemplary devices as illustrated in FIGS. 8, 12-13, 18-20, and 28. That is to say, for example, that devices 3002 and 3004 may be representative of both halves of device 1826 of FIG. 18C, which are coupled together using male and female connectors 3010 and 3012, respectively.

Figure 30B:
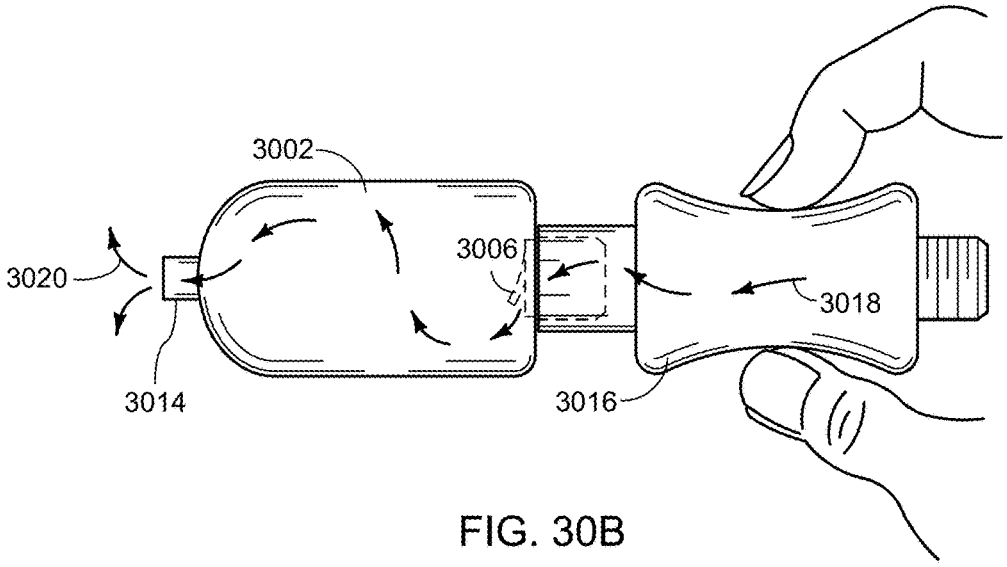
Figure 30C:
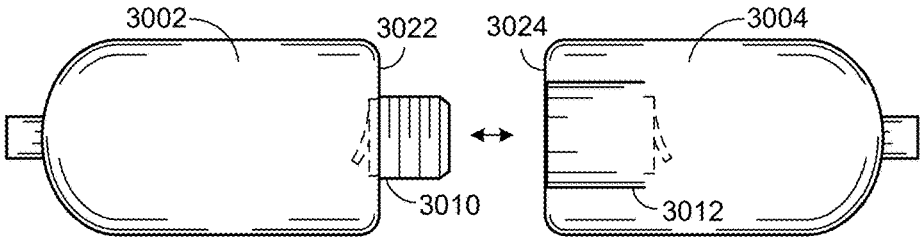

In certain embodiments, both halves of the device may need to be coupled in such a manner that allows the inner surface, e.g., 3022 and 3024 of FIG. 30C, to come into contact with each other. In such an instance, female connector 3012 may be configured to be completely encompassed within device 3004, such that once male member 3010 is fully engaged with female member 3012, surfaces 3022 and 3024 contact one another. As a result, the outer surface of devices 3002 and 3004 forms a congruent surface that appears to form a single device, such as device 1826 of FIG. 18C.

Turning to FIG. 30B, an alternate utility of male/female connectors 3010 and 3012 is illustrated, whereby the male/female connectors provide refill ports that facilitate a refill operation of devices 3002 and/or 3004. In particular, refill device 3016 may contain both an activator solution and a fluorescer solution that are caused to come into contact with one another to emit visible light through chemiluminescence in accordance with the various embodiments of the invention as provided herein. Refill device 3016 may then be coupled to device 3002 as illustrated, such that depression of the outer surface of refill device 3016 causes the transfer of chemiluminescent solution 3018 contained within refill device 3016 to device 3002 via one-way valve 3006.

In response, expired chemiluminescent solution 3020 is caused to be expelled from device 3002 via exhaust valve 3014. Once the transfer is complete, leakage of the chemiluminescent solution contained within device 3002 is prevented through closure of one-way valve 3006. It can be seen, therefore, that by: 1) connecting refill device 3016 to each of devices 3002-3004; 2) replacing expired chemiluminescent solution with newly activated chemiluminescent solution; and 3) reconnecting devices 3002-3004; that a device, e.g., device 1826 of FIG. 18C, may be refilled with newly activated chemiluminescent solution so as to replenish and/or change the self-illumination properties of the device.

In alternate embodiments, devices 3002 and/or 3004 may form a single device. In such an instance, either of connectors 3010 or 3012, respectively, form a single refill port and the respective exhaust valves 3014 provide the mechanism utilized to exhaust expired chemiluminescent solution upon transfer of chemiluminescent solution 3018 contained within the respective refill device.

Figure 30D:
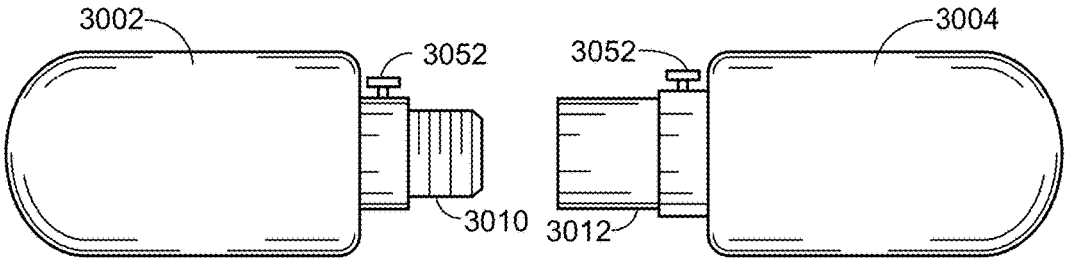
Figure 30E:
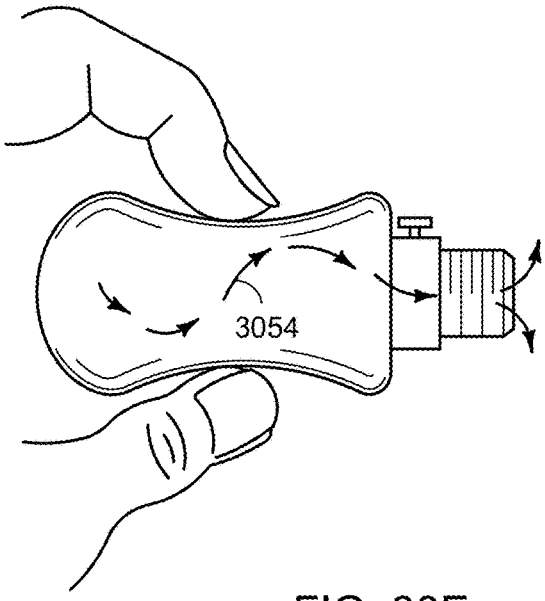

Turning to FIGS. 30D-30E, an alternate embodiment is illustrated, whereby expulsion of expired chemiluminescent solution from devices 3002 and 3004 may instead be achieved via valves 3052 that may form a portion of connectors 3010 and 3012 as illustrated. Valves 3052 may be opened such that depression of devices 3002 and 3004 causes expired chemiluminescent solution 3054 to be expelled as illustrated in FIG. 30E, without the necessity to attach refill device 3016 as discussed above in relation to FIG. 30B. In such an instance, valves 3052 provide a "breather" function through ventilation, whereby outside air is allowed to occupy volume within devices 3002-3004 that is left vacant by the exhausted chemiluminescent solution 3054.

Figure 31A:
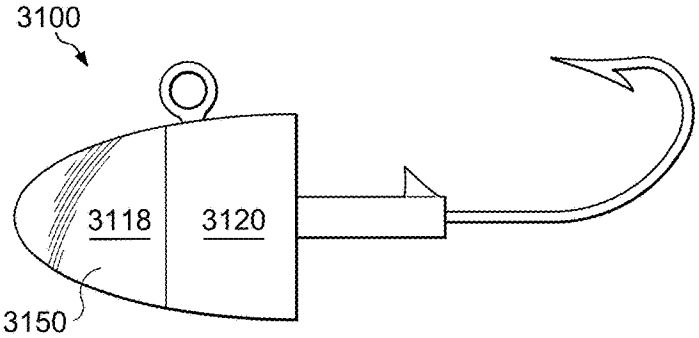
FIGS. 31A-31D illustrate jig head style fishing lures in accordance with alternate embodiments of the present invention.

Turning to FIG. 31A, an alternate embodiment of jig head style fishing lure 3100 is illustrated, whereby "bullet shaped" jig head lure 3100 is segmented into first portion 3118 and second portion 3120. Second portion 3120 may be implemented with a heavy metal, e.g., lead. First portion 3118 may instead be implemented with a translucent or transparent material, e.g., plastic, such that the solution contained within the one or more cavities of first portion 3118 may be visible.

Figure 31B:
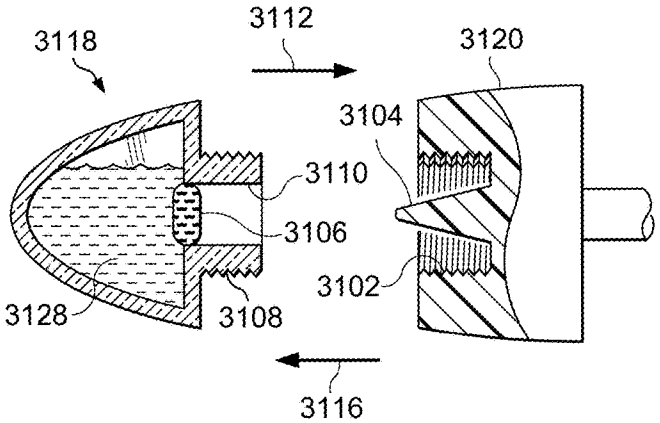

It is noted that first portion 3118 may be mechanically engaged in direction 3112, as illustrated in FIG. 31B, to second portion 3120 to form a single, bullet-shaped jig head portion 3150, whereby the interface between first portion 3118 and second portion 3120 is congruent and appears to form a single device when the two portions are engaged. It is further noted that second portion 3120 may instead be formed of the translucent or transparent material, e.g., plastic, such that the solution contained within the one or more cavities of second portion 3120 may be visible, while first portion 3118 may instead be formed of the heavy metal, e.g., lead.

First portion 3118 may be disengaged in direction 3116, as illustrated in FIG. 31B, from second portion 3120, so as to facilitate interchangeability between first and second portions 3118 and 3120, respectively. For example, first portion 3118 may represent a chemiluminescent attachment, such that when activated in accordance with the various embodiments of the present invention, first portion 3118 emanates visible light through chemiluminescence. Once the emanation of visible light from first portion 3118 has expired, first portion 3118 may be disengaged from second portion 3120 and exchanged with a replacement first portion 3118.

Figure 31C:
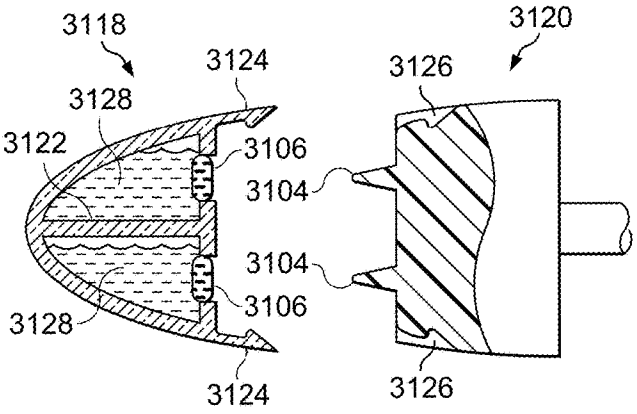

Turning to FIG. 31C, a first embodiment of mechanical engagement is illustrated, whereby clasps 3124 of first portion 3118 engage mating portions 3126 of second portion 3120 once first portion 3118 and second portion 3120 are engaged to form bullet-shaped jig head portion 3150. Engagement of first portion 3118 to second portion 3120 also causes triggers 3104 to engage vials 3106, thereby causing vials 3106 to rupture. As a result, the solution contained within vials 3106 mixes with the solution contained within cavities 3128 to emanate visible light through chemiluminescence as in steps 102-106 of FIG. 1. It is noted that a water-tight seal (not shown) may be created within first portion 3128, so as to prevent leakage of solution from cavities 3128 and vials 3106.

As illustrated, a plurality of cavities 3128 may exist within first portion 3118, where each cavity contains a chemiluminescent solution that may be configured to emanate a different color of light when activated. As a result, a plurality of chemiluminescent effects may be generated within first portion 3118, such that one or more colors may be emanated during the chemiluminescent phase of first portion 3118.

Figure 31D:
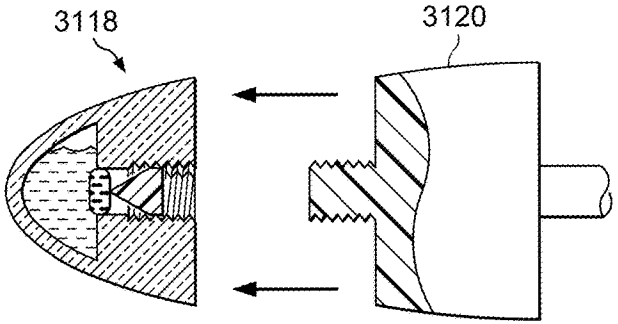

FIG. 31B illustrates an alternate mechanical engagement embodiment, whereby male portion 3108 of first portion 3118 engages female portion 3102 of second portion 3120 via threaded portions as illustrated. Engagement of first portion 3118 to second portion 3120 also causes trigger 3104 to engage vial 3106, thereby causing vial 3106 to rupture. As a result, the solution contained within vial 3106 mixes with the solution contained within cavity 3128 to emanate visible light from cavity 3128 through chemiluminescence as in steps 102-106 of FIG. 1. It is noted that a water-tight seal (not shown) may be created within first portion 3128, so as to prevent leakage of solution from cavity 3128 and vial 3106. FIG. 31D illustrates yet another mechanical engagement embodiment, whereby the female portion instead exists within first portion 3118 and the male portion exists within second portion 3120.

Other embodiments are also provided, whereby first portion 3118 includes both the trigger mechanism and the vial. In such an instance, mechanical engagement between first portion 3118 and second portion 3120 does not cause the trigger to engage the vial. Rather, a portion of the surface of first portion 3118 instead contains the trigger mechanism, whereby the portion of the surface of first portion 3118 that is immediately adjacent to the trigger mechanism is sufficiently pliable so as to allow depression of the trigger mechanism to engage the vial. The remaining surface of first portion 3118 is not sufficiently pliable, i.e., rigid, so as to provide sufficient rigidity during fishing operations. Applying a sufficient amount of force upon the portion of the surface of first portion 3118 causes the trigger mechanism to rupture the vial, which then allows the activator and fluorescer solutions to mix within cavity 3128. The mixed solutions then cause cavity 3128 to emit visible light, which in turn causes first portion 3118 to self-illuminate.

Figure 32A:
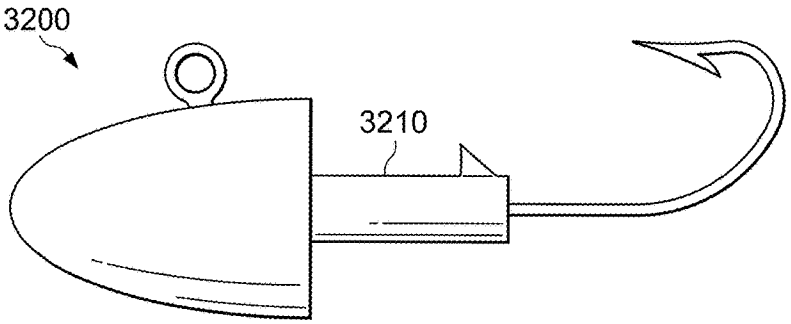
FIGS. 32A-32E illustrate fishing lures in accordance with alternate embodiments of the present invention.
Figure 32B:
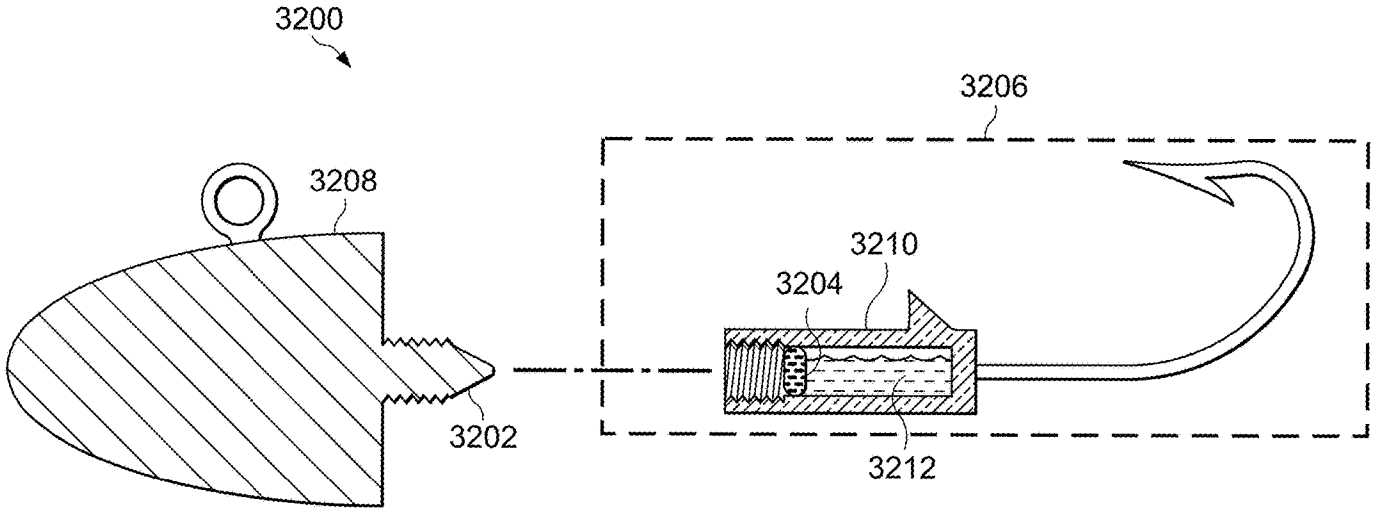

Turning to FIGS. 32A and 32B, an alternate embodiment of jig head style fishing lure 3200 is illustrated, whereby bullet shaped jig head lure 3200 is segmented into first portion 3208 and second portion 3206. First portion 3208 may be implemented with a heavy metal, e.g. lead. Shaft portion 3210 of second portion 3206 may instead be implemented with a translucent or transparent material, e.g., plastic, such that the solution contained within cavity 3212 may be visible.

It is noted that first portion 3208 and second portion 3206 may be mechanically engaged to form a single, bullet-shaped jig head portion 3200, whereby the interface between first portion 3208 and second portion 3206 is congruent and appears to form a single device when the two portions are engaged. First portion 3208 may be disengaged from second portion 3206, so as to facilitate interchangeability between first and second portions 3208 and 3206, respectively. For example, shaft portion 3210 of second portion 3206 may represent a chemiluminescent attachment, such that when activated in accordance with the various embodiments of the present invention, shaft portion 3210 of second portion 3206 emanates visible light through chemiluminescence. Once the emanation of visible light from shaft portion 3210 of second portion 3206 has expired, second portion 3206 may be disengaged from first portion 3208 and exchanged with a replacement second portion 3206.

FIG. 32B illustrates one embodiment, whereby male portion 3202 of first portion 3208 engages the female portion of shaft portion 3210 via threaded portions as illustrated. Engagement of first portion 3208 to second portion 3206 also causes male portion 3202 to act as a trigger mechanism to engage vial 3204, thereby causing vial 3204 to rupture. As a result, the solution contained within vial 3204 mixes with the solution contained within cavity 3212 to emanate visible light from cavity 3212 through chemiluminescence. It is noted that a water-tight seal (not shown) may be created within shaft portion 3210, so as to prevent leakage of solution from cavity 3212 and vial 3204.

Other embodiments are also provided, whereby shaft portion 3210 includes both the trigger mechanism and the vial. In such an instance, mechanical engagement between first portion 3208 and second portion 3206 does not cause the trigger to engage the vial. Rather, a portion of the surface of shaft portion 3210 instead contains the trigger mechanism, whereby the portion of the surface of shaft portion 3210 that is immediately adjacent to the trigger mechanism is sufficiently pliable so as to allow depression of the trigger mechanism to engage the vial. The remaining surface of shaft portion 3210 is not sufficiently pliable, i.e., rigid, so as to provide sufficient rigidity during fishing operations. In such an embodiment, it is noted that first portion 3208 and second portion 3206 may be permanently affixed to one another. Furthermore, the cavity 3212 of shaft portion 3210 may contain an inner core (not shown in FIG. 32B) comprised of a solid, such as a metal, or may be completely filled with solution as illustrated in FIG. 32B.

Applying a sufficient amount of force upon the portion of the surface of shaft portion 3210 causes the trigger mechanism to rupture the vial, which then allows the activator and fluorescer solutions to mix within cavity 3212. The mixed solutions then cause cavity 3212 to emit visible light, which in turn causes shaft portion 3210 to self-illuminate.

Figure 32C:
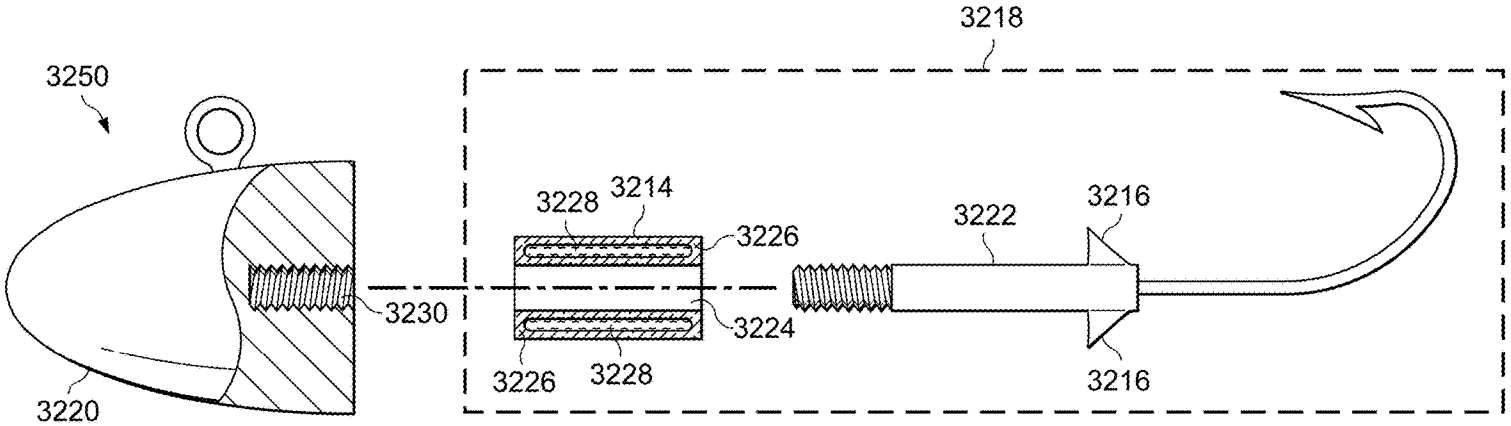

Turning to FIG. 32C, an alternate embodiment of jig head style fishing lure 3250 is illustrated, whereby bullet-shaped jig head lure 3250 is segmented into first portion 3220 and second portion 3218, where second portion 3218 is further segmented into shaft portion 3222 and cylindrical portion 3214. First portion 3220 and shaft portion 3222 of second portion 3218 may be implemented with a heavy metal, e.g., lead, whereas cylindrical portion 3214 may instead be implemented with a translucent or transparent material, e.g., plastic.

As illustrated, cylindrical portion 3214 is translucent or transparent, such that the solution contained within cavity 3226 may be visible. In addition, cylindrical portion 3214 surrounds channel 3224 which is hollow, so as to allow insertion of shaft portion 3222 into channel 3224. As illustrated, shaft portion 3222 engages female portion 3230 of first portion 3220 to complete the assembly of first portion 3220 and second portion 3218, whereby once assembled, cylindrical portion 3214 surrounds shaft portion 3222. It is noted, that channel 3224 of cylindrical portion 3214 may be lined with a layer of protective coating, such as steel, aluminum, or ceramic, so as to protect cylindrical portion 3214 from inadvertent damage that may be caused by the friction between shaft portion 3222 and cylindrical portion 3214 within channel 3224.

Engagement of flanges 3216 against cylindrical portion 3214 engages a trigger mechanism (not shown) within cylindrical portion 3214, thereby causing vial 3228 to rupture. As a result, the solution contained within vial 3228 mixes with the solution contained within cavity 3226 to emanate visible light from cavity 3226 through chemiluminescence.

In an alternate embodiment, mechanical engagement between flanges 3216 and cylindrical portion 3214 does not cause the trigger to engage the vial. A portion of the surface of cylindrical portion 3214 contains the trigger mechanism, whereby the portion of the surface of cylindrical portion 3214 that is immediately adjacent to the trigger mechanism is sufficiently pliable so as to allow depression of the trigger mechanism to engage the vial. The remaining surface of cylindrical portion 3214 is not sufficiently pliable, i.e., rigid, so as to provide sufficient rigidity during fishing operations. Applying a sufficient amount of force upon the portion of the surface of cylindrical portion 3214 causes the trigger mechanism to rupture the vial, which then allows the activator and fluorescer solutions to mix within cavity 3226. The mixed solutions then cause cavity 3226 to emit visible light, which in turn causes cylindrical portion 3214 to self-illuminate. In such an instance, it is noted that shaft portion 3222 may be inserted into cylindrical portion 3214 and first portion 3220, such that shaft portion 3222 permanently attaches to first portion 3220. In addition, cylindrical portion 3214 may also be manufactured with flanges 3216, in the event that shaft portion 3222 is absent flanges 3216.

In alternate embodiments, the surface of cylindrical portion 3214 may be sufficiently pliable so as to obviate the need for a trigger mechanism. In such an instance, the surface of cylindrical portion 3214 may be manipulated in order to rupture vial 3228 to cause cylindrical portion 3214 to emit visible light.

Figure 32D:
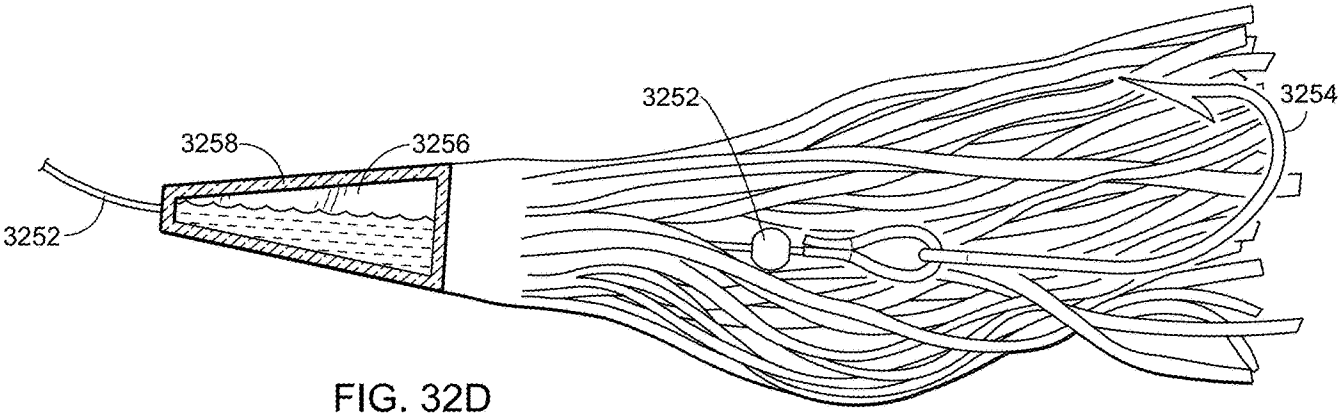

In alternate embodiments, such as illustrated in FIG. 32D, at least a portion of cylinder 3256 may be fitted within a cavity (not shown) of first portion 3258. In such an embodiment, cylinder 3256 may conform to the dimensions of the cavity (not shown) of first portion 3258 as cylinder 3256 is fitted within first portion 3258. As illustrated, first portion 3258 is sufficiently translucent, or transparent, so as to allow the emanation of visible light from first portion 3258 once cylinder 3256 is activated. It is noted that shaft portion/fishing line 3252 extends within the hollow portion of cylinder 3256 and is detachably connected to hook portion 3254 to complete the fishing lure assembly. Accordingly, once the emanation of visible light from cylinder 3256 has expired, shaft portion/fishing line 3252 may be disengaged from hook portion 3254 to facilitate replacement of cylinder 3256. It is noted that the hollow portion of cylinder 3256 may be lined with a layer of protective coating, such as steel, aluminum, or ceramic, so as to protect cylinder 3256 from inadvertent damage that may be caused by the friction between shaft portion/fishing line 3252 and cylinder 3256.

Figure 32E:
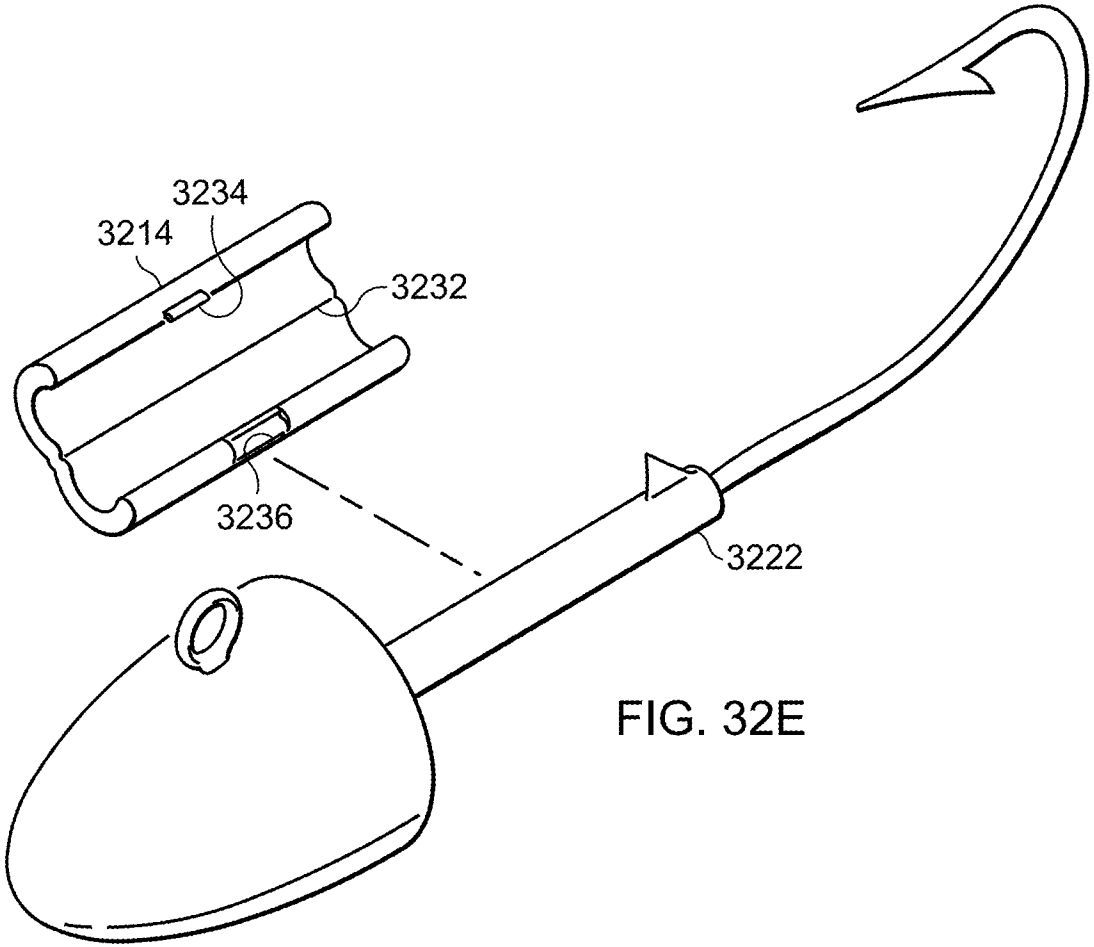

In an alternate embodiment, as illustrated in FIG. 32E, cylindrical portion 3214 contains hinge 3232, which allows cylindrical portion 3214 to be opened and then clasped around shaft portion 3222 to be held in place. As illustrated, cylindrical portion 3214 folds around shaft portion 3222 to allow engagement of clasp 3234 with receiver 3236, whereby once assembled, cylindrical portion 3214 surrounds shaft portion 3222 and is locked into place via clasp 3234 and receiver 3236. As discussed above in relation to FIG. 8C, upon closure of cylindrical portion 3214 around shaft portion 3222, compression forces causing clasp 3234 to engage 3236 may also engage trigger mechanisms (not shown in FIG. 32E), thereby causing vials 3228 to rupture. The solutions contained within cavity 3226 are then allowed to mix with solution contained within vials 3228, which then causes the emission of visible light by the process of chemiluminescence from cavity 3226.

It is understood that cylindrical portion 3214 may not be configured to surround shaft portion 3222 and, therefore, hollow channel 3224 may be replaced with a solid channel, or conversely, may be filled with chemiluminescent solution. In such an instance, cylindrical portion 3214 may be configured with an attachment means (not shown) that allows the exterior portion of cylindrical portion 3214 to be detachably engaged to the exterior portion of shaft portion 3222. Cylindrical portion 3214 may simply "snap on" to shaft portion 3222 to provide a mechanical engagement between the outer portion of cylindrical portion 3214 and the outer portion of shaft portion 3222 while cylindrical portion 3214 is emanating visible light. A new cylindrical portion 3214 may then be snapped onto shaft portion 3222 to replace the chemiluminescent effects previously produced by the expired cylindrical portion 3214. It is noted that the shape of cylindrical portion 3214 may be changed from that of a cylinder to virtually any other shape that lends itself to detachable engagement to shaft portion 3222.

Figure 33A:
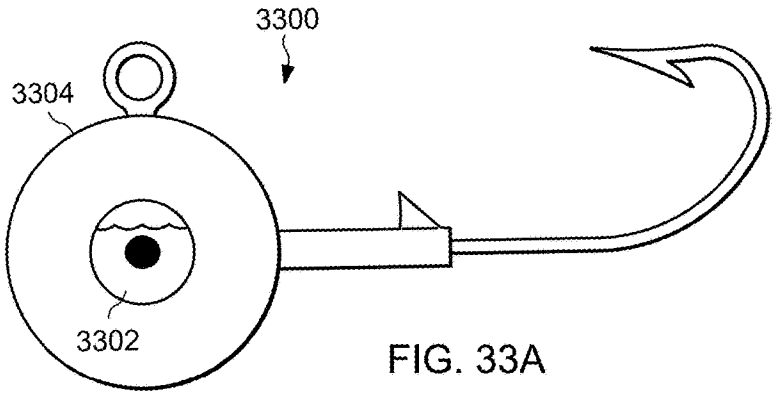
FIGS. 33A-33C illustrate jig head style fishing lures in accordance with alternate embodiments of the present invention.

Turning to FIG. 33A, an alternate embodiment of FIG. 13C is illustrated, whereby jig head style fishing lure 3300 contains eye portion 3302 that may be caused to emanate visible light by chemiluminescence. Spherical portion 3304 may be implemented as a solid object with a heavy metal, e.g., lead, having hollow portion 3316. Hollow portion 3316 extends throughout the interior of spherical portion 3304 to form diametrically opposed openings to allow the insertion of eye portion 3302 through either opening. Eye portion 3302 may be implemented with a translucent or transparent material, e.g., plastic, such that the solution contained within the one or more cavities of eye portion 3302 may be visible.

In alternate embodiments, hollow portion 3316 may not extend throughout the interior of spherical portion 3304 to form two, diametrically opposed openings. Rather, partial hollow portion(s) 3316 may be formed within spherical portion 3304 resulting in singular opening(s) in the surface of spherical portion 3304 that allow the insertion of one or more chemiluminescent inserts along the surface of spherical portion 3304.

It is noted that eye portion 3302 and spherical portion 3304 may be mechanically engaged to form a single jig head portion 3300, whereby eye portion 3302 and spherical portion 3304 appears to form a single device when the two portions are engaged. In addition, once engaged with spherical portion 3304, eye portion 3302 may form a congruent surface as compared to the surface of spherical portion 3304. Alternately, eye portion 3302 may instead protrude outwardly from the surface of spherical portion 3304, or be retracted inwardly from the surface of spherical portion 3304, so as to produce the effect that eye balls are either protruding from spherical portion 3304 or recessed within spherical portion 3304.

Figure 33B:
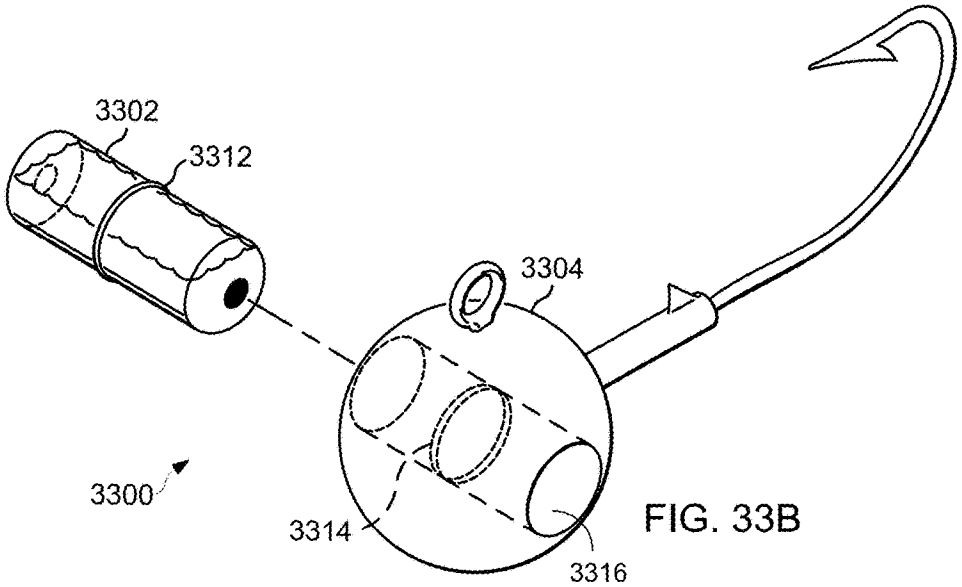

In one embodiment, as illustrated in FIG. 33B, eye portion 3302 may contain flange 3312 that engages channel 3314 of spherical portion 3304 when the two portions are engaged. In alternate embodiments, clip mechanisms (not shown), such as circlips, may instead be utilized to secure eye portion 3302 within spherical portion 3304. In other embodiments, mechanical friction, o-rings, or other mechanical means may instead be utilized to maintain the engagement between eye portion 3302 and spherical portion 3304.

Eye portion 3302 may be disengaged from spherical portion 3304, so as to facilitate interchangeability between portions 3302 and 3304, respectively. For example, eye portion 3302 represents a chemiluminescent attachment, such that when activated in accordance with the various embodiments of the present invention, eye portion 3302 emanates visible light through chemiluminescence. Chemiluminescent activation of eye portion 3302 may include an operation whereby eye portion 3302 is compressed along the longitudinal axis of eye portion 3302 in order to rupture the vial(s) (not shown) contained within eye portion 3302.

Once the emanation of visible light from eye portion 3302 has expired, eye portion 3302 may be disengaged from spherical portion 3304 and exchanged with a replacement eye portion 3302. It is noted that spherical portion 3304 may be reinforced with a protective coating, such as steel, aluminum, or ceramic, so that multiple engagement/disengagement operations between portions 3302 and 3304 does not excessively wear spherical portion 3304.

It is further noted that the shape of spherical portion 3304 may be altered to any other shape, e.g., a bullet shape, in order to accommodate the particular fishing operation being implemented. For example, spherical-shaped lures may be utilized to attract smaller predator fish in fresh water applications, whereas bullet-shaped lures may instead be utilized to attract larger predator fish in salt water applications.

Figure 33C:
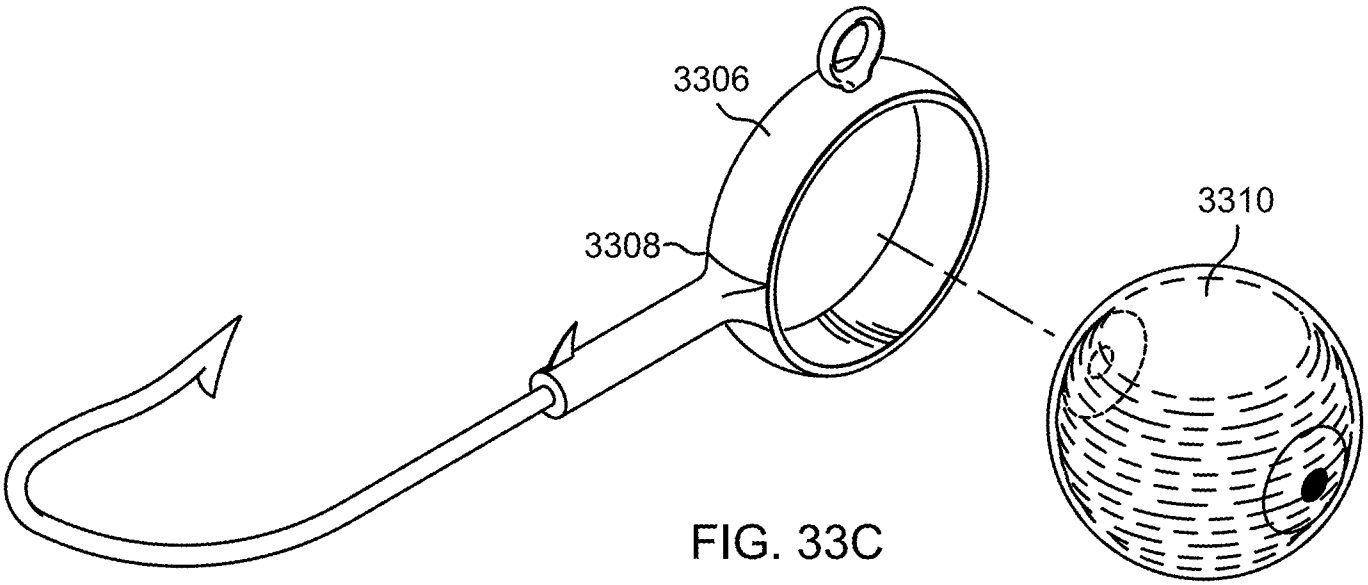

In an alternate embodiment, as illustrated in FIG. 33C, eye portion 3302 and spherical portion 3304 are combined to form a single portion 3310. In one embodiment, single portion 3310 is similar to that of FIG. 13C, such that the entire sphere contains a first solution and a vial that when ruptured, causes a second solution contained within the vial to mix with the first solution to emanate visible light by chemiluminescence. In an alternate embodiment, each of eye portion 3302 and spherical portion 3304 forms single portion 3310 that may individually contain respective chemiluminescent solutions and vials that when activated, are caused to emanate visible light by chemiluminescence. Accordingly, eye portion 3302 and spherical portion 3304 may be configured to emanate light of different color, intensity, etc.

Band portion 3306 is configured to accept single portion 3310, whereby single portion 3310 and/or portion 3306 is sufficiently pliable to contract/expand while single portion 3310 is inserted into band portion 3306. As a result, once single portion 3310 is inserted into band portion 3306, single portion 3310 and/or band portion 3306 returns to its original shape to form a mechanical engagement between single portion 3310 and band portion 3306.

In an alternate embodiment, band portion 3306 contains interface 3308 and associated clasping mechanisms (not shown, but similar to clasp 3234 and receiver 3236 of FIG. 32D), whereby band portion 3306 may be separated at interface 3308 to allow insertion of single portion 3310. Once inserted, band portion 3306 may be rejoined at interface 3308 to allow engagement of the clasping mechanisms (not shown) to hold single portion 3310 into place.

Figure 34A:
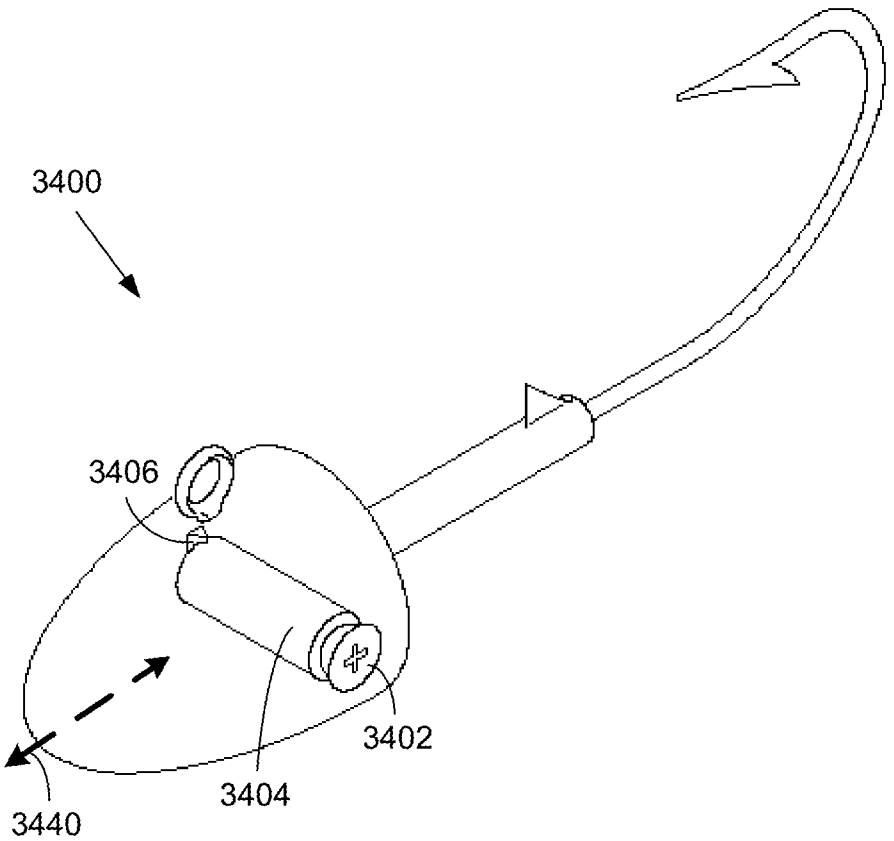
FIGS. 34A-34E illustrate various actuator mechanisms in accordance with alternate embodiments of the present invention.

Turning to FIG. 34A, an alternate embodiment is illustrated, whereby manipulation of vial 3404 via steps 102-106 of FIG. 1 may be accomplished through use of an actuator that is integrated within fishing lure 3400. As illustrated in FIG. 34A, actuator 3402, wedge portion 3406, and associated vial 3404 are configured along an axis that is orthogonal to longitudinal axis 3440 of fishing lure 3400. In alternate embodiments, actuator 3402, wedge portion 3406, and vial 3404 may extend parallel to longitudinal axis 3440 or may be configured at any other geometric relationship with respect to longitudinal axis 3440.

Figure 34C:
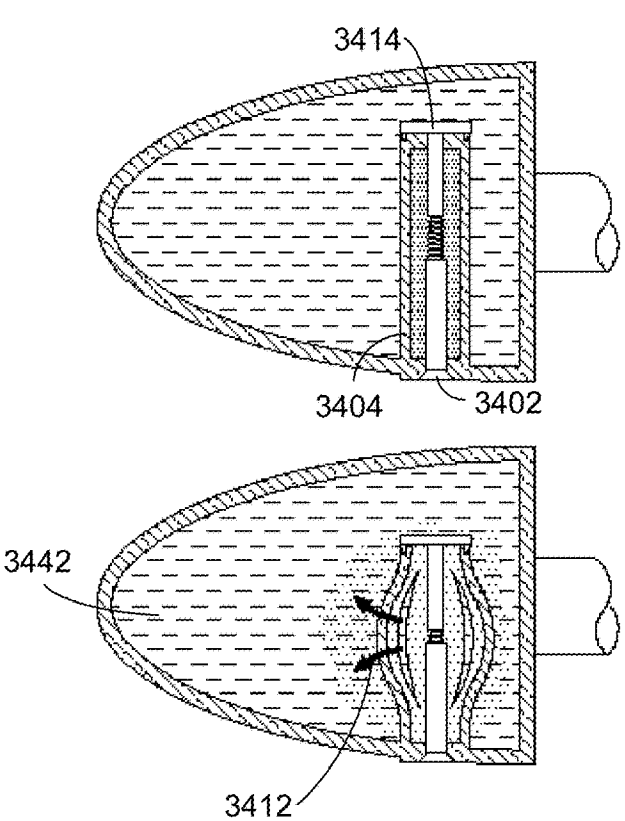
Figure 34B:
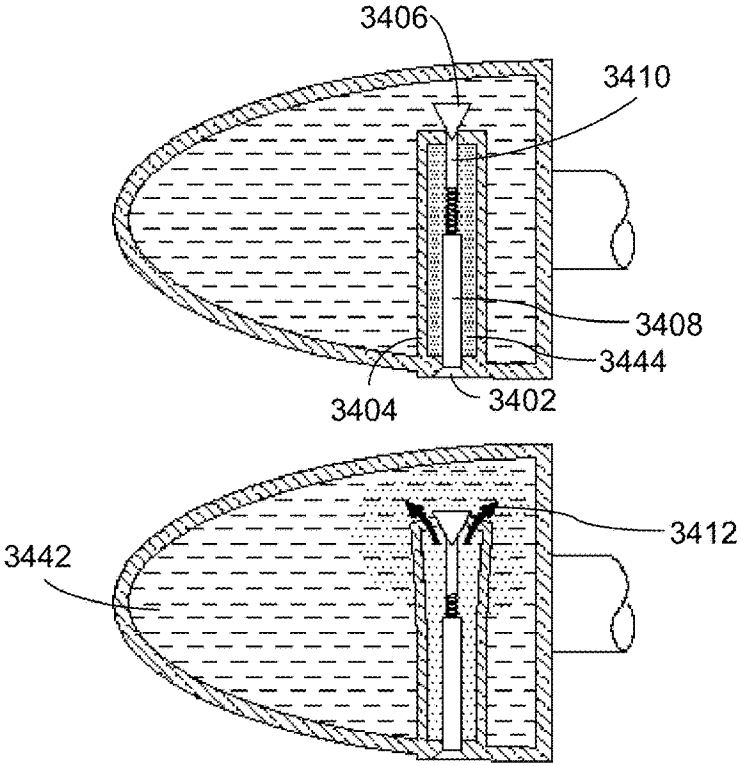

Turning to FIG. 34B, a cross-section view illustrates vial 3404 as providing a hollow channel through which actuator 3402 is inserted. Wedge portion 3406 is attached to the opposite end of actuator 3402 via threaded portion 3410. Rotation of actuator 3402 causes threaded portion 3410 to be drawn into shaft portion 3408 of actuator 3402. In response, wedge portion 3406 is caused to be drawn towards vial 3404, thereby causing vial 3404 to rupture. Once ruptured, solution 3412 contained within vial 3404 mixes with solution 3442 to cause fishing lure 3400 to emanate visible light through the process of chemiluminescence.

In an alternate embodiment as illustrated in FIG. 34C, plate 3414 replaces wedge portion 3406. Similarly as discussed above, rotation of actuator 3402 draws plate 3414 closer to vial 3404, which causes vial 3404 to rupture. Once ruptured, solution 3412 contained within vial 3404 mixes with solution 3442 to cause fishing lure 3400 to emanate visible light through the process of chemiluminescence.

Figure 34E:
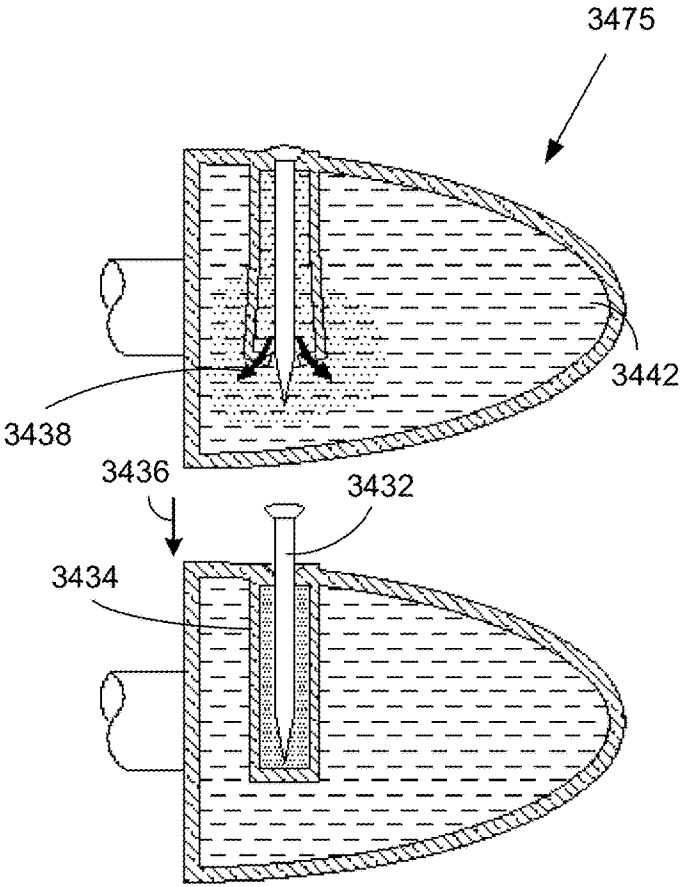
Figure 34D:
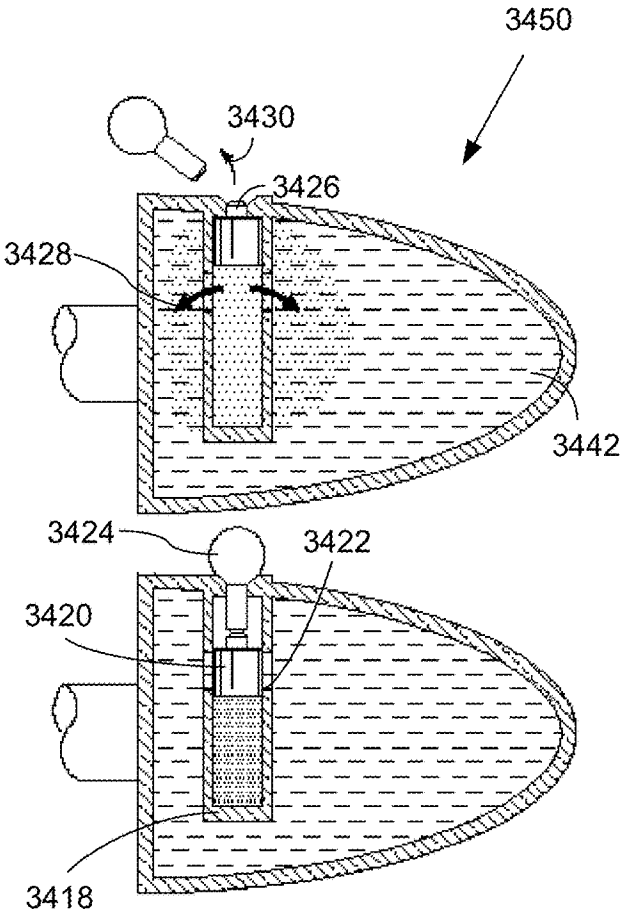

Turning to FIG. 34D, yet another embodiment is illustrated, whereby an alternate mechanism integrated within fishing lure 3450 may be actuated to cause the emanation of visible light from fishing lure 3450. Vial 3418 accepts plunger 3420, which is attached to actuator 3424, thereby preventing solution contained within vial 3418 from escape. Pulling actuator 3424 away from fishing lure 3450 in direction 3430 causes plunger 3420 to be removed from vial 3418, which then causes solution 3428 to mix with solution 3442 to cause fishing lure 3450 to emanate visible light through the process of chemiluminescence.

In an alternate embodiment as illustrated in FIG. 34E, push-pin 3432 acts as the actuation mechanism for fishing lure 3475. By pressing push-pin in direction 3436, vial 3434 ruptures, causing solution 3438 contained within vial 3434 to mix with solution 3442 to cause fishing lure 3475 to emanate visible light through the process of chemiluminescence.

It is noted that the self-illuminating objects illustrated in FIGS. 34A-34E provide an actuation mechanism that allows a rupturing function to be performed on a vial contained within an object, such as a fishing lure, without the need to manipulate any other portion of the object. For example, fishing lure 3400 of FIG. 34A provides a bullet-shaped portion that includes actuator 3402, which enables a rupturing function to be performed on vial 3404 without manipulating any other part of the bullet-shaped portion. Accordingly, the bullet-shaped portion may be manufactured to be completely non-pliable to increase the durability of the bullet-shaped portion, while nevertheless maintaining the ability to rupture vial 3404 via actuator 3402. It is further noted that the actuation mechanisms provided herein and their equivalents may be incorporated within any other self-illuminating objects provided herein or their equivalents.

Figure 35B:
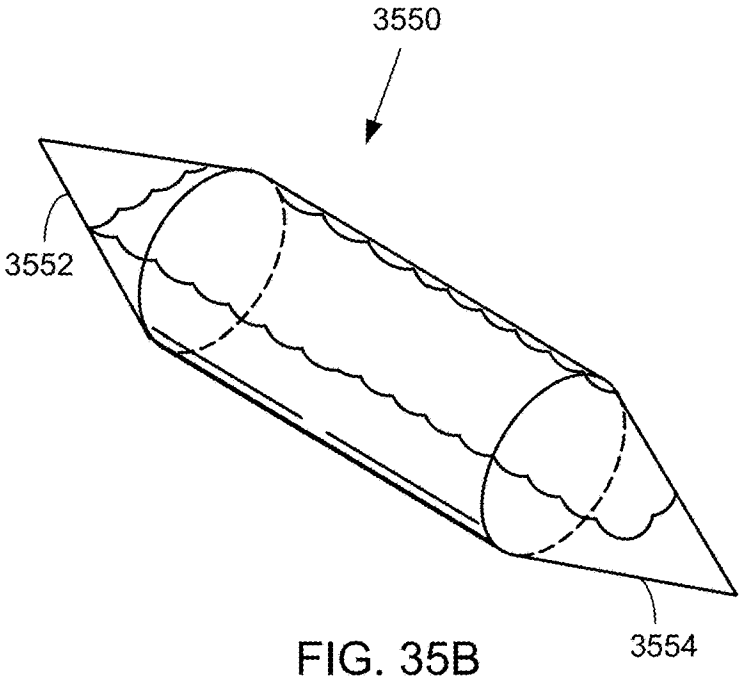
FIGS. 35A-35B illustrate self-illuminating sports/entertainment devices in accordance with alternate embodiments of the present invention.
Figure 35A:
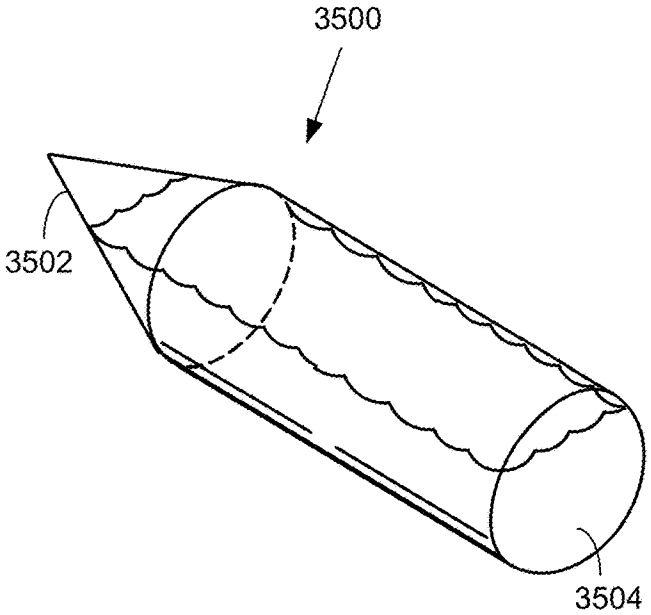

Turning to FIG. 35A, an alternate embodiment is illustrated, whereby manipulation via steps 102-106 of FIG. 1 may be accomplished by manipulating an outer portion of objects 3500 and 3550 to rupture a vial (not shown) to cause self-illumination of objects 3500 and 3550. Object 3500 may be shaped in any manner, such as a smooth sided shape (e.g., a cylindrical shape) or a shape having intersecting sides (e.g., a rectangular or polygonal shape).

Object 3500 may include a tapered shape (e.g., cone shape 3502) having a substantially pointed end. Accordingly, object 3500 may be inserted into another object, such that the substantially pointed end of cone shape 3502 facilitates insertion of object 3500 into the other object. For example, a relatively soft object (e.g., a plastic or rubber object such as a rubber worm) may include a relatively soft outer portion around the entire object. Object 3500 may be pressed against the soft object, such that a pointed end of cone shape 3502 may press against the soft object. By applying pressure on back end 3504 of object 3500, object 3500 may penetrate the soft outer portion of the relatively soft object. The pointed end of cone shape 3502 may facilitate such a penetration by improving the ease at which object 3500 pierces the relatively soft outer portion of the plastic or rubber object and the ease at which object 3500 may be fully inserted into the plastic or rubber object. In so doing, self-illuminating object 3500 may be attached (e.g., inserted) into virtually any other object that allows penetration and insertion of another object. For example, virtually any plastic or rubber fishing lure may accept object 3500 by simply inserting object 3500 into the plastic or rubber fishing lure. Once activated, object 3500 may cause the plastic or rubber fishing lure to self-illuminate in accordance with the manner in which object 3500 is inserted into the plastic or rubber fishing lure.

Object 3550 illustrates an alternate embodiment of a self-penetrating, self-illuminating object, where each end of object 3550 may include tapered ends (e.g., cone shaped portions 3552 and 3554) where each tapered end may be tapered to a point. In so doing, object 3550 may be used to penetrate not one, but two other objects. Accordingly, two other objects (e.g., a plastic or rubber ball) may be joined together using object 3550. Once activated, the two joined objects may appear to be connected via a self-illuminated post (e.g., self-illuminating object 3550).

It should be noted that ends 3502 and 3552-3554 may not necessarily be cone shaped, but may employ any other tapered shape that may facilitate piercing. For example, ends 3502 and/or 3552-3554 may be tapered to a sharp edge that may facilitate piercing of another object by the sharp edge.

Other aspects and embodiments of the present invention will be apparent to those skilled in the art from consideration of the specification and practice of the invention disclosed herein. For example, while heavy metal compositions, such as lead are provided herein, other heavy metal compositions may be utilized, such as copper, brass, steel, etc. In addition, while transparent or translucent materials, such as plastic are provided herein, other transparent or translucent materials may also be utilized, such as glass. Furthermore, multi-colored or multi-faceted wraps may be applied to the exteriors of the self-illuminating objects provided herein, so as to alter, modify, or otherwise enhance the illumination effects produced by the self-illuminating objects. Other materials, such as glitter, may also be added to the solution(s) contained within the self-illuminating objects to further enhance the illumination effects produced by the self-illuminating objects. It is intended, therefore, that the specification and illustrated embodiments be considered as examples only, with a true scope and spirit of the invention being indicated by the following claims.

What is claimed is:

1. A self-illuminating device, comprising:

a body portion having a skin layer and a hollow channel, the hollow channel extending throughout an interior of the body portion to form first and second diametrically opposed openings in the body portion, the body portion including, a first solution and a vial disposed between the skin layer and the hollow channel, the vial containing a second solution, wherein depression of the skin layer is operative to rupture the vial to mix the first and second solutions to cause self-illumination of the self-illuminating device.

2. The self-illuminating device of claim 1, wherein the body portion further includes a bladder disposed between the skin layer and the hollow channel.

3. The self-illuminating device of claim 2, wherein the bladder contains air.

4. The self-illuminating device of claim 2, wherein the bladder contains cork.

5. The self-illuminating device of claim 2, wherein the bladder contains air and cork.

6. The self-illuminating device of claim 2, wherein the bladder is configured to be buoyant.

7. The self-illuminating device of claim 2, wherein the bladder is configured to be non-buoyant.

8. The self-illuminating device of claim 1, wherein the body portion is spherically shaped.

9. The self-illuminating device of claim 1, wherein the body portion is cylindrically shaped.

10. The self-illuminating device of claim 1, wherein the body portion is shaped in the form of prey.

11. The self-illuminating device of claim 1, wherein the hollow channel is configured to accept a fishing line.

* * * * *